US011156225B2

(12) United States Patent
Park et al.

(10) Patent No.: US 11,156,225 B2
(45) Date of Patent: Oct. 26, 2021

(54) FLOW GENERATING DEVICE

(71) Applicant: LG ELECTRONICS INC., Seoul (KR)

(72) Inventors: Heechul Park, Seoul (KR); Myungjin Ku, Seoul (KR); Hongseok Kim, Seoul (KR); Eunsun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 54 days.

(21) Appl. No.: 16/641,702

(22) PCT Filed: Aug. 31, 2018

(86) PCT No.: PCT/KR2018/010140
§ 371 (c)(1),
(2) Date: Feb. 25, 2020

(87) PCT Pub. No.: WO2019/045516
PCT Pub. Date: Mar. 7, 2019

(65) Prior Publication Data

US 2020/0355191 A1 Nov. 12, 2020

(30) Foreign Application Priority Data

Sep. 1, 2017 (KR) ..... 10-2017-0112021

(51) Int. Cl.
*F04D 25/16* (2006.01)
*F04D 29/28* (2006.01)
(Continued)

(52) U.S. Cl.
CPC ..... *F04D 25/166* (2013.01); *F04D 29/281* (2013.01); *F04D 29/441* (2013.01); *F04D 29/703* (2013.01)

(58) Field of Classification Search
CPC .. F04D 25/166; F04D 29/4226; F04D 29/441; F04D 29/541; F04D 29/281
See application file for complete search history.

(56) References Cited

U.S. PATENT DOCUMENTS 4,738,188 A * 4/1988 Nishida ..... F24F 11/0001 454/229
6,030,173 A * 2/2000 Bacchiocchi ..... F04D 17/105 415/98

(Continued)

FOREIGN PATENT DOCUMENTS

DE 2456521 8/1976
EP 3273062 1/2018

(Continued)

OTHER PUBLICATIONS

International Search Report dated Dec. 26, 2018 issued in Application No. PCT/KR2018/010140.

(Continued)

*Primary Examiner* — Ninh H. Nguyen
(74) *Attorney, Agent, or Firm* — Ked & Associates, LLP

(57) ABSTRACT

An embodiment of the present invention relates to a flow generating device comprising: a main body comprising a first suction part and a second suction part disposed at sides opposite to each other, a first inner discharge part through which air suctioned into the first suction part passes, a second inner discharge part through which air suctioned into the second suction part passes, and at least one outer discharge part through which air passing through the first inner discharge part and air passing through the second inner discharge part are discharged to the outside; a first fan disposed between the first suction part and the first inner discharge part; and a second fan disposed between the second suction part and the second inner discharge part.

17 Claims, 36 Drawing Sheets

(51) Int. Cl.
*F04D 29/44* (2006.01)
*F04D 29/70* (2006.01)

(56) References Cited

U.S. PATENT DOCUMENTS

| | | | | |
|---|---|---|---|---|
| 7,158,716 | B2 * | 1/2007 | Shapiro | F04D 17/04 392/365 |
| 10,337,523 | B2 * | 7/2019 | Chou | F04D 25/0606 |
| 2012/0275915 | A1 | 11/2012 | Konishi et al. | |
| 2015/0204338 | A1 | 7/2015 | Tiainen et al. | |
| 2016/0252097 | A1 * | 9/2016 | Ha | F04D 25/088 415/213.1 |
| 2017/0059204 | A1 | 3/2017 | Iyer et al. | |

FOREIGN PATENT DOCUMENTS

| | | |
|---|---|---|
| JP | 2012-229657 | 11/2012 |
| KR | 20-1986-0013533 | 11/1986 |
| KR | 10-2002-0017126 | 3/2002 |
| KR | 20-0278255 | 6/2002 |
| KR | 10-0919317 | 10/2009 |
| KR | 10-2012-0049182 | 5/2012 |
| KR | 10-2016-0053650 | 5/2016 |

OTHER PUBLICATIONS

European Search Report dated Mar. 29, 2021 issued in Application No. 18852192.6.

* cited by examiner

FLOW GENERATING DEVICE

CROSS-REFERENCE TO RELATED PATENT APPLICATIONS

This application is a U.S. National Stage Application under 35 U.S.C. § 371 of PCT Application No. PCT/KR2018/010140, filed Aug. 31, 2018, which claims priority to Korean Patent Application No. 10-2017-0112021, filed Sep. 1, 2017, whose entire disclosures are hereby incorporated by reference.

TECHNICAL FIELD

Embodiments of the present invention relate to a flow generating device.

BACKGROUND ART

Generally, a flow generating device is understood as a device for driving a fan to generate an air flow and blowing the generated air flow to a position desired by a user. The flow generating device is usually called a "fan". Such a flow generating device may be mainly disposed in an indoor space such as a home or office and be used to provide cool and pleasant feeling to a user in hot weather such as summer.

With respect to this flow generating device, techniques of the following prior art document have been proposed in the related art.

PRIOR ART DOCUMENT 1

1. Publication Number (Published Date): 10-2012-0049182 (May 16, 2012)

2. Title of the Invention: AXIAL FLOW FAN

The axial flow fan disclosed in the prior art document 1 includes a rotational shaft portion, an inner blade group including a plurality of inner blades provided radially around the rotational shaft portion, and an outer blade group provided outside the inner blade group and including a plurality of outer blades provided radially around the rotational shaft portion. The axial flow fan may adjust a difference in wind velocity generated from each of the inner blade group and the outer blade group.

However, the axial flow fan disclosed in the prior art document 1 blows air from the rear side to the front side of the axial flow fan and may form airflow in only one direction, that is, the front-and-rear direction. Therefore, there is a limitation in that the air around the upper and lower sides of the axial flow fan or the air around the left and right sides of the axial flow fan quickly flows.

DISCLOSURE OF THE INVENTION

Technical Problem

An object of the present invention is to provide a flow generating device capable of making ambient air flow more quickly and stereoscopically.

Technical Solution

In order to achieve the above objects, a flow generating device according to an embodiment of the present invention includes: a main body including a first suction part and a second suction part disposed at sides opposite to each other, a first inner discharge part through which air suctioned into the first suction part passes, a second inner discharge part through which air suctioned into the second suction part passes, and at least one outer discharge part through which air passing through the first inner discharge part and air passing through the second inner discharge part are discharged to the outside; a first fan disposed between the first suction part and the first inner discharge part; and a second fan disposed between the second suction part and the second inner discharge part.

The outer discharge part may be opened in the main body in a radial direction.

An opening direction of the outer discharge part may intersect with each of an opening direction of the first suction part and an opening direction of the second suction part.

The outer discharge part may be opened in the main body in a horizontal direction.

A size of the outer discharge part may be smaller than the sum of a size of the first suction part and a size of the second suction part.

The main body may include: a first fan housing in which the first inner discharge part is formed; a second fan housing in which the second inner discharge part is formed; and a connector coupling the first fan housing and the second fan housing such that a discharge passage is formed between the first fan housing and the second fan housing.

The outer discharge part may communicate with the discharge passage.

The connector may be coupled to the first fan housing and the second fan housing such that the first fan housing and the second fan housing are disposed in parallel.

The main body may further include an outer discharge body which surrounds at least a portion of an outer circumference of the connector and in which the outer discharge part is formed.

The main body may include: a first cover in which the first suction part is formed; and a second cover in which the second suction part is formed, wherein the outer discharge body may be disposed between the first cover and the second cover.

The outer discharge body may define an inner curved surface guiding the air passing through the first inner discharge part and the air passing through the second inner discharge part toward the outer discharge part.

The inner curved surface may contact the outer circumference of the connector.

The connector may include: a first air guide defining a first discharge passage through which the air passing through the first inner discharge part passes; and a second air guide defining a second discharge passage through which the air passing through the second inner discharge part passes.

The outer discharge part may communicate with each of the first discharge passage and the second discharge passage.

The outer discharge part may include a first outer discharge part communicating with the first discharge passage, and a second outer discharge part communicating with the second discharge passage.

The flow generating device may include: a first air treating unit disposed between the first suction part and the second inner discharge part; and a second air treating unit disposed between the second suction part and the second inner discharge part.

One of the first air treating unit and the second air treating unit may be one of a temperature regulator, a cleanliness regulator, and a humidity regulator.

The other of the first air treating unit and the second air treating unit may be the other of the temperature regulator, the cleanliness regulator, and the humidity regulator.

A horizontal width of the main body may be reduced from a central portion toward upper and lower portions.

The main body may further include: an upper cover surrounding an outer circumference of the first fan; an inlet cover disposed above the upper cover and defining an upper suction hole; and a top cover disposed above the inlet cover and shielding the upper suction hole.

The flow generating device may further include: a base; and a leg provided below the main body and extending downward from the main body to be coupled to the base, wherein the second suction part faces the base in a vertical direction.

The leg may include: a leg main body coupled to the base and extending upward; and at least one leg extension part extending upward from the leg main body, wherein at least a portion of the at least one leg extension part is disposed below the second suction part.

The at least one leg extension part may include: a first leg extension part extending from the leg main body in one direction; and a second leg extension part extending from the leg main body in another direction different from the direction of the first leg extension part, wherein a gap is formed between the first leg extension part and the second leg extension part.

Advantageous Effects

According to the present invention, air around a main body is suctioned through a first suction part and a second suction part formed opposite to each other, air around the main body may be quickly suctioned and blown, and various stereoscopic air flows may be formed around the main body.

Also, since air over the main body and air under the main body are suctioned in both directions and discharged in the horizontal direction, the upper space around the main body and the lower space around the main body may be quickly ventilated.

BEST MODE

Exemplary embodiments of the present disclosure will be described below in more detail with reference to the accompanying drawings. The description of the present disclosure is intended to be illustrative, and those with ordinary skill in the technical field of the present disclosure pertains will be understood that the present disclosure may be carried out in other specific forms without changing the technical idea or essential features. Also, for helping understanding of the invention, the drawings are not to actual scale, but are partially exaggerated in size.

First Embodiment

Figure 1:
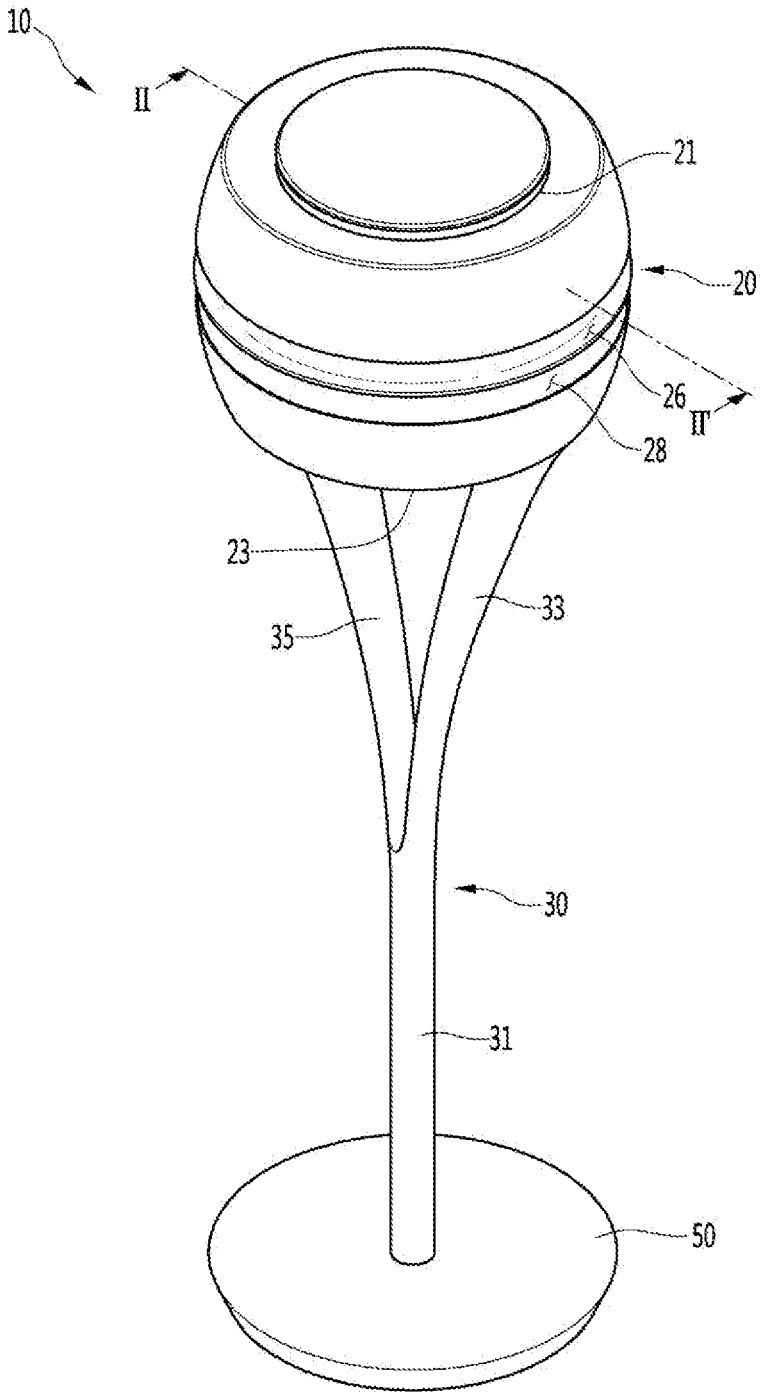
FIG. 1 is a perspective view illustrating a configuration of a flow generating device according to a first embodiment of the present invention.
Figure 2:
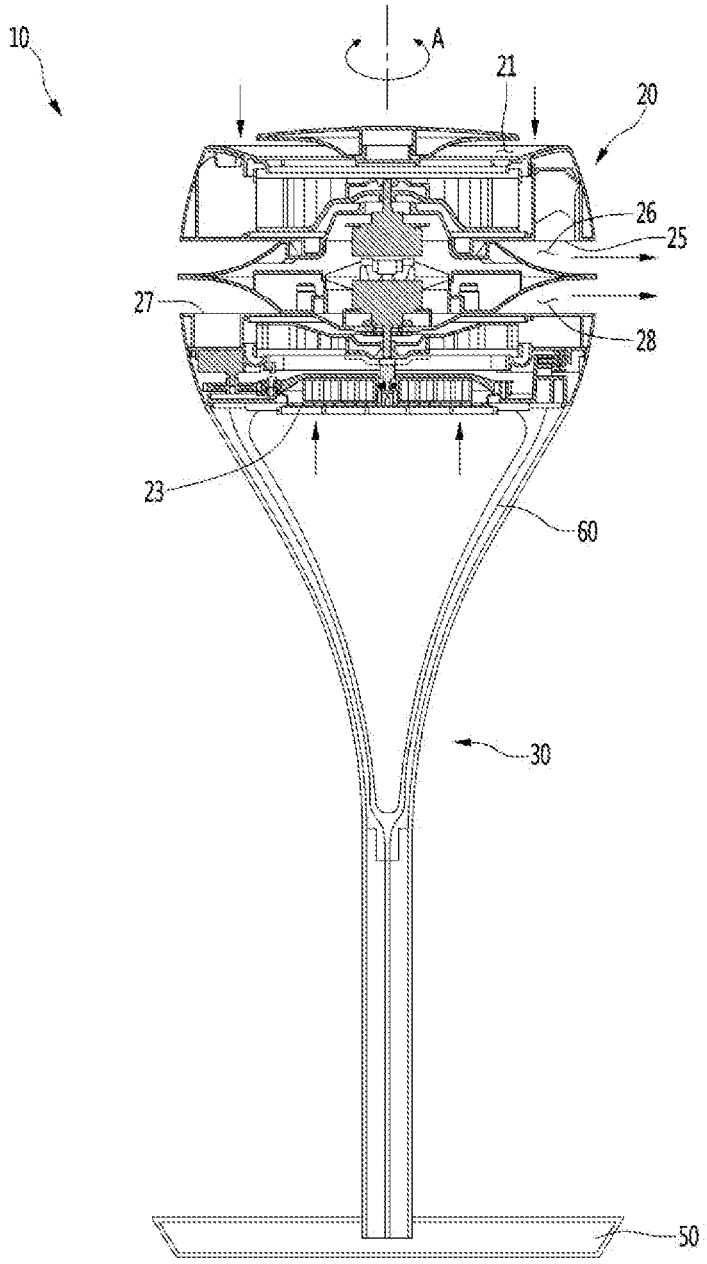
FIG. 2 is a cross-sectional view taken along line II-II' of FIG. 1.

FIG. 1 is a perspective view illustrating a configuration of a flow generating device according to an embodiment of the present invention, and FIG. 2 is a cross-sectional view taken along line II-II' of FIG. 1.

[Main Body]

Referring to FIGS. 1 and 2, a flow generating device 10 according to an embodiment of the present invention includes a main body 20 including suction parts 21 and 23 through which air is suctioned and inner discharge parts 25 and 27 through which air is discharged.

The main body 10 may form the appearance of the flow generating device 10.

[First and Second Suction Parts]

One pair of suction parts 21 and 23 may be provided in the main body 20, and one pair of suction parts 21 and 23 may be disposed on the opposite side of the main body 20. One pair of suction parts 21 and 23 may include a first suction part 21 and a second suction part 23 spaced apart from each other.

When one of the first suction part 21 and the second suction part 23 is formed above the main body 20, the other of the first suction part 21 and the second suction part 23 may be formed below the main body 20. In this case, the first suction part 21 and the second suction part 23 may be formed at different heights of the main body 20.

When the first suction part 21 is formed above the main body 20, the second suction part 23 may be formed below the main body 20, the air suctioned through the first suction part 21 may flow downward to be discharged to the central portion of the main body 21, and the air suctioned through the second suction part 23 may flow upward to be discharged to the central portion of the main body 21. The "central portion" of the main body 21 may represent a central portion of the main body 21 in a vertical direction.

[First and Second Inner Discharge Parts]

The inner discharge parts 25 and 27 may be disposed at the central portion of the main body 20.

One pair of inner discharge parts 25 and 27 may be provided inside the main body 20. One pair of inner discharge parts may include a first inner discharge part 25 and a second inner discharge part 27 spaced apart from the first inner discharge part 25.

One of the first inner discharge part 25 and the second inner discharge part 27 may be disposed to be higher than the other thereof.

The inner discharge parts 25 and 27 include a first inner discharge part 25 through which the air suctioned into the first suction part 21 is discharged and a second inner discharge part 27 through which the air suctioned into the second suction part 23 is discharged. The first inner discharge part 25 is disposed above the second inner discharge part 27.

Also, the first inner discharge part 25 may discharge the air in a direction of the second inner discharge part 27, and the second inner discharge part 27 may discharge the air in a direction of the first inner discharge part 25. In other words, a first air flow discharged from the first inner discharge part 25 and a second air flow discharged from the second inner discharge part 27 may flow to be close to each other.

The air discharged from the first inner discharge part 25 and the air discharged from the second inner discharge part 27 may be guided in a lateral direction or a radial direction of the main body 20. A passage through which the air discharged from the first inner discharge part 25 flows is called a "first discharge passage 26", and a passage through which the air discharged from the second inner discharge part 27 flows is called a "second discharge passage 28". Also, the first and second discharge passages 26 and 28 may be collectively called a "discharge passage".

[Direction Definition]

The direction will be defined. In FIGS. 1 and 2, a longitudinal direction may be referred to as an "axial direction" or a "vertical direction", and a transverse direction perpendicular to the axial direction may be referred to as a "radial direction".

[Leg]

The flow generating device 10 further includes a leg 30 provided below the main body 20. The leg 30 may extend downward from the main body 20 and be coupled to a base 50. The base 50 may be a component placed on the ground and support the main body 20 and the leg 30.

The leg 30 includes a leg body 31 coupled to the base 50 to extend upward. Also, the leg 30 further includes at least one leg extension part 33 and 35 extending upward from the leg body 31.

At least a portion of at least one leg extension parts 33 and 35 may be disposed below the second suction part 23. At least one leg extension parts 33 and 35 may include a separation part provided below the second suction part 23 to be spaced apart from the second suction part 23.

At least one leg extension parts 33 and 35 include a first leg extension part 33 extending from the leg body 31 in one direction and a second leg extension part 35 extending from the leg body 31 in the other direction different from the direction of the first leg extension part 33.

Each of the leg bodies 31 and 33 and the second leg extension part 35 may include a separation part disposed below the second suction part 23 and spaced apart from the second suction part 23. The separation part may minimize the inflow of a rod or a plastic bag into the second suction part 23.

The first and second leg extension parts 33 and 35 may be coupled to a lower portion of the main body 20. For example, the leg body 30 and the first and second leg extension parts 33 and 35 may have a "Y" shape.

A gap may be formed between the first and second leg extension parts 33 and 35, and the first and second leg extension parts 33 and 35 may function as a handle. The gap between the first and second leg extension parts 33 and 35 may face the second suction part 23 in a vertical direction.

<Configuration of Upper Module>

Figure 3:
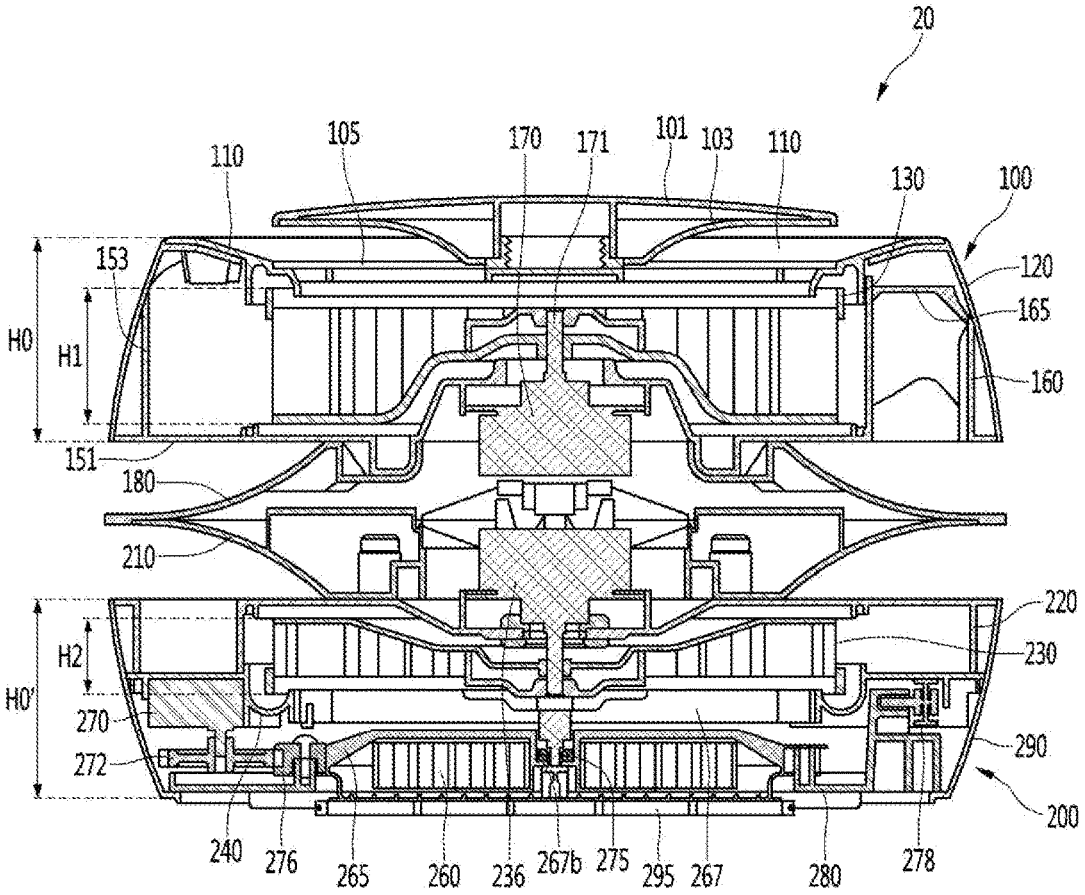
FIG. 3 is a cross-sectional view illustrating a configuration of an upper module and a lower module according to the first embodiment of the present invention.
Figure 4:
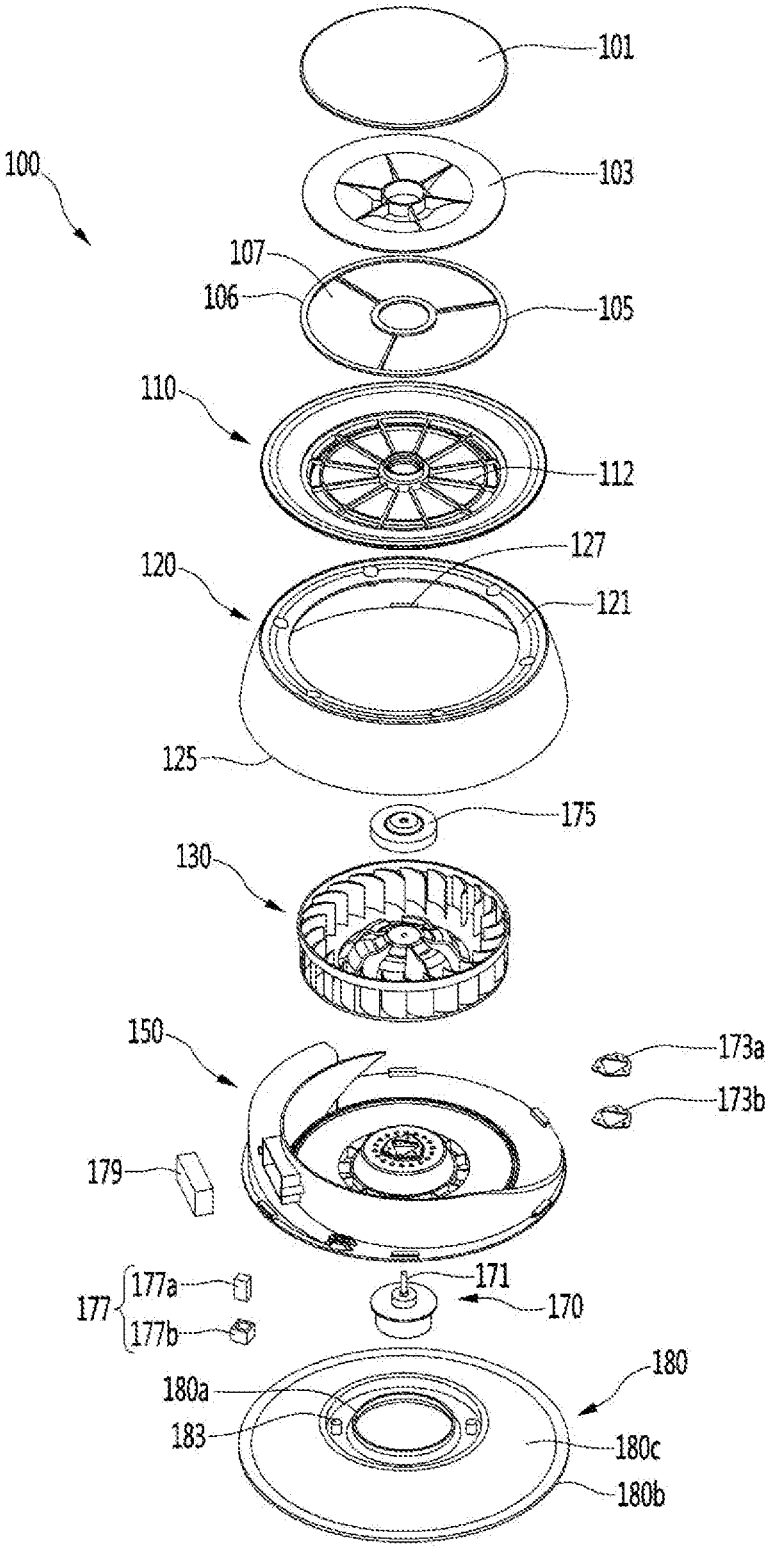
FIG. 4 is an exploded perspective view illustrating a configuration of the upper module according to the first embodiment of the present invention.

FIG. 3 is a cross-sectional view illustrating a configuration of an upper module and a lower module according to the first embodiment of the present invention, and FIG. 4 is an exploded perspective view illustrating a configuration of the upper module according to the first embodiment of the present invention.

Referring to FIGS. 3 and 4, the main body 20 includes an upper module 100 and a lower module 200 disposed below the upper module 100. The upper module 100 and the lower module 200 may be laminated in the vertical direction.

[Upper Fan and Upper Fan Housing]

The upper module 100 includes a first fan 130 that generates an air flow and an upper fan housing 150 in which the first fan 130 is installed.

The first fan 130 may be a fan that is higher in height than a second fan 230 described later. Hereinafter, the first fan 130 may be referred to as an upper fan 130.

The upper module 100 may include an upper fan 130 and an upper fan housing 150 in which the upper fan 130 is installed.

The first inner discharge part 25 may be an inner discharge part through which the air flowed by the upper fan 130 passes. The first inner discharge part 25 may be formed in the upper fan housing 150.

The upper fan 130 may include a centrifugal fan that suctions the air in the axial direction and discharges the suctioned air in the radial direction. For example, the upper fan 130 may include a sirocco fan.

The upper fan housing 150 may have a guide structure that supports a lower portion of the upper fan 130 and guides the air flow generated by rotation of the upper fan 130 to the first inner discharge part 25.

[First Air Treating Unit]

A first air treating unit that operates to air-condition or purify air flowing through the upper module 100 may be provided in the upper fan housing 150. For example, the first air treating device may be one of a temperature regulator and a purity regulator, and a humidity controller, and may include an ionizer 179 capable of removing floating microorganisms from the suctioned air.

The ionizer 179 may be installed on an ionizer mounting part (see reference numeral 168 of FIG. 5) provided in the upper fan housing 150. The ionizer mounting part 168 is provided on a guide wall 153. The ionizer 179 may be installed on the ionizer mounting part 168 and exposed to a first fan passage 138*a*. Thus, the ionizer 179 may act on the air passing through the upper fan 130 to perform a sterilizing function.

[Upper Motor]

The upper module 100 may further include an upper motor 170 connected to the upper fan 130 to provide driving force. An upper motor shaft 171 is provided on the upper motor 170. The upper motor shaft 171 may extend upward from the upper motor 170. Also, the upper motor 170 may be disposed below the upper fan housing 150, and the upper motor shaft 171 may be disposed to pass through the upper fan housing 150.

[Locking Part]

The upper module 100 further includes a locking part 175 coupled to the upper motor shaft 171. The locking part 175 is disposed on a hub (see reference numeral 131*a* of FIG. 5) of the upper fan 130 to fix the upper fan 130 to the upper motor shaft 171.

[Motor Damper]

The upper module 100 further includes motor dampers 173*a* and 173*b* damped between the upper motor 170 and the upper fan housing 150. The motor dampers 173*a* and 173*b* may be provided in plurality.

The upper motor damper 173*a* of the plurality of motor dampers 173*a* and 173*b* may be disposed above the upper fan housing 150 to support a portion of the upper motor shaft 171. Also, the lower motor damper 173*b* of the plurality of motor dampers 173*a* and 173*b* may be disposed below the upper fan housing 150 to support the other portion of the upper motor shaft 171 and be inserted between one surface of the upper motor 170 and a bottom surface of the upper fan housing 150.

[Upper Cover]

The flow generating device may include a first cover in which the first suction part 21 is formed. The first cover may further include an upper cover 120 disposed to surround the outer circumference of the upper fan 130 and the upper fan housing 150.

The upper cover 120 includes a cover inflow part 121 which has an opened upper end and through which the air suctioned through the first suction part 21 is introduced. Also, the upper cover 120 further includes a cover discharge part 125 having an opened lower end. The air passing through the upper fan 130 may flow to the first discharge passage 26 through the cover discharge part 125.

The cover discharge part 125 may have a size greater than that of the cover inflow part 121. Thus, the upper cover 120 may have a truncated conical shape with opened upper and lower ends. Due to this configuration, the air passing through the upper fan 130 may flow to be gradually spread in a circumferential direction and then easily discharged through the first inner discharge part 25.

[Upper Inlet Cover]

The first cover may further include an inlet cover 110 seated on the upper portion of the upper cover 120. An air passage, that is, an upper suction hole, may be formed in the inlet cover 110. The inlet cover 110 includes a cover grill 112 forming the upper suction hole. The air suctioned through the first suction part 21 may flow downward through the upper suction hole of the cover grill 112.

[First Pre-Filter]

The upper module 100 further includes a first pre-filter 105 supported by the inlet cover 110. The first pre-filter 105 may include a filter frame 106 and a filter member 107 coupled to the filter frame 106. Foreign substances contained in the air suctioned through the first suction part 21 may be filtered by the first pre-filter 105.

[Top Cover and Top Cover Support]

The first cover may further include a top cover support 103 coupled to an upper portion of the inlet cover 110 and a top cover 101 placed on an upper portion of the top cover support 103. The top cover support 103 may protrude upward from the inlet cover 110. The first suction part 21 may be formed between the top cover support 103 and the inlet cover 110.

A central portion of the top cover support 103 may be coupled to a central portion of the inlet cover 110, and a bottom surface of the top cover support 103 may extend to be rounded from the central portion of the top cover support 103 in the outer radial direction. Due to the configuration of the top cover support 103, the air suctioned through the first suction part 21 may be guide toward a cover grill 112 of the inlet cover 110 along the bottom surface of the top cover support 103.

[Upper Air Guide]

The upper module 100 may further include an upper air guide 180 provided below the upper fan housing 150 to guide the air passing through the upper fan housing 150 to the first discharge passage 26. The upper air guide 180 is configured to support the upper fan housing 150. Also, the upper fan housing 150 includes a first guide coupling part (see reference numeral 151*b* of FIG. 6) coupled to the upper air guide 180. A predetermined coupling member may be coupled to a first housing coupling part 183 of the upper air guide 180 through the first guide coupling part 151*b*.

The upper air guide 180 has a hollow plate shape. In detail, the upper air guide 180 includes a central portion 180*a* into which the upper motor 170 is inserted, an edge portion 180*b* defining an outer circumferential surface of the upper air guide 180, and a guide extension part 180*c* extending from the central portion 180*c* toward the edge portion 180*b* in an outer radial direction.

The guide extension part 180*c* may extend to be inclined downward or rounded downward from the central portion 180*a* toward the edge portion 180*b*. Due to this configuration, the air discharged downward from the upper fan housing 150 may easily flow in the outer radial direction.

[Detailed Configuration of Upper Fan]

Figure 5:
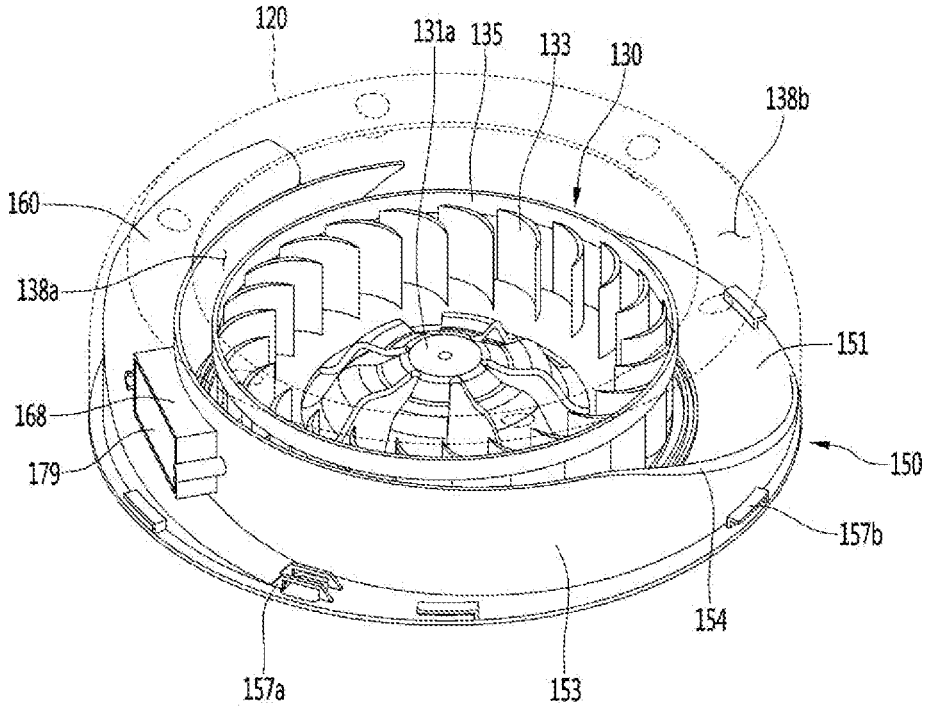
FIG. 5 is a view illustrating a configuration of an upper fan housing and an upper fan according to the first embodiment of the present invention.
Figure 6:
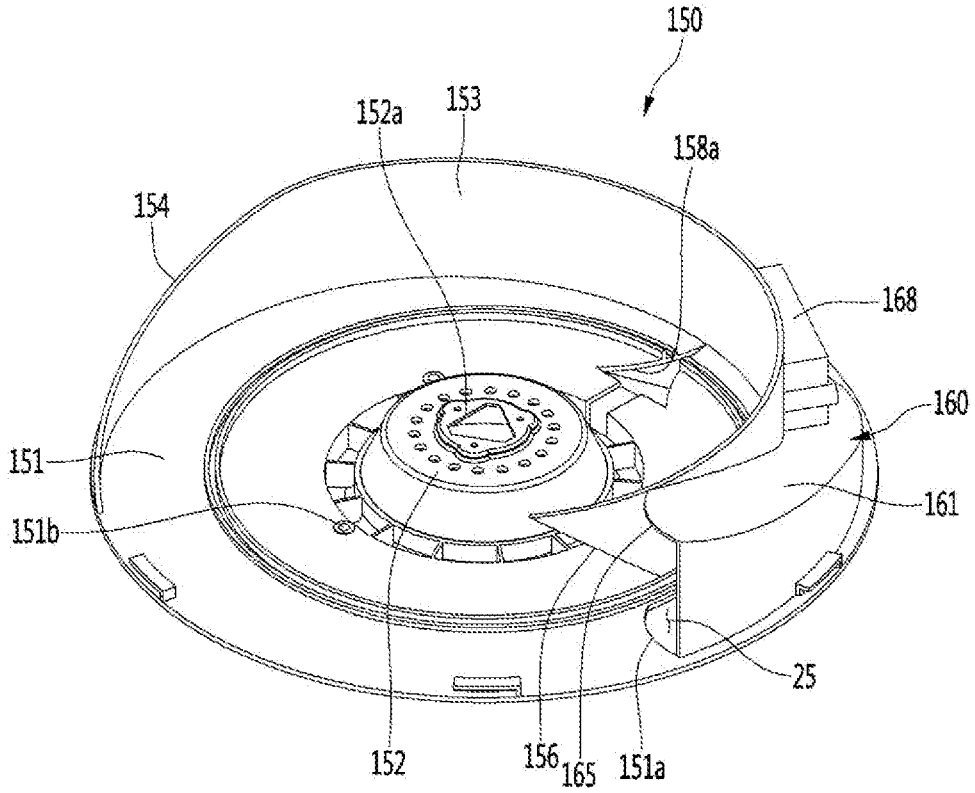
FIG. 6 is a perspective view of a configuration of the upper fan housing according to the first embodiment of the present invention.
Figure 7:
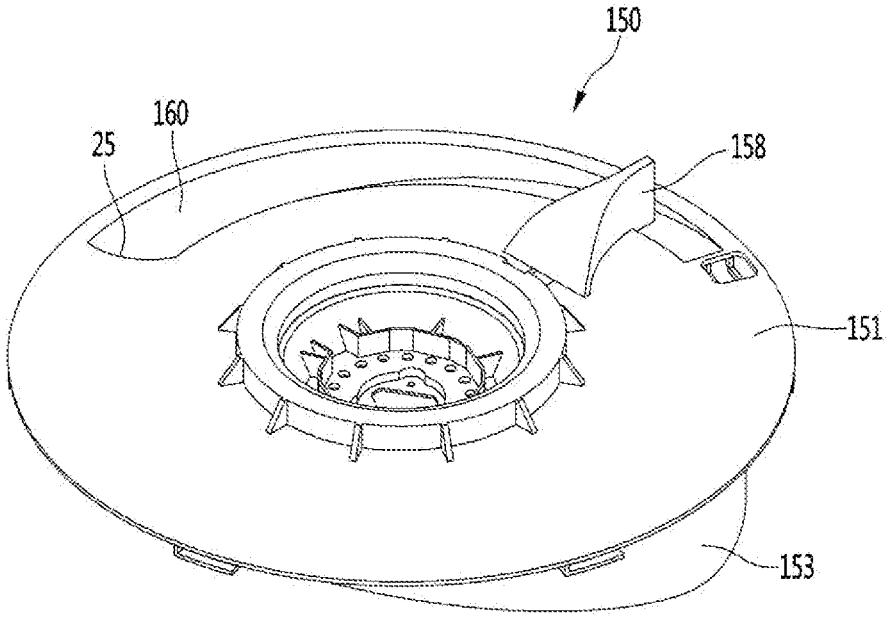
FIG. 7 is a bottom perspective view illustrating the configuration of the upper fan housing according to the first embodiment of the present invention.

FIG. 5 is a view illustrating a configuration of the upper fan housing and the upper fan according to the embodiment of the present invention, FIG. 6 is a perspective view of a configuration of the upper fan housing according to the embodiment of the present invention, and FIG. 7 is a bottom perspective view illustrating the configuration of the upper fan housing according to the embodiment of the present invention.

Referring to FIGS. 5 to 7, the upper module 100 may include the upper fan 130 generating an air flow and the upper fan housing 150 supporting the upper fan 130 and surrounding at least a portion of the outer circumferential surface of the upper fan 130.

The upper fan 130 may have a cylindrical shape as a whole. In detail, the upper fan 130 includes a main plate 131 to which a plurality of blades 133 are coupled and a hub 131*a* provided at a central portion of the main plate 131 to protrude upward. The hub 131*a* may be coupled to the upper motor shaft 171. The plurality of blades 133 may be disposed spaced apart from each other in a circumferential direction of the main plate 131.

The upper fan 130 further includes a side plate part 135 provided above the plurality of blades 133. The side plate part 135 fixes the plurality of blades 133. A lower end of each of the plurality of blades 133 may be coupled to the main plate 131, and an upper end of each of the plurality of blades 133 may be coupled to the side plate part 135.

The side plate 135 may be an upper ring spaced apart from the main plate 131 and coupled to an upper portion of each of the plurality of blades 133.

[Housing Plate of Upper Fan Housing]

The upper fan housing 150 includes a housing plate 151 supporting a lower portion of the upper fan 130 and a hub facing part 152 which is provided at a central portion of the housing plate 151 and on which the hub 131*a* of the upper fan 130 is seated. The hub facing part 152 may protrude upward from the housing plate 151 to correspond to the shape of the hub 131*a*.

[Guide Wall]

The upper fan housing 150 further includes a guide wall 153 protruding upward from the housing plate 151 and disposed to surround at least a portion of an outer circumferential surface of the upper fan 130. The guide wall 153 may extend to be rounded from a top surface of the housing plate 151 in the circumferential direction.

[First Fan Passage]

A first fan passage (see reference numeral 138*a* of FIG. 5) through which the air passing through the upper fan 130 flows may be formed between the inner circumference of the guide wall 153 and at least a portion of the outer circumferential surface of the upper fan 130. The first fan passage 138*a* may be understood as an air passage through which the air flows in the circumferential direction. That is, the air introduced in the axial direction of the upper fan 130 may be discharged in the radial direction of the upper fan 130 and guided by the guide wall 153 to flow while rotating in the circumferential direction along the first fan passage 138*a*.

The first fan passage 138*a* may have a cross-sectional area that gradually increases in the rotation direction of the air. That is, the first fan passage 138*a* may have a spiral shape. This may be called a "spiral flow". Due to this flow, the air passing through the upper fan 130 may be reduced in flow resistance, and also noise generated from the upper fan 130 may be reduced.

[First Inclined Part]

The guide wall 153 includes a first inclined part 154 extending to be inclined downward from an upper end of one side of the guide wall 153 toward the housing plate 151. The downwardly inclined direction may correspond to the air flow direction in the first fan passage 138*a*. Due to the configuration of the first inclined part 154, it is possible to have an effect of gradually increasing in flow cross-sectional area of the air in the air flow direction.

[Second Fan Passage]

In the state in which the upper cover 120 is coupled to the upper fan housing 150, a second fan passage (see reference numeral 138*b* of FIG. 5) disposed at a downstream side of the first fan passage 138*a* may be disposed between a portion of the outer circumferential surface of the upper fan 130 and an inner circumferential surface of the upper cover 120. The second fan passage 138*b* may extend from the first fan passage 138*a* in the circumferential direction in which the air flows. Thus, the air passing through the first fan passage 138*a* may flow to the second fan passage 138*b*.

The second fan passage 138*b* may have a flow cross-sectional greater than that of the first fan passage 138*a*. Thus, while the air flows from the first fan passage 138*a* to the second fan passage 138*b*, the flow cross-sectional area may increase to reduce flow resistance of the air passing through the upper fan 130 and noise generated from the upper fan 130.

[Second Inclined Part]

The guide wall 153 includes a first inclined part (see reference numeral 156 of FIG. 6) extending to be inclined downward from an upper end of the other side of the guide wall 153 toward the housing plate 151. The downwardly inclined direction may correspond to the air flow direction in the second fan passage 138*b*. The second inclined part 156 may be called a cut-off. Due to the configuration of the second inclined part 154, it is possible to have an effect of gradually increasing in cross-sectional area of the air flow in the air flow direction.

The first inclined part 154 and the second inclined part 156 define both ends of the guide wall 153. Also, the first inclined part 154 may be provided in a region between the first fan passage 138*a* and the second fan passage 138*b*, and the second inclined part 156 may be provided in a region between the second fan passage 138*b* and the flow guide part 160. As described above, the first and second inclined parts 154 and 156 may be provided on a boundary area, in which the air flow is changed, to improve flow performance of the air.

[Flow Guide Part]

The upper fan housing 150 may further include a flow guide part (see reference numeral 160 of FIG. 6) guiding a flow of the air passing through the second fan passage 138*b*. The flow guide part 160 protrudes upward from a top surface of the housing plate 151.

Also, the flow guide part 160 may be disposed on an outer surface of the guide wall 153. Due to the arrangement of the flow guide part 160, the air flowing in the circumferential direction via the first and second fan passages 138*a* and 138*b* may be easily introduced into the flow guide part 160. The flow guide part 160 includes a guide body (see reference numeral 161 of FIG. 6) extending to be inclined downward in the flow direction of the air, i.e., the circumferential direction. That is, the guide body 161 includes a rounded surface or an inclined surface.

An air passage is provided in the flow guide part 160. In detail, an inflow part 165 into which the air passing through the second fan passage 138*b* is introduced is provided in a front end of the flow guide part 160 with respect to the flow direction of the air. The inflow part 165 may be understood as an opened space part. The guide body 161 may extend to be inclined downward from the inflow part 165 toward the top surface of the housing plate 151.

[Cutoff Part]

A cutoff part (see reference numeral 151*a* of FIG. 6) is provided on the housing plate 151. The cutoff part 151*a* is understood as a portion in which at least a portion of the housing plate 151 passes in the vertical direction. The inflow part 165 may be disposed above the cutoff part 151*a*.

The inflow part 165 may define the first inner discharge part 25 together with the cutoff part 151*a*. The first inner discharge part 25 may be understood as a discharge hole for discharging the air flow existing above the housing plate 151, i.e., the air flowing through the first and second fan passages 138*a* and 138*b* to a lower side of the housing plate 151. Thus, the air flowing through the second fan passage 138*b* may flow to the lower side of the housing plate 151 through the first inner discharge part 25.

[First Discharge Guide Part]

A first discharge guide part (see reference numeral 158 of FIG. 7) for guiding the air flow discharged through the first inner discharge part 25 in the radial direction is provided on a bottom surface of the housing plate 151. The first discharge guide part 158 may protrude downward from the bottom surface of the housing plate 151 to extend from the central portion of the housing plate 151 in the outer radical direction. Also, the first discharge guide part 158 may be disposed at an outlet side of the first inner discharge part 25.

A plate recess part (see reference numeral 158*a* of FIG. 6) recessed downward is provided on the housing plate 151. The protruding shape of the first discharge guide part 158 may be realized by the plate recess part 158*a*. For example, the first discharge guide part 158 may be formed in a manner in which a portion of the housing plate 151 is recessed downward to form the plate recess part 158*a*.

The air flow discharged through the first inner discharge part 25 may have a rotating property. The upper air guide 180 together with the first discharge guide part 158 may guide the air flow in the radial direction.

Due to this configuration, the air suctioned downward to the upper fan 130 through the first suction part 21 is guided in the circumferential direction and thus has rotation force and is discharged through the first inner discharge part 25. Also, the discharged air may be guided by the first discharge guide part 158 and the upper air guide 180 and thus be easily discharged through the first discharge passage 26 in the radial direction.

[Support Mechanism of Upper Motor]

Figure 8:
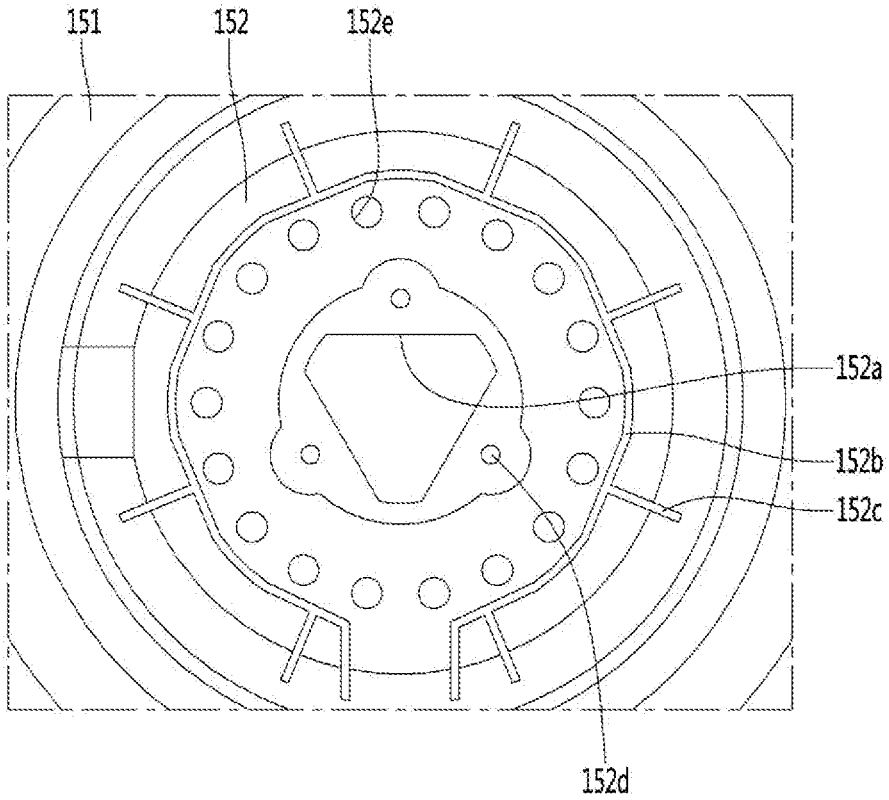
FIG. 8 is a view illustrating a lower configuration of a hub facing part according to the first embodiment of the present invention.
Figure 9:
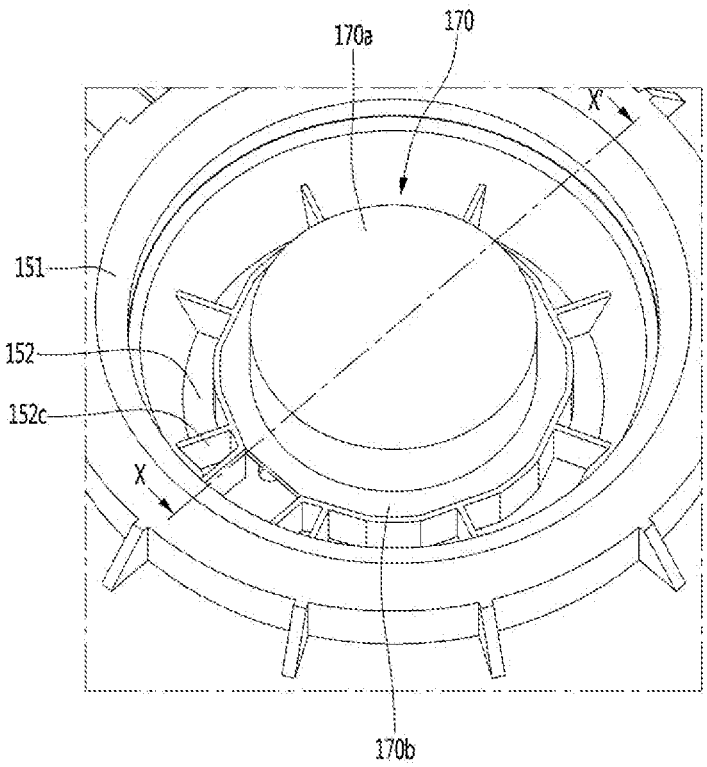
FIG. 9 is a view illustrating a state in which an upper motor is coupled to the hub facing part according to the first embodiment of the present invention.
Figure 10:
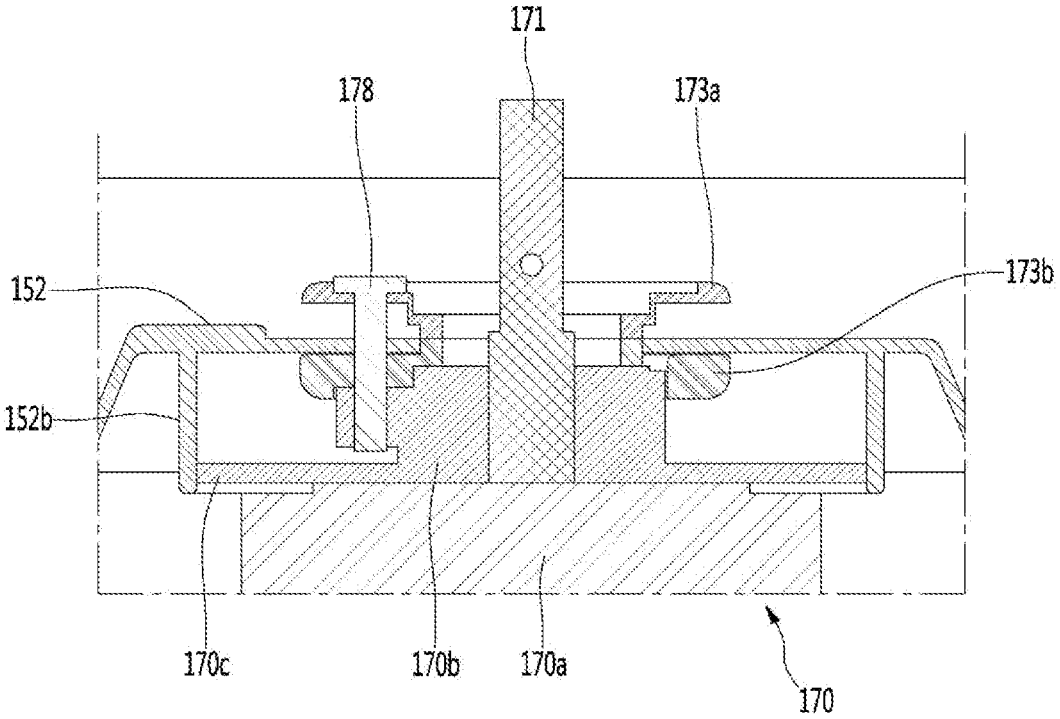
FIG. 10 is a cross-sectional view taken along line X-X' of FIG. 9.

FIG. 8 is a view illustrating a configuration of a lower configuration of the hub facing part according to the first embodiment of the present invention, FIG. 9 is a view illustrating a state in which the upper motor is coupled to the hub facing part according to the first embodiment of the present invention, and FIG. 10 is a cross-sectional view taken along line X-X' of FIG. 9.

A support mechanism of the upper motor 170 is provided below the hub facing part 152. A shaft through-hole 152*a* through which the upper motor shaft 171 passes may be defined in the support mechanism. The upper motor shaft 171 may extend upward from the upper motor 170 to pass through the shaft through-hole 152*a* and then be coupled to the upper fan 130.

[Support Rib]

The support mechanism further includes a support rib 152*b* supporting the upper motor 170. The support rib 152*b* may protrude downward from a bottom surface of the hub facing part 152 to extend in an approximately circumferential direction so as to support the edge portion of the upper motor 170.

[Reinforcement Rib]

The support mechanism may include a reinforcement rib 152*c* extending from the support rib 152*b* in the radial direction. The reinforcement rib 152*c* may be provided in plurality, and the plurality of reinforcement ribs 152*c* may be spaced apart from each other to be arranged in the circumferential direction.

[Coupling Hole]

The support mechanism further includes a coupling hole 152*d* to which the coupling member 178 is coupled. The coupling hole 152*d* may be defined outside the shaft through-hole 152*a* and, for example, may be provided in plurality. The coupling member 178 may couple the upper motor damper 173*a* and the lower motor damper 173*b* to the upper motor 170 and, for example, may include a screw.

In detail, the upper motor damper 173*a* may be disposed above the hub facing part 152, and the lower motor damper 173*b* may be disposed below the hub facing part 152. That is, the hub facing part 152 may be disposed between the upper motor damper 173*a* and the lower motor damper 173*b*.

The coupling member 178 passes through the upper motor damper 173*a* to extend downward and passes through the lower motor damper 173*b* via the coupling hole 152*d*. Also, the coupling member 178 may pass through the coupling hole 152*d* to extend downward and then be coupled to the upper motor 170.

[Discharge Hole]

A discharge hole 152*e* for discharging heat generated in the upper motor 170 is defined in the hub facing part 152. The discharge hole 152*e* may be provided in plurality. The plurality of discharge holes 152*e* may be arranged to be spaced apart from each other in the circumferential direction of the hub facing part 152. For example, the plurality of discharge holes 152*e* may be arranged in the circumferential direction outside the shaft through-hole 152*a*.

[Coupling Structure of Upper Motor and Coupling Member]

The coupling member 178 may be coupled to a motor fixing part 170*b* of the upper motor 170. In detail, the upper motor 170 includes a motor rotation part 170*a* rotating together with the upper motor shaft 171 and a motor fixing part 170*b* fixed to one side of the motor rotation part 170*a*. That is, the upper motor 170 includes an outer rotor type motor.

The motor fixing part 170*b* includes a motor PCB 170*c*. The motor PCB 170*c* may be supported by the support rib 152*b*. In detail, the motor PCB 170*c* may be restricted inside the support rib 152*b* to prevent the upper motor 170 from moving in a left and right direction (radial direction).

[Method for Assembling Upper Motor]

A method for assembling the upper motor 170 will be briefly described.

The motor rotation part 170*a* of the upper motor 170 may be grasped to locate the upper motor 170 below the hub facing part 152. Here, the upper motor damper 173*a* and the lower motor damper 173*b* may be disposed on a top surface and a bottom surface of the hub facing part 152.

Also, the upper motor 170 moves upward so that the upper motor shaft 171 is inserted into the shaft through-hole 152*a* of the hub facing part 152, and the motor PCB 170*c* is supported by the support rib 152*b*.

The motor dampers 173*a* and 173*b* and the motor fixing part 170*b* are coupled to each other by using the coupling member 178. A coupling member coupling part to which the coupling member 178 is coupled may be provided on the motor fixing part 170*b*. According to this structure and the assembly method, the motor PCB 170*c* may be easily disposed in a fixed position, and also, the upper motor 170 may be stably supported by the upper fan housing 150.

The description with respect to the coupling structure of the upper motor 170 may be equally applied to a coupling structure of the lower motor 236, which will be described below.

Figure 11:
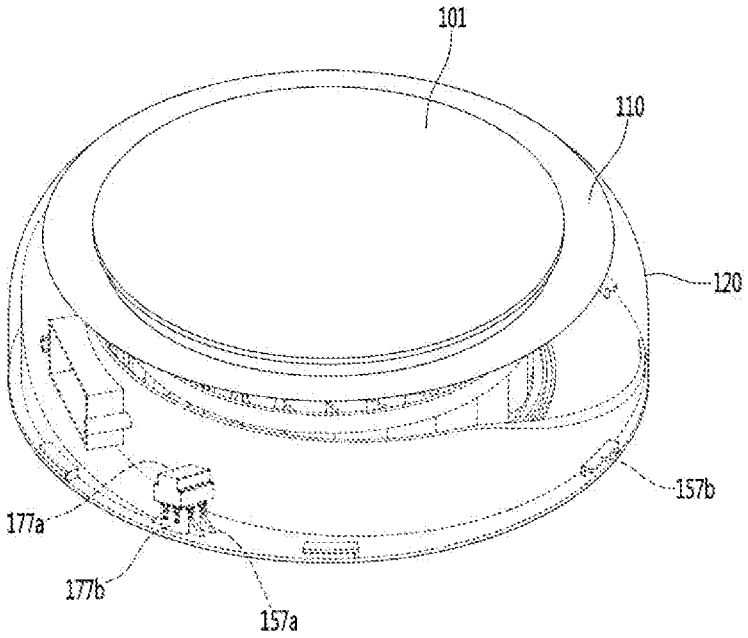
FIG. 11 is a view illustrating a state in which the upper cover and the upper fan housing according to the embodiment of the present invention are coupled.
Figure 12A:
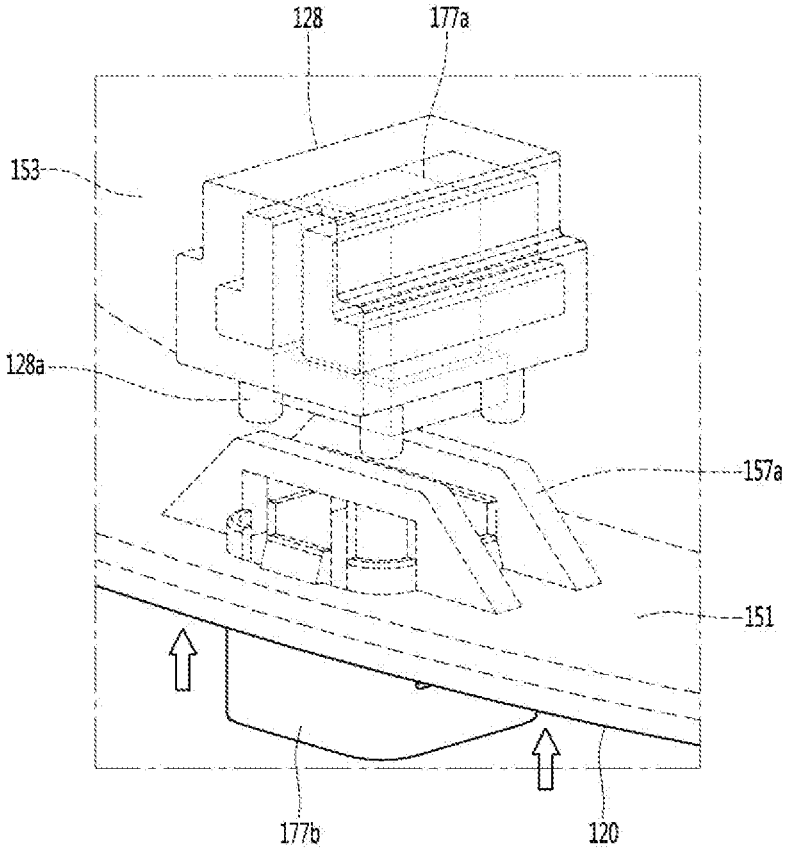
FIGS. 12A and 12B are views illustrating the configuration and operation of a circumferential locking mechanism of the upper cover according to the first embodiment of the present invention.
Figure 12B:
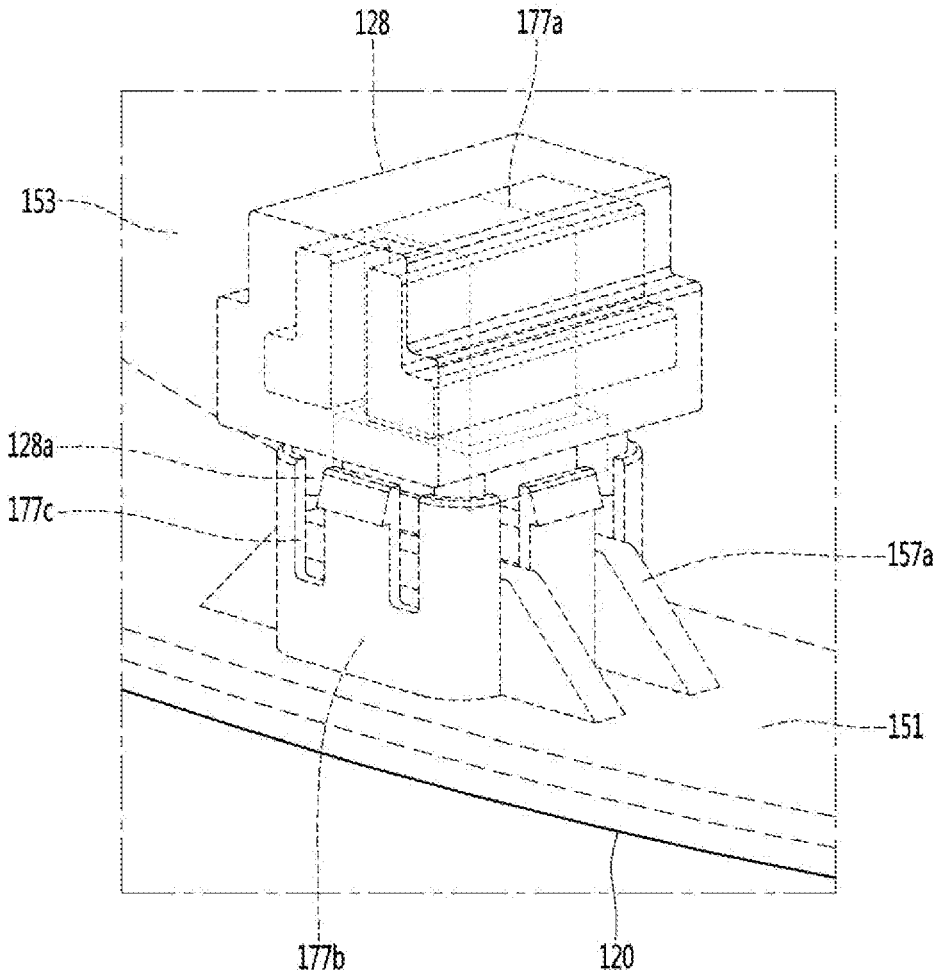
Figure 13A:
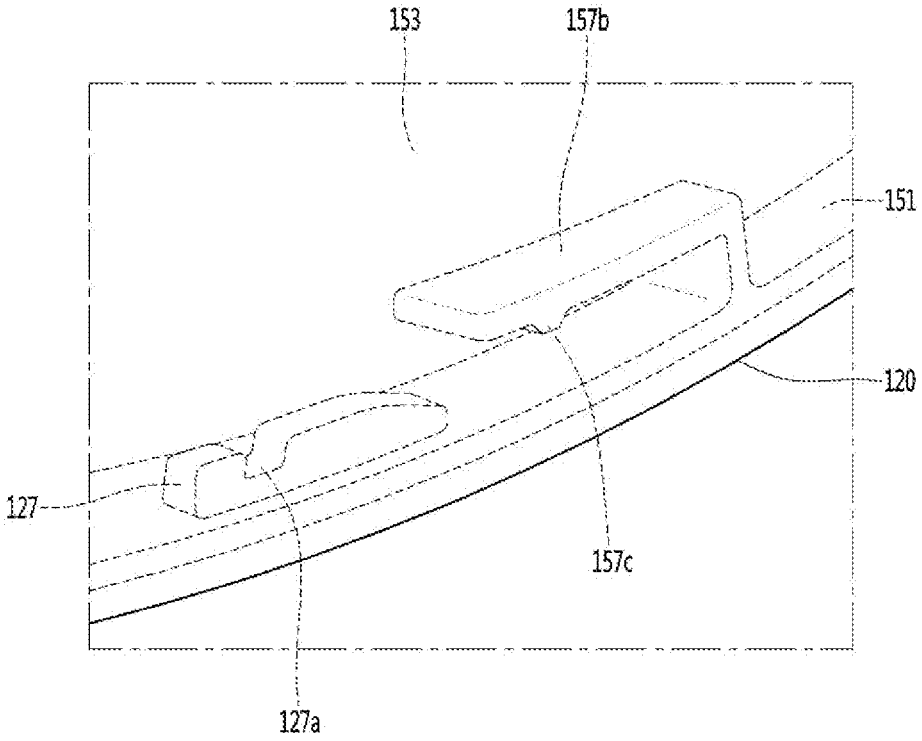
FIGS. 13A and 13B are views illustrating the configuration and operation of a vertical locking mechanism of the upper cover according to the first embodiment of the present invention.
Figure 13B:
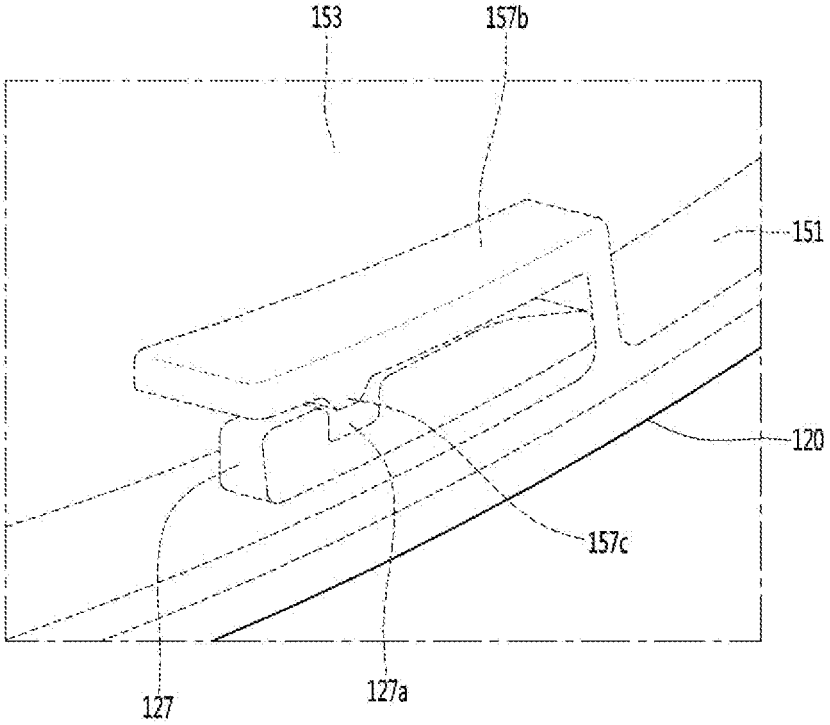

FIG. 11 is a view illustrating a state in which the upper cover and the upper fan housing according to the embodiment of the present invention are coupled, FIGS. 12A and 12B are views illustrating the configuration and operation of a circumferential locking mechanism of the upper cover according to the first embodiment of the present invention, and FIGS. 13A and 13B are views illustrating the configuration and operation of a vertical locking mechanism of the upper cover according to the first embodiment of the present invention.

[Locking Mechanism of Upper Cover in Radial Direction, Latch Assembly]

Referring to FIGS. 11, 12A, and 12B, the upper cover 120 according to the first embodiment of the present invention may be detachably installed in the flow generating device 10. In detail, the upper module 100 may include a locking mechanism that allows the upper cover 120 to be selectively locked to the upper fan housing 150 in the circumferential direction. The locking mechanism includes latch assemblies 177*a* and 177*b*.

The upper fan housing 150 includes a latch coupling part 157*a* to which the latch assemblies 177*a* and 177*b* are coupled. The latch coupling part 157*a* may be provided at the edge portion of the housing plate 151 and may protrude upward from the top surface of the housing plate 151.

The latch assemblies 177*a* and 177*b* include a first latch 177*a* inserted into the upper cover 120 and a second latch 177*b* movably coupled to the latch coupling part 157*a*. The first and second latches 177*a* and 177*b* may be coupled by an elastic member. The second latch 177*b* may be understood as a latch operated by a user and may be called a "latch switch".

[Latch Accommodation Part]

The upper cover 120 includes a latch accommodation part 128 into which the first latch 177*a* is inserted. The latch accommodation part 128 may be provided on the inner circumferential surface of the upper cover 120 and may have an opened lower end into which the first latch 177*a* may be inserted.

[Locking Protrusion]

The upper cover 120 may include a locking protrusion 128*a* for locking the second latch 177*b*. The locking protrusion 128*a* may be provided to protrude downward from the lower portion of the latch accommodation part 128. For example, the locking protrusion 128*a* may be provided in plurality on the lower edge side of the latch accommodation part 128.

[Latch Recessed Part]

The second latch 177*b* includes a latch recessed part 177*c*. The latch recessed part 177*c* is configured to be recessed downward from the upper portion of the second latch 177*b*. When the second latch 177*b* moves upward, the locking protrusion 128*a* may be inserted into and locked to the latch recessed part 177*c*. When the locking protrusion 128*a* is inserted, the second latch 177*b* is elastically deformed to guide the locking protrusion 128*a* to be inserted into the latch recessed part 177*c*. When the insertion of the locking protrusion 128*a* is completed, the second latch 177*b* is restored and locked to the locking protrusion 128*a*.

[Operation of Latch Assembly]

When the second latch 177*b* is pressed once, the locking to the locking protrusion 128*a* may be achieved. When the second latch 177*b* is pressed again, the locking to the locking protrusion 128*a* may be released.

In detail, when the user presses down the lower portion of the second latch 177*b* to move the second latch 177*b* upward, the second latch 177*b* may be locked to the locking protrusion 128*a*. At this time, the second latch 177*b* is in a state of being inserted into the upper fan housing 150, i.e., in a state of protruding upward from the housing plate 151. Therefore, it is possible to prevent the upper cover 120 from moving in the circumferential direction.

In this state, when the second latch 177*b* is pressed again, the second latch 177*b* is released from the locking to the locking protrusion 128*a*, moves downward due to the restoring force of the elastic member, and is in a state of protruding downward from the housing plate 151. The upper cover 120 may be detachable from the flow generating device 10.

In this state, the power applied to the flow generating device 10 may be cut off. Therefore, even when the upper cover is removed during operation of the flow generating device 10, the driving of the upper fan 130 is stopped to improve the stability of use.

In addition, the upper cover 120 may be separated from or coupled to the flow generating device 10 by a simple operation of the second latch 177*b*, thereby improving use convenience.

[Locking Mechanism of Upper Cover in Radial Direction]

Referring to FIGS. 13A and 13B, the upper module 100 may include a locking mechanism that enables the upper cover 120 to be selectively locked to the upper fan housing 150 in the vertical direction.

The locking mechanism includes a hook 157*b*. The hook 157*b* may have a shape that protrudes from the top surface of the housing plate 151 and bends in one direction, for example, an "¬" shape.

The upper cover 120 includes a hook coupling part 127 having a shape corresponding to the hook 157*b*. The hook coupling portion 127 may be disposed on the inner circumferential surface of the upper cover 120 and may be disposed to be seated on the top surface of the housing plate 151. The hook coupling part 127 may be fitted between the top surface of the housing plate 151 and the upper portion of the hook 157*b* in a state in which the upper cover 120 and the upper fan housing 150 are coupled.

The hook coupling part 127 defines a coupling groove 127*a*, and the hook 157*b* includes a hook protrusion 157*c*. For example, the coupling groove 127*a* is formed to be recessed downward from the upper portion of the hook coupling part 127, and the hook protrusion 157*c* may be provided so as to protrude downward from the upper bottom surface of the hook 157*b*.

During the rotation of the upper cover 120, the hook protrusion 157*c* may be inserted into the coupling groove 127*a*, and the upper cover 120 and the upper fan housing 150 may be stably coupled.

[Operation of Hook and Hook Coupling Part]

The upper cover 120 may be fitted to the outer side of the upper fan housing 150 and the hook coupling part 127 may be seated on the top surface of the housing plate 151. When the upper cover 120 is rotated clockwise or counterclockwise, the hook coupling part 127 may be fitted between the top surface of the housing plate 151 and the upper portion of the hook 157*b* while being rotating. That is, the locking may be achieved between the hook 157*b* and the hook coupling portion 127. Due to this locking operation, the upper cover 120 may be prevented from being separated upward or downward from the upper fan housing 150.

[Effect of Locking Mechanism]

As described above, the upper cover 120 may be stably coupled to the upper fan housing 150 by the locking mechanism in the circumferential direction of the upper cover 120 and the locking mechanism in the vertical direction. The upper cover 120 may be easily separated from the upper fan housing 150.

When the upper cover 120 is separated from the flow generating device 10, the upper fan housing 150 and the upper fan 130 may be exposed to the outside. Then, the exposed upper fan housing 150 and the exposed upper fan 130 may be cleaned. In summary, when the flow generating device 10 is operated, the upper fan housing 150 and the upper fan 130 may be shielded by the upper cover 120, thereby preventing a safety accident and improving the appearance. Meanwhile, since the upper cover 120 may be separated by simply operating the latch assemblies 177*a* and 177*b*, the cleaning convenience of the upper fan housing 150 or the upper fan 130 may be improved.

It should be noted that the description of the coupling structure of the upper cover 120 may be equally applied to the coupling structure of the lower cover 290, which will be described later.

<Configuration of Lower Module>

Figure 14:
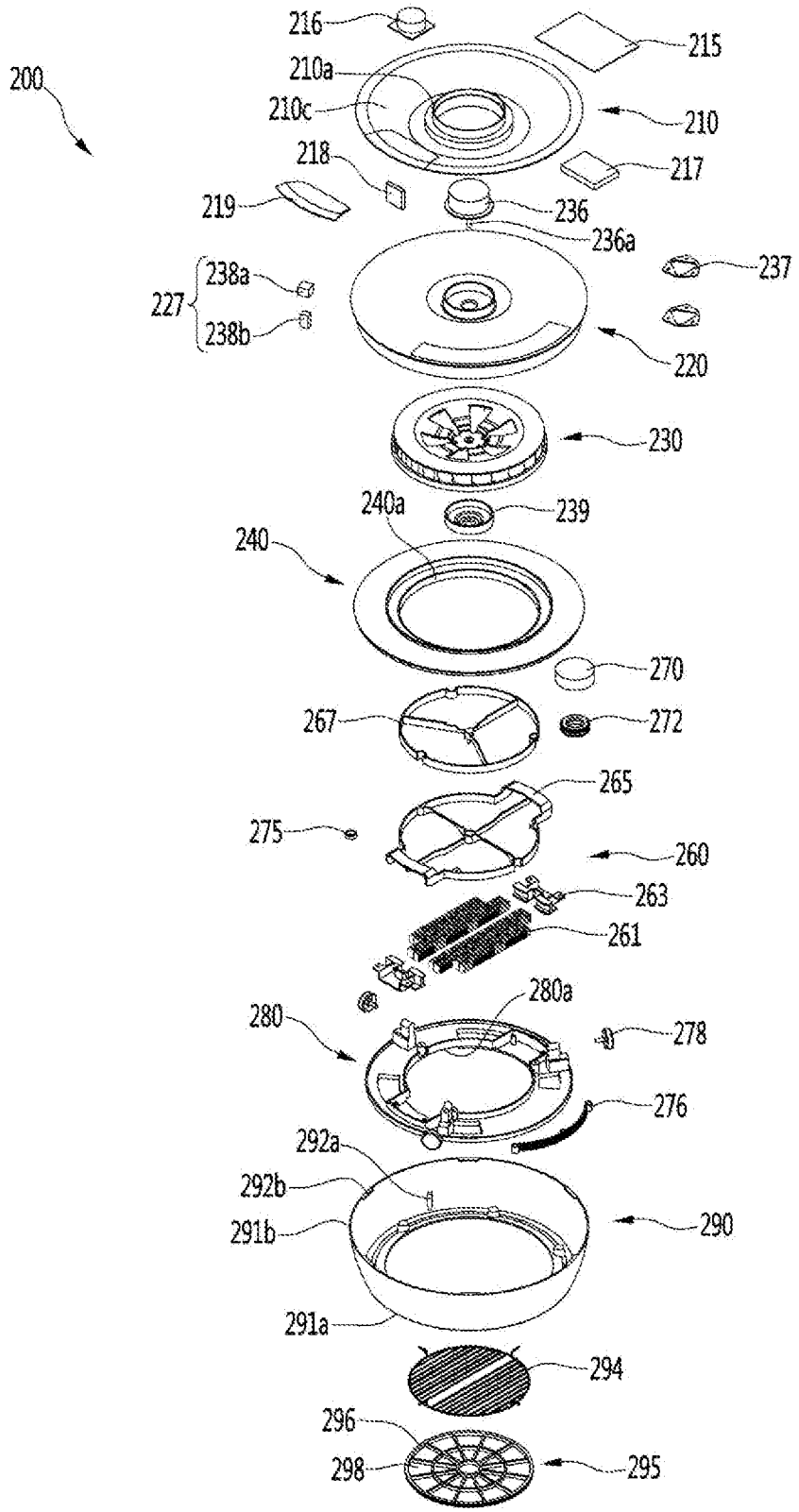
FIG. 14 is an exploded perspective view illustrating a configuration of the lower module according to the first embodiment of the present invention.

FIG. 14 is an exploded perspective view illustrating a configuration of the lower module according to the embodiment of the present invention.

[Lower Fan and Lower Fan Housing]

Referring to FIGS. 3 and 14, the lower module 200 includes a second fan 230 generating an air flow and a lower fan housing 220 in which the second fan 230 is installed.

The second fan 230 may be a fan disposed at a lower height than the upper fan 130, and will be referred to as a lower fan 230. The upper module 200 may include a lower fan 230 generating an air flow and a lower fan housing 220 in which the lower fan 230 is installed.

The second inner discharge part 27 may be an inner discharge part through which the air blown by the lower fan 230 passes. The second inner discharge part 27 may be formed in the lower fan housing 220.

The lower fan 230 may include a centrifugal fan that suctions the air in the axial direction and discharges the suctioned air in the radial direction. For example, the lower fan 230 may include a sirocco fan.

The lower fan housing 220 may include a guide structure coupled to the upper side of the lower fan 230 to guide the air flow generated by the rotation of the lower fan 230 to the second inner discharge part 27.

[Lower Motor]

The lower module 200 further includes a lower motor 236 connected to the lower fan 230 to provide driving force. A lower motor shaft 236*a* is provided below the lower motor 236. The lower motor shaft 236*a* may extend downward from the lower motor 236. Also, the lower motor 236 may be disposed above the lower fan housing 220, and the lower motor shaft 236*a* may be disposed to pass through the lower fan housing 220 and the lower fan 230. Also, a shaft coupling part (see reference numeral 234 of FIG. 16) to which the lower motor shaft 236*a* is coupled is provided on the lower fan 230.

[Locking Part]

The lower module 200 further includes a locking part 239 coupled to the lower motor shaft 236*a*. The locking part 239 is disposed at a lower side of a hub 231*a* of the lower fan 230 to fix the lower motor 236 to the lower fan 230.

[Motor Damper]

The lower module 200 further includes a motor damper 237 damped between the lower motor 236 and the lower fan housing 220. The motor damper 237 may be provided in plurality.

One of the plurality of motor dampers 237 may be provided above the lower fan housing 220 to support a portion of the lower motor shaft 236*a* and be inserted between one surface of the lower motor 236 and a top surface of the lower fan housing 220. Also, the other one of the plurality of motor dampers 237 may be provided below the lower fan housing 220 to support the other portion of the lower motor shaft 236*a*.

[Lower Cover]

The flow generating device may include a second cover in which the second suction part 23 is formed.

The second cover may further include a lower cover 290 disposed to surround the lower fan 230 and the lower fan housing 220.

The second suction part 23 may be formed below the lower cover 290 to open in the vertical direction. The second suction part 23 may face the base 50 in the vertical direction.

The leg 30 may support the main body 20 such that the second suction part 23 is spaced apart from the base 50, and the air outside the flow generating device may be suctioned through the second suction part 23 after passing between the main body 20 and the base 50.

The lower cover 290 may include a suction body part 291*a* formed with the second suction part 23 opened in the vertical direction. The suction body part 291*a* may be formed below the lower cover 290. The suction body part 291*a* may be formed below the lower cover 290 in a ring shape.

Also, the lower cover 290 further includes a cover discharge part 291*b* having an opened upper end. The air passing through the lower fan 230 may flow into the second discharge passage 28 through the cover discharge part 291*b*.

The size of the cover discharge part 291*b* may be larger than the size of the suction body part 291*a*. Therefore, the lower cover 290 may have a truncated conical shape with an open top end and an opened bottom end. Due to this configuration, the air passing through the lower fan 290 may flow to be gradually spread in a circumferential direction and then easily discharged through the second inner discharge part 27.

[Protection Member]

The lower module 200 further includes a protection member 294 provided below the lower cover 29*p* to block heat generated from a heater assembly 260. The protection member 294 may have an approximately circular plate shape. The protection member 294 may be made of a steel material that is not burned by heat. Due to the protection member 294, the heat may not be transferred to a second pre-filter 295 to prevent the second pre-filter 295 from being damaged.

[Second Pre-Filter]

The lower module 200 further includes the second pre-filter 295 provided below the protection member 294. The second pre-filter 295 may include a filter frame 296 and a filter member 297 coupled to the filter frame 296. Foreign substances contained in the air suctioned through the second suction part 23 may be filtered by the second pre-filter 295. It is understood that a lower space part of the second pre-filter 295 provides the second suction part 23.

[Lower Air Guide]

The lower module 200 further includes a lower air guide 210 provided below the lower fan housing 220 to guide the air passing through the lower fan housing 220. The lower air guide 210 has a hollow plate shape. In detail, the lower air guide 210 includes a central portion 210*a* into which the lower motor 236 is inserted, an edge portion 210*b* defining an outer circumferential surface of the lower air guide 210, and a guide extension part 210*c* extending from the central portion 210*a* toward the edge portion 210*b* in an outer radial direction.

The guide extension part 210*c* may extend to be inclined upward or rounded upward from the central portion 210*a* toward the edge portion 210*b*. Due to this configuration, the air discharged upward from the lower fan housing 220 through the second inner discharge part 27 may be guided in the radial direction to flow to the second discharge passage 28.

[PCB Device]

A plurality of components may be installed on a top surface of the guide extension part 210*c*. The plurality of components include a PCB device provided with a main PCB 215 for controlling the flow generator 10. Also, the PCB device further includes a regulator 216 stably supplying power to be supplied to the flow generator 10. Power having a constant voltage may be supplied to the flow generator 10 by the regulator 216 even though a voltage or frequency of input power varies.

[Communication Module]

The plurality of components further include a communication module. The flow generating device 10 may communicate with an external server through the communication module. For example, the communication module may include a Wi-Fi module.

[LED Device]

The plurality of components further include an LED device. The LED device may constitute a display part of the flow generating device 10. The LED device may be installed between the upper air guide 180 and the lower air guide 220 to emit light having a predetermined color. The color light emitted from the LED device may represent operation information of the flow generating device 10.

The LED device includes an LED PCB 218 on which an LED is installed and an LED cover 219 provided outside the LED PCB 218 in the radial direction to diffuse the light emitted from the LED. The LED cover 219 may be called a "diffusion plate".

[Coupling Structure of Upper Air Guide and Lower Air Guide]

The upper air guide 180 and the lower air guide 210 may be coupled to each other. The upper air guide 180 and the lower air guide 210 may be collectively called an "air guide device". The air guide device partitions the upper module 100 from the lower module 200. In other words, the air guide device may space the upper module 100 and the lower module 200 apart from each other. Also, the air guide device may support the upper module 100 and the lower module 200.

In detail, the lower air guide 210 may be coupled to a lower portion of the upper air guide 180. Due to the coupling between the upper air guide 180 and the lower air guide 210, a motor installation space is defined in each of the air guide devices 180 and 210. Also, the upper motor 170 and the lower motor 236 may be accommodated in the motor installation space. Due to this configuration, space utilization of the device may be improved.

[Latch Assembly]

The lower cover 290 may be provided separably from the flow generating device 10. In detail, a latch coupling part (see reference numeral 225*b* of FIG. 11) may be provided in the lower fan housing 220. Also, latch assembles 238*a* and 238*b* that are selectively hooked with the lower cover 290 may be coupled to the latch coupling part 225*b*. The latch assembles 238*a* and 238*b* include a first latch 238*a* inserted into the lower cover 290 and a second latch 238*b* movably coupled to the latch coupling part 225*b*.

The latch coupling part of the lower fan housing 220 may be provided at a position corresponding to the latch coupling part 157*a* provided in the upper fan housing 150. Also, the description with respect to the first and second latches 238*a* and 238*b* will be derived from that with respect to the first and second latches 177*a* and 177*b* of the upper module 100.

[Upper Orifice]

The lower module 200 further includes an upper orifice 240 which is provided below the lower fan housing 220 and in which a driving device for rotation of portions of the upper module 100 and the lower module 200 is installed. The upper orifice 240 have an opened central portion 240*a* and an annular shape. The central portion 240*a* may provide a passage for the air suctioned through the second suction part 23.

[Driving Device]

The driving device include a rotary motor 270 generating driving force. For example, the rotary motor 270 may include a step motor that is easy to adjust a rotation angle.

The driving device further includes a power transmission device connected to the rotary motor 270. The power transmission device may include a pinion gear 272 coupled to the rotary motor 270 and a rack gear 276 interlocked with the pinion gear 272. The rack gear 276 may have a shape that is rounded to correspond to a rotational curvature of each of the upper module 100 and the lower module 200.

[Lower Orifice]

The lower module 200 further includes a lower orifice 280 provided below the upper orifice 240. The lower orifice 280 is coupled to the leg 30. In detail, both sides of the lower orifice 280 may be coupled to the first leg extension part 33 and the second leg extension part 35. Thus, the lower orifice 280 may be understood as a fixed component of the lower module 200.

[Rack Gear]

The rack gear 276 may be coupled to the lower orifice 280. The lower orifice 280 have an opened central portion 280*a* and an annular shape. The central portion 280*a* may provide a passage for the air suctioned through the second suction part 23. Air passing through a central portion 280*a* of the lower orifice 280 may pass through a central portion 240*a* of the upper orifice 240.

[Second Air Treating Unit]

The lower module 200 further includes a second air treating unit that operates to air-condition or purify air flowing through the lower module 200.

The first air treating unit may be one of a temperature regulator, a cleanliness regulator, and a humidity regulator, and the second air treating unit may be the other one of the temperature regulator, the cleanliness regulator, and the humidity regulator.

The second air treating unit may perform a function different from the first air treating unit. For example, the second air treating unit includes a heater assembly 260 supported by the lower orifice 280 to generate predetermined heat.

In detail, the heater assembly 260 includes a heater 261. The heater 261 is disposed in the open central portion 280*a* of the lower orifice 240 and is capable of heating the air suctioned through the second suction part 23. For example, the heater 261 may include a PTC heater.

The heater assembly 260 further includes a heater bracket 263 supporting both sides of the heater 261. The heater bracket 263 may be coupled to the lower orifice 280.

[Roller]

The lower orifice 280 includes a roller guiding rotation of the upper module 100 and the lower module 200. The roller 278 may be coupled to an edge portion of the lower orifice 280 and provided in plurality in the circumferential direction. The roller 278 may contact a bottom surface of the upper orifice 240 to guide rotation, i.e., revolution of the upper orifice 240.

[Support]

The lower module 200 further includes supports 265 and 267 disposed above the heater assembly 260. The supports 265 and 267 include a first support 265 coupled to an upper portion of the heater 261 and a second support 267 coupled to an upper portion of the first support 265.

The first support 265 may space the heater assembly 260 and the lower fan 230 apart from each other to prevent heat generated from the heater assembly 260 from adversely affecting other components. Also, the second support 267 provides a rotation center of each of the upper module 100 and the lower module 200. Also, a bearing 275 is provided on the second support 267 to guide movement of the rotating component.

[Lower Fan and Lower Fan Housing]

Figure 15:
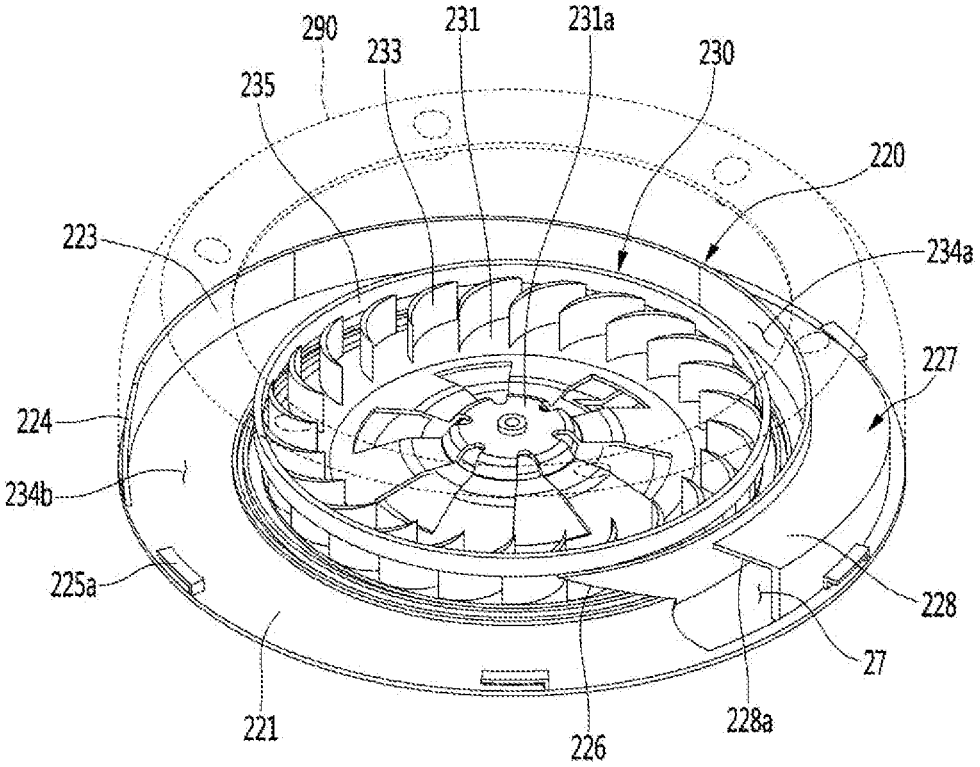
FIG. 15 is a view illustrating a configuration of a lower fan housing and a lower fan according to the first embodiment of the present invention.
Figure 16:
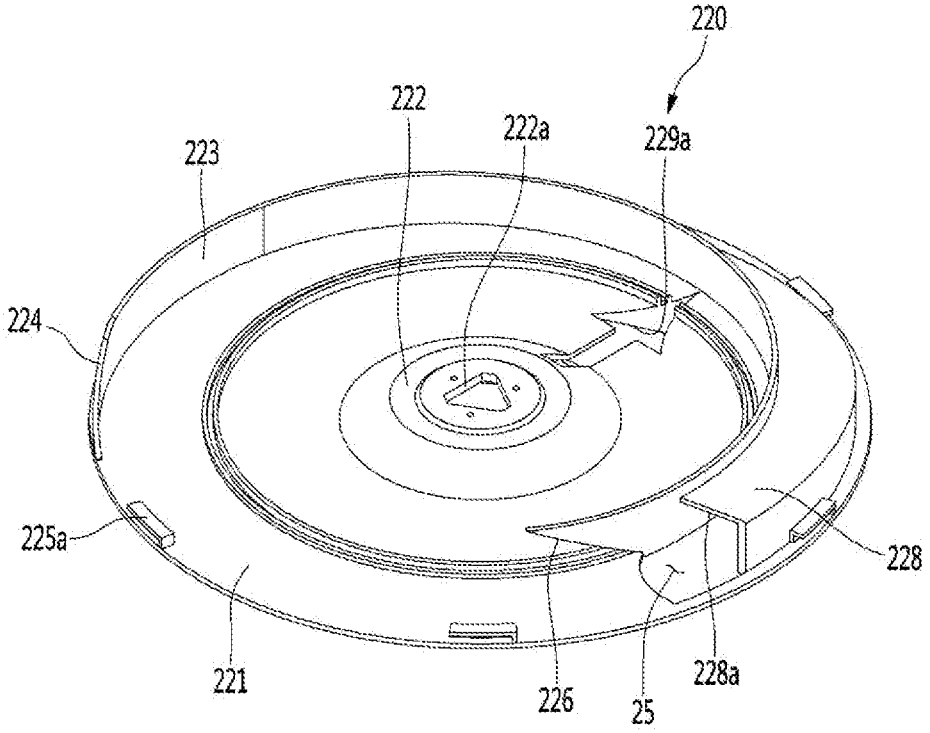
FIG. 16 is a perspective view illustrating a configuration of the lower fan housing according to the first embodiment of the present invention.
Figure 17:
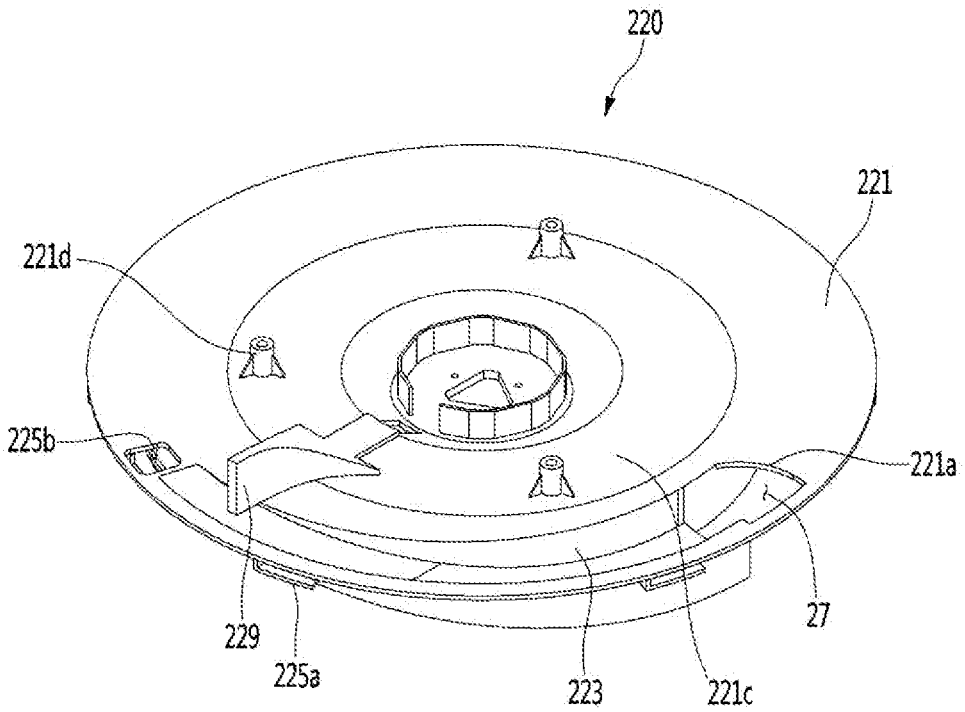
FIG. 17 is a bottom perspective view illustrating a configuration of the lower fan housing according to the first embodiment of the present invention.

FIG. 15 is a view illustrating the configuration of the lower fan housing and the lower fan according to the embodiment of the present invention, FIG. 16 is a perspective view of the configuration of the lower fan housing according to the embodiment of the present invention, and FIG. 17 is a bottom perspective view illustrating the configuration of the lower fan housing according to the embodiment of the present invention.

Referring to FIGS. 3 and 15 to 17, the lower module 200 according to the embodiment of the present invention includes the lower fan 230 generating an air flow and the lower fan housing 220 coupled to an upper portion of the lower fan 230 and surrounding at least a portion of the outer circumferential surface of the lower fan 230.

[Detailed Configuration of Lower Fan]

The lower fan 230 may have a cylindrical shape as a whole. In detail, the lower fan 230 includes a main plate 231 to which a plurality of blades 233 are coupled and a hub 231*a* provided at a central portion of the main plate 231 to protrude upward. The hub 231*a* may be coupled to the lower motor shaft 236*a*. The plurality of blades 233 may be disposed spaced apart from each other in a circumferential direction of the main plate 231.

The lower fan 230 further includes a side plate part 235 provided below the plurality of blades 233. The side plate part 235 fixes the plurality of blades 233. A lower end of each of the plurality of blades 233 may be coupled to the main plate 231, and a lower end of each of the plurality of blades 233 may be coupled to the side plate part 235.

[Difference in Size of Upper Fan and Lower Fan]

A vertical height Ho of the upper cover 120 and a vertical height Ho' of the lower cover 290 may be substantially the same. Due to this configuration, the flow generating device 10 may have a compact outer appearance and an elegant design.

On the other hand, a vertical height H2 of the lower fan 230 may be less than a vertical height H1 of the upper fan 130. This is done for compensating a height of the heater assembly 260 provided in only in the lower module 200. Here, the lower fan 230 may have a relatively low height. Thus, maximum performance of the upper fan 130 may be greater than that of the lower fan 230.

For example, when the upper fan 130 and the lower fan 230 rotate at the same number of revolution, an amount of air discharged from the upper module 100 may be greater than that of air discharged from the lower module 200. Thus, in order to control an amount of air discharged from the upper module 100 and an amount of air discharged from the lower module 200 to be the same, the number of revolution of the lower fan 230 may be adjusted to be greater than that of the upper fan 130. As a result, the mixed air flow discharged from the upper module 100 and the lower module 200 may be easily discharged in the radial direction without being biased upward and downward.

[Detailed Structure of Lower Fan Housing]

The lower fan housing 220 includes a housing plate 221 supporting an upper portion of the lower fan 230 and a hub facing part 222 which is provided at a central portion of the housing plate 221 and on which the hub 231*a* of the lower fan 230 is seated. The hub facing part 222 may protrude downward from the housing plate 221 to correspond to the shape of the hub 231*a*. Also, a shaft through-hole 222*a* through which the lower motor shaft 236*a* passes may be defined in the hub facing part 222*a*.

The lower fan housing 220 further includes a guide wall 223 protruding downward from the housing plate 221 and disposed to surround at least a portion of an outer circumferential surface of the lower fan 230. The guide wall 223 may extend to be rounded from a top surface of the housing plate 151 in the circumferential direction. Since the height H2 of the lower fan 230 is smaller than the height H1 of the upper fan 130, the height of the guide wall 223 of the lower fan housing 220 may be smaller than the height of the guide wall 153 of the lower fan housing 150.

[First Fan Passage]

A first fan passage 234*a* through which the air passing through the lower fan 230 flows is provided between the guide wall 223 and at least a portion of the outer circumferential surface of the lower fan 230. The first fan passage 234*a* may be understood as an air passage through which the air flows in the circumferential direction. That is, the air introduced in the axial direction of the lower fan 230 may be discharged in the radial direction of the lower fan 230 and guided by the guide wall 223 to flow while rotating in the circumferential direction along the first fan passage 234*a*.

The first fan passage 234*a* may have a cross-sectional area that gradually increases in the rotation direction of the air. That is, the first fan passage 234*a* may have a spiral shape. This may be called a "spiral flow". Due to this flow, the air passing through the lower fan 230 may be reduced in flow resistance, and also noise generated from the upper fan 230 may be reduced.

[First Inclined Part]

The guide wall 223 includes a first inclined part 223 extending to be inclined upward from a lower end of one side of the guide wall 224 toward the housing plate 221. The upwardly inclined direction may correspond to the air flow direction in the first fan passage 234*a*. Due to the configuration of the first inclined part 224, it is possible to have an effect of gradually increasing in flow cross-sectional area of the air in the air flow direction.

[Effect of Hook and Hook Coupling Part]

The housing plate 221 includes a hook 225*a* hooked with the lower cover 290. The hook 225*a* may have a shape that protrudes from the top surface of the housing plate 151 and then is bent in one direction, e.g., a "¬" shape. A hook coupling part (see reference numeral 292*b* of FIG. 8) having a shape corresponding to the hook 225*a* is provided on the lower cover 290. The description with respect to the hook 225*a* and the hook coupling part 292*b* will be derived from that with respect to the hook 157*b* and the hook coupling part 127 of the upper module 100.

[Second Fan Passage]

In the state in which the lower cover 290 is coupled to the lower fan housing 220, a second fan passage 234*b* disposed at a downstream side of the first fan passage 234*a* may be disposed between a portion of the outer circumferential surface of the lower fan 230 and an inner circumferential surface of the lower cover 290. The second fan passage 234*b* may extend from the first fan passage 234*a* in the circumferential direction in which the air flows. Thus, the air passing through the first fan passage 234*a* may flow to the second fan passage 234*b*.

The second fan passage 234*b* may have a flow cross-sectional greater than that of the first fan passage 234*a*. Thus, while the air flows from the first fan passage 234*a* to the second fan passage 234*b*, the flow cross-sectional area may increase to reduce flow resistance of the air passing through the upper fan 230 and noise generated from the lower fan 230.

[Second Inclined Part]

The guide wall 223 includes a second inclined part 226 cut off to be inclined upward from a lower end of the other side of the guide wall 223 toward the housing plate 221. The upwardly inclined direction may correspond to the air flow direction in the second fan passage 234*b*. The second inclined part 226 may be called a cut-off. Due to the configuration of the second inclined part 226, it is possible to have an effect of gradually increasing in cross-sectional area of the air flow in the air flow direction.

The first inclined part 224 and the second inclined part 226 may define both ends of the guide wall 223. Also, the first inclined part 224 may be provided in a region between the first fan passage 234*a* and the second fan passage 234*b*, and the second inclined part 226 may be provided in a region between the second fan passage 234*b* and the flow guide part 227. As described above, the first and second inclined parts 224 and 226 may be provided on a boundary area, in which the air flow is changed, to improve flow performance of the air.

[Flow Guide Part]

The lower fan housing 220 further includes a flow guide part 227 guiding the air passing through the second fan passage 234*b*. The flow guide part 227 protrudes downward from a bottom surface of the housing plate 221. For convenience of description, the flow guide part 160 provided in the upper module 100 is called a "first flow guide part", and the flow guide part 227 provided in the lower module 200 is called a "second flow guide part".

Also, the flow guide part 227 may be disposed on an outer surface of the guide wall 223. Due to the arrangement of the flow guide part 227, the air flowing in the circumferential direction via the first and second fan passages 234*a* and 234*b* may be easily introduced into the flow guide part 227. The flow guide part 227 includes a guide body 228 extending to be inclined downward in the flow direction of the air, i.e., the circumferential direction. That is, the guide body 228 includes a rounded surface or an inclined surface.

An air passage is provided in the flow guide part 227. In detail, an inflow part 228*a* into which the air passing through the second fan passage 234*b* is introduced is provided in a front end of the flow guide part 227 with respect to the flow direction of the air. The inflow part 228*a* may be understood as an opened space part. The guide body 228 may extend to be inclined upward from the inflow part 228*a* toward the top surface of the housing plate 221.

[Cutoff Part]

A cutoff part 221*a* is provided on the housing plate 221. The cutoff part 221*a* is understood as a portion in which at least a portion of the housing plate 221 passes in the vertical direction. The inflow part 1228*a* may be disposed below the cutoff part 221*a*.

The inflow part 228*a* can define the second inner discharge part 27 together with the cutoff part 221*a*. The second inner discharge part 27 can be understood as a discharge hole for discharging the air flow existing below the housing plate 221, i.e., the air flowing through the first and second fan passages 234*a* and 234*b* to an upper side of the housing plate 221. Thus, the air flowing through the second fan passage 234*b* may flow to the upper side of the housing plate 221 through the second inner discharge part 27.

[Second Discharge Guide Part]

A second discharge guide part 229 for guiding the air flow discharged through the second inner discharge part 27 in the radial direction is provided on a top surface of the housing plate 221. The second discharge guide part 229 may protrude upward from the top surface of the housing plate 221 to extend from the central portion of the housing plate 151 in the outer radical direction. Also, the second discharge guide part 229 may be disposed at an outlet side of the second inner discharge part 27, and may be disposed at a lower side of the first discharge guide part 158.

A plate recess part 229*a* recessed upward is provided on the housing plate 221. The protruding shape of the second discharge guide part 229 may be realized by the plate recess part 229*a*. For example, the second discharge guide part 229 may be formed in a manner in which a portion of the housing plate 221 is recessed upward to form the plate recess part 229*a*.

[Effect of Second Discharge Guide Part]

The air flow discharged through the second inner discharge part 27 may have a rotating property. Thus, when the air contacts the second discharge guide part 229, the air flow direction may be changed into the radial direction by the second discharge guide part 229 and then be discharged. Alternatively, the lower air guide 210 together with the second discharge guide part 229 may guide the air flow in the radial direction.

Due to this configuration, the air suctioned upward toward the lower fan 230 through the second suction part 23 may be guided in the circumferential direction and thus have rotation force. Then, the air may be discharged through the second inner discharge part 27 and be guided by the second discharge guide part 229 and the lower air guide 210 so that the air is easily discharged through the second discharge passage 28 in the radial direction.

[Guide Seating Part]

A guide seating part 221*c* on which the lower air guide 210 is seated is provided on the top surface of the housing plate 221. The lower air guide 210 may be stably supported by the guide seating part 221*c*. Also, a second guide coupling part 221*d* to which the lower air guide 210 is coupled is provided on the guide seating part 221*c*. A predetermined coupling member may be coupled to the lower air guide 210 through the second guide coupling part 221*d*.

[Upper Orifice and Lower Fan]

Figure 18:
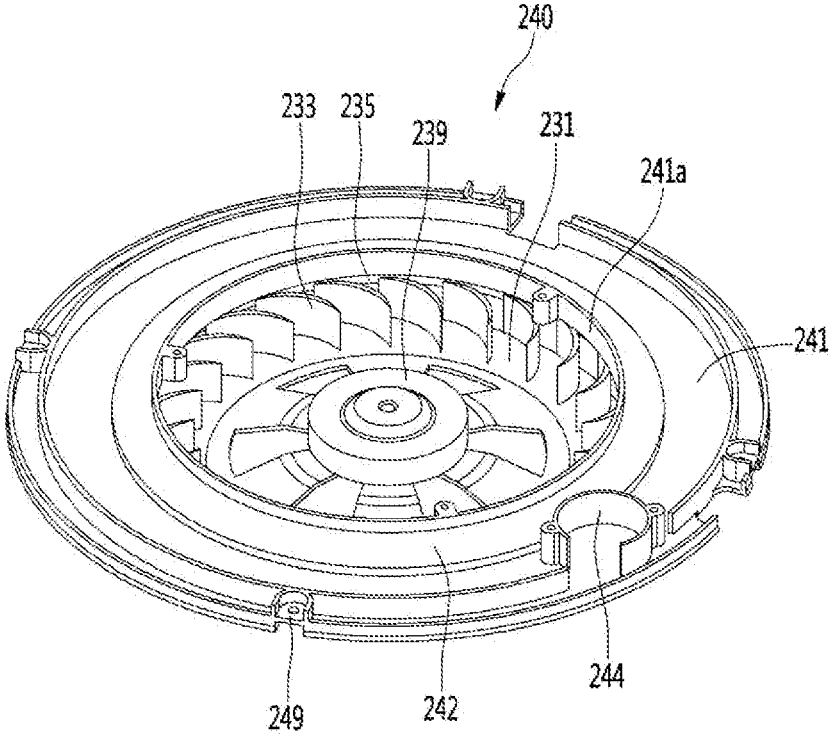
FIG. 18 is a perspective view illustrating a configuration of an upper orifice and the lower fan according to the first embodiment of the present invention.
Figure 19:
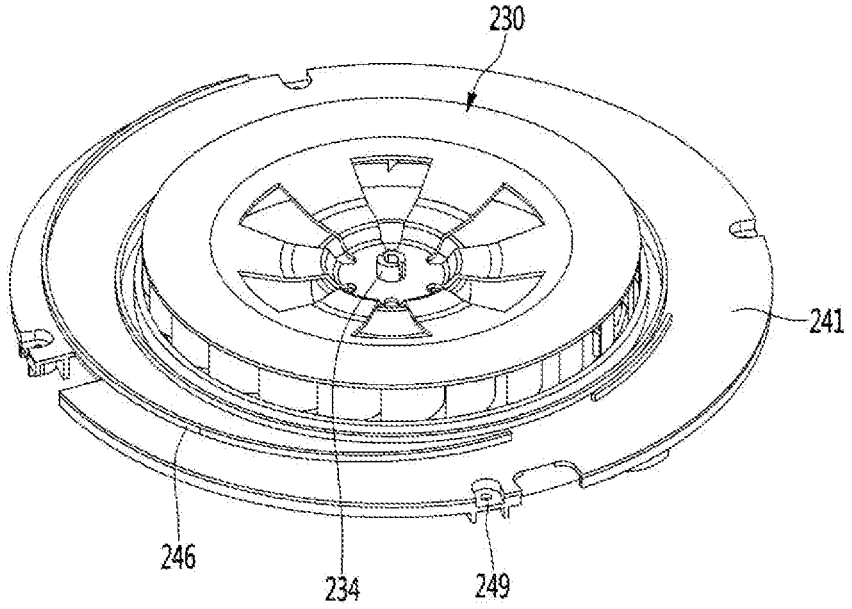
FIG. 19 is a bottom perspective view illustrating a configuration of an upper orifice and the lower fan according to the first embodiment of the present invention.
Figure 20:
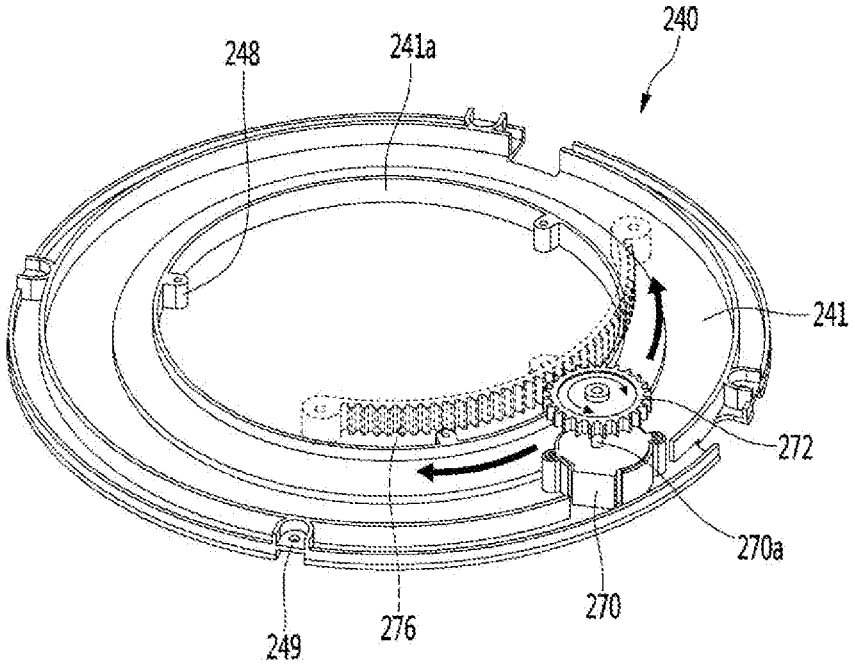
FIG. 20 is a perspective view illustrating a state in which a rotary motor is installed on the upper orifice according to the first embodiment of the present invention.

FIG. 18 is a perspective view illustrating a configuration of the upper orifice and the lower fan according to the embodiment of the present invention, FIG. 19 is a bottom perspective view illustrating a configuration of the upper orifice and the lower fan according to the embodiment of the present invention, and FIG. 20 is a perspective view illustrating a state in which a rotary motor is installed on the upper orifice according to the embodiment of the present invention.

[Upper Orifice Body]

Referring to FIGS. 3 and 18 to 20, the upper orifice 240 according to an embodiment is coupled to a lower portion of the lower fan housing 220. In detail, the upper orifice 240 includes an upper orifice body 241 having an opened central portion 241*a*. The opened central portion 241*a* may provide an air passage through which air is transferred to the lower fan 230. The upper orifice body 241 may have an approximately annular shape by the opened central portion 241*a*.

[Fan Guide]

The upper orifice 240 includes a fan guide 244 into which the side plate part 235 of the lower fan 230 is inserted. The fan guide 244 may protrude downward from a bottom surface of the upper orifice body 241. The fan guide 244 may be disposed to surround the opened central portion 241*a*.

[Motor Support]

The upper orifice 240 further includes a motor support 244 supporting the rotary motor 270. The motor support 244 may protrude downward from the upper orifice body 241 and be disposed to surround an outer circumferential surface of the rotary motor 270. The rotary motor 270 may support the bottom surface of the upper orifice body 241 and be inserted into the motor support 244.

[Driving Device]

The lower module 200 includes a driving device generating driving force to guide the rotation of the upper module 100 and the lower module 200. The driving device includes the rotary motor 270 and gears 272 and 276. The gears 272 and 276 may include a pinion gear 272 and a rack gear 276.

The rotary motor 270 may be coupled to the pinion gear 272. The pinion gear 272 may be disposed below the rotary motor 270 and coupled to a motor shaft 270*a* of the rotary motor 270. When the rotary motor 270 is driven, the pinion gear 272 may also rotate.

The pinion gear 272 may be interlocked with the rack gear 276. The rack gear 276 may be fixed to the lower orifice 280. Since the rack gear 276 is a fixed component, when the pinion gear 272 rotates, the rotary motor 270 and the pinion gear 272 may rotate, i.e., revolve around a center of the opened central portion 241*a* of the upper orifice 240. Also, the upper orifice 240 supporting the rotary motor 270 rotates.

[Second Support Coupling Part]

The upper orifice 240 further includes a second support coupling part 248 coupled to the second support 267. The second support coupling part 248 may be provided on an inner circumferential surface of the central portion 241*a* of the upper orifice 240. The second support 267 includes a second coupling part 267*d* coupled to the second support coupling part 248. A predetermined coupling member may be coupled to the second coupling part 267*d* through the second support coupling part 248.

[Cover Coupling Part]

The upper orifice 240 further includes a cover coupling part 249 coupled to the lower cover 290. The cover coupling part 249 may be provided in plurality along an edge portion of the upper orifice body 241. The plurality of cover coupling parts 249 may be disposed spaced apart from each other in the circumferential direction.

[Orifice Coupling Part]

The lower cover 290 includes an orifice coupling part 292*a* coupled to the cover coupling part 249. The orifice coupling part 292*a* is disposed on an inner circumferential surface of the lower cover 290 and provided in plurality to correspond to the cover coupling part 249. A predetermined coupling member may be coupled to the cover coupling part 249 through the orifice coupling part 292*a*.

[Wall Support]

The upper orifice 240 further includes a wall support supporting the guide wall 223 of the lower fan housing 220. The wall support 246 may protrude upward from the top surface of the upper orifice body 241. Also, the wall support 246 may support an outer circumferential surface of the guide wall 223.

[Lower Orifice and Heater Assembly]

Figure 21:
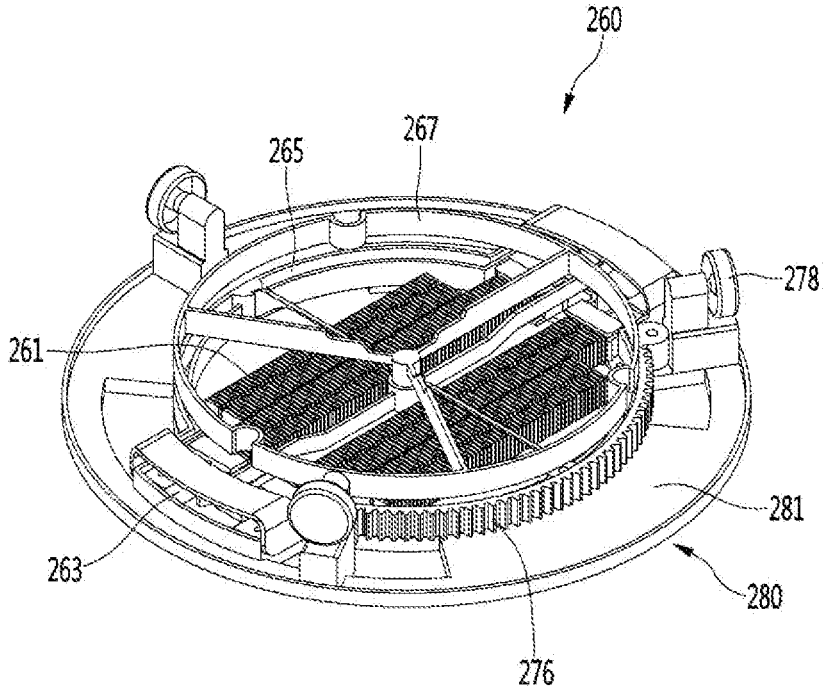
FIG. 21 is a perspective view illustrating a configuration of a heater assembly according to the first embodiment of the present invention.
Figure 22:
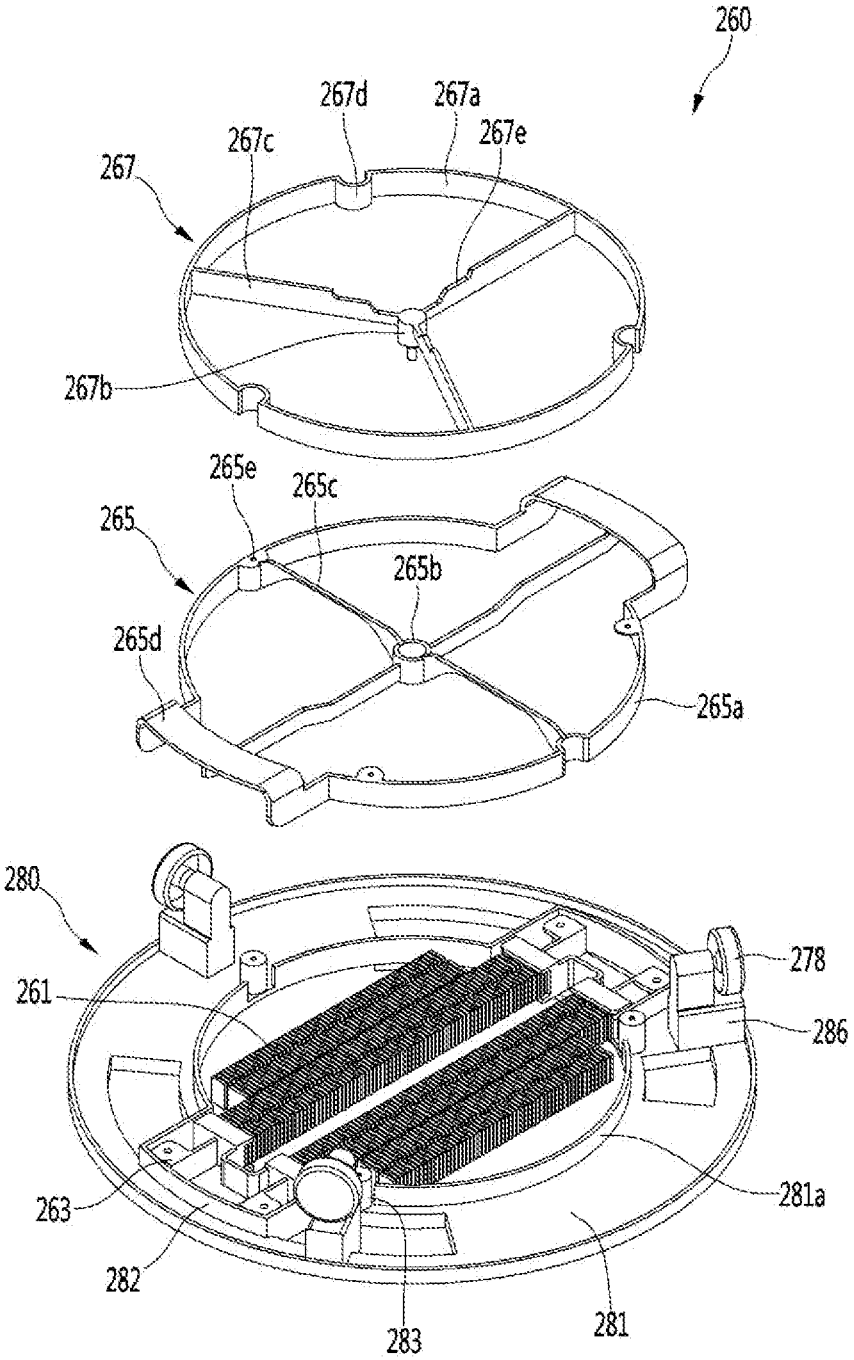
FIG. 22 is an exploded perspective view illustrating a configuration of the heater assembly according to the first embodiment of the present invention.
Figure 23:
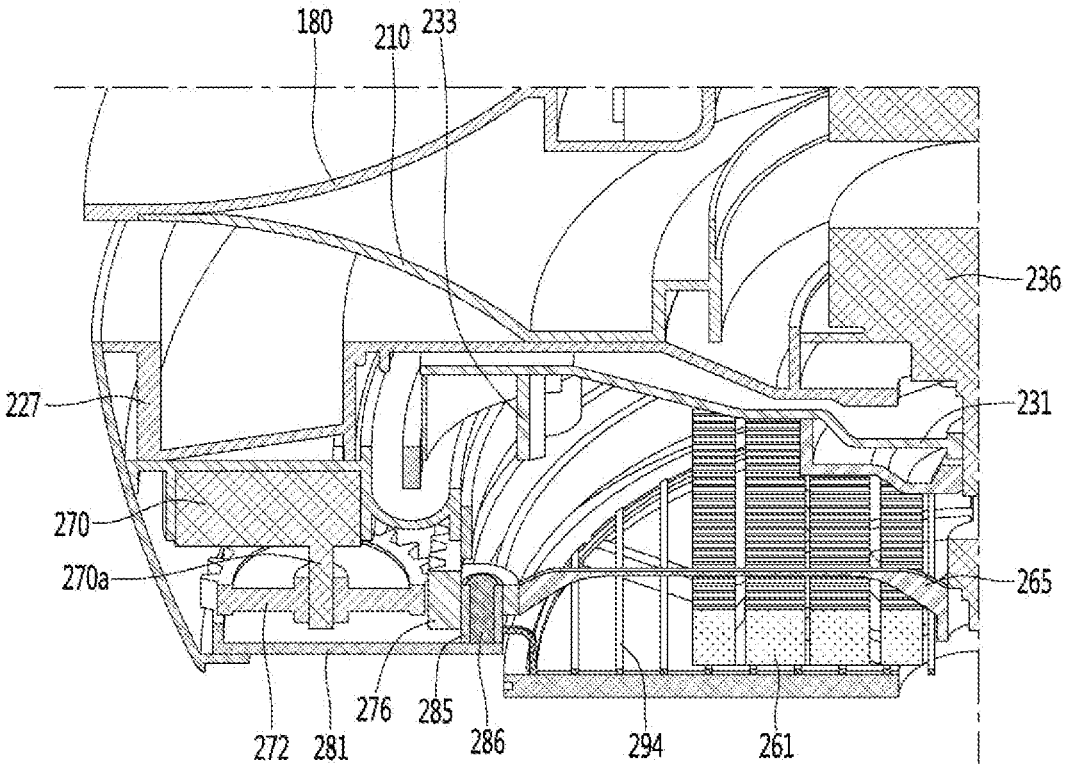
FIG. 23 is a cross-sectional view illustrating a configuration of the rotary motor and a power transmission device according to the first embodiment of the present invention.
Figure 24:
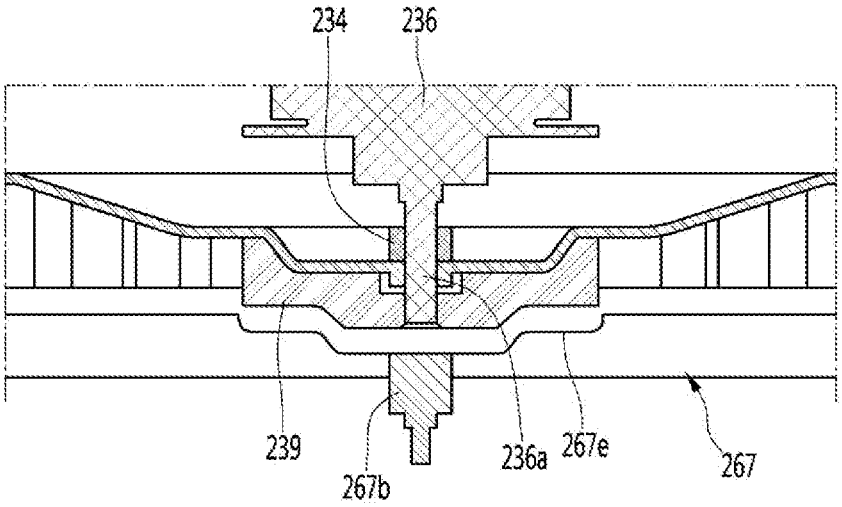
FIG. 24 is a cross-sectional view illustrating a configuration of a lower fan and a second support according to the first embodiment of the present invention.

FIG. 21 is a perspective view of a configuration of the heater assembly according to the embodiment of the present invention, FIG. 22 is an exploded perspective view illustrating a configuration of the heater assembly according to the embodiment of the present invention, FIG. 23 is a cross-sectional view illustrating a configuration of the rotary motor and the power transmission device according to the embodiment of the present invention, and FIG. 24 is a cross-sectional view illustrating a configuration of the lower fan and the second support according to the embodiment of the present invention.

[Lower Orifice Body]

Referring to FIGS. 21 to 23, the heater assembly 260 according to an embodiment of the present invention may be mounted on the lower orifice 280. The lower orifice 280 includes a lower orifice body 281 having an opened central portion 281*a*. The opened central portion 281*a* may provide an air passage through which the air suctioned through the second suction part 23 is transferred to the opened central portion 241*a* of the upper orifice 240. The lower orifice body 281 may have an approximately annular shape by the opened central portion 281*a*.

[Rack Coupling Part]

The lower orifice 280 further includes a rack coupling part 285 coupled to the rack gear 276. The rack coupling part 285 may protrude upward from a top surface of the lower orifice body 281 and have an insertion groove into which a rack coupling member 286 is inserted. The rack coupling member 286 may pass through the rack gear 276 and be coupled to the rack coupling part 285.

[Bracket Support]

The heater assembly 260 include a heater 261 and a heater bracket 263 supporting both sides of the heater 261. The heater 261 may be inserted into the opened central portion 281*a*.

The lower orifice body 281 further includes a bracket support 282 on which the heater bracket 263 is mounted. The bracket support 282 may be provided on each of both sides of the lower orifice body 281. The heater bracket 263 may be coupled to the bracket support 282 by a predetermined coupling member.

[Roller Support]

A roller support 280 supporting the roller 278 is provided on the lower orifice body 281. While the upper orifice 240 rotates, the roller 278 may contact the upper orifice 240 to perform a rolling operation.

[First Support Coupling Part]

The lower orifice body 281 includes a second support coupling part 283 coupled to the second support 265. The first support coupling part 283 may be provided on an edge-side of the central portion 241*a*. The first support 265 includes a first coupling part 265*e* coupled to the first support coupling part 283. A predetermined coupling member may be coupled to the first coupling part 265*e* through the first support coupling part 283.

[First Support]

The first support 265 is disposed above the lower orifice 280. Also, the first support 265 may be placed on the heater assembly 260. The first support 265 may be made of a metal material, for example, an aluminum material.

The first support 265 supports a rotating component of the lower module 200. Also, the first support 265 together with the second support 267 may protect the components disposed on the lower module 200 so that the components do not directly contact the heater assembly 260. That is, the first and second supports 265 and 267 guide the lower fan 230 and the lower fan housing 220 to be spaced apart from the heater assembly 260.

The first support 265 includes a first support body 265*a* having an approximately ring shape and a first support frame 265*c* extending from one point to the other point of an inner circumferential surface of the first support body 265*a*. The first support frame 265*c* is provided in plurality, and the plurality of first support frames 265*c* may be disposed to cross each other.

A support central portion 265*b* is provided at a portion at which the plurality of first support frames 265*c* cross each other. A rotation central portion 267*b* of the second support 267 may be inserted into the support central portion 265*b*. Also, the bearing 275 may be provided on the support central portion 265*b*. In summary, the bearing 275 may be provided outside of the rotation central portion 267*b* to guide the rotation central portion 267*b* so that the rotation central portion 267*b* easily rotates within the support central portion 265*b*.

[Second Support]

The lower orifice 280, the heater assembly 260, and the first support 265 are fixed components. The second support 267 and components provided above the second support, i.e., the lower fan 230, the lower fan housing 220, and the upper orifice 240 may rotate (revolved).

The second support 267 includes a second support body 267*a* having an approximately ring shape and a second support frame 267*c* extending from one point of an inner circumferential surface of the second support body 267*a* to the central portion of the second support body 267*a*. The second support frame 267*c* is provided in plurality, and the plurality of second support frames 267*c* may meet each other at a central portion of the second support body 267*a*.

A rotation central portion 267*b* providing a rotational center of the second support 267 is provided at a center of the second support body 267*a*. The rotation central portion 267*b* provides a rotation central axis of the second support 267. Also, the rotation central portion 267*b* may protrude downward from the central portion of the second support body 267*a* and be rotatably inserted into the central portion 265*b* of the first support 265.

[Arrangement Structure of the Second Support and Locking Part]

A stepped part 267*e* that is recessed downward is disposed on a top surface of each of the plurality of second support frames 267*c*. The stepped part 267*e* has a shape corresponding to a stepped shape of the locking part 239. The stepped part 267*e* may be disposed below the locking part 239.

In detail, referring to FIG. 24, the lower motor 236 is disposed above the lower fan 230 according to an embodiment of the present invention, and the lower motor shaft 236*a* extends downward from the bottom surface of the lower motor 236 and is coupled to the lower fan 230. The shaft coupling part 234 through which the lower motor shaft 236*a* passes is provided on the lower fan 230. The shaft coupling part 234 may protrude upward from the hub 231*a* of the lower fan 230.

The lower motor shaft 236*a* passes through the shaft coupling part 234 to protrude to a lower side of the lower fan 230 and is coupled to the locking part 239. A bottom surface of the locking part 239 may have a protruding or stepped shape corresponding to that of the hub 231*a* of the lower fan 230.

A stepped part 267*e* of the second support 267 may be disposed below the locking part 239. Thus, interference between the locking part 239 and the second support 267 may be prevented. Also, the bottom surface of the locking part 239 and the stepped part 267*e* of the second support 267 may be spaced a set distance S1 from each other. Due to this configuration, even though vibration occurs while the lower fan 230 is driven, the interference between the lower fan 230 or the locking part 239 and the second support 267 may be prevented.

[Coupling Structure of Upper Air Guide and Lower Air Guide]

Figure 25:
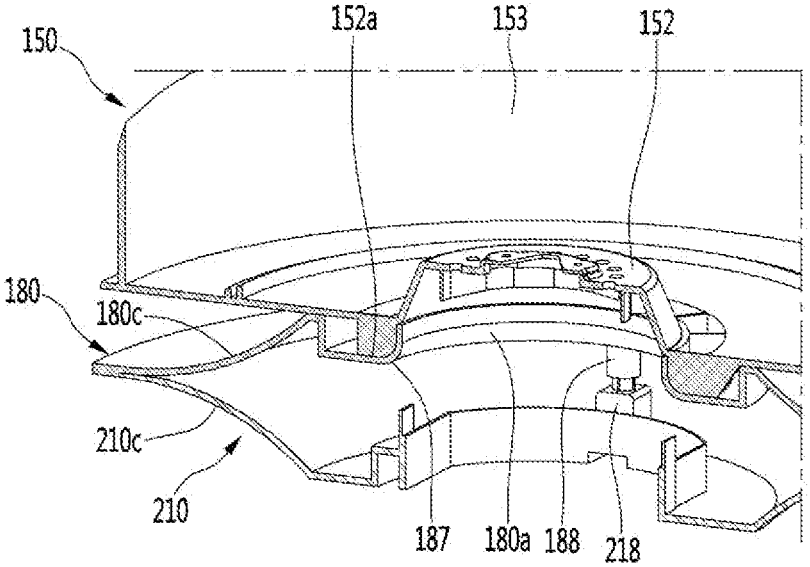
FIG. 25 is a cross-sectional view illustrating a configuration of an air guide device and the upper fan housing according to the first embodiment of the present invention.
Figure 26:
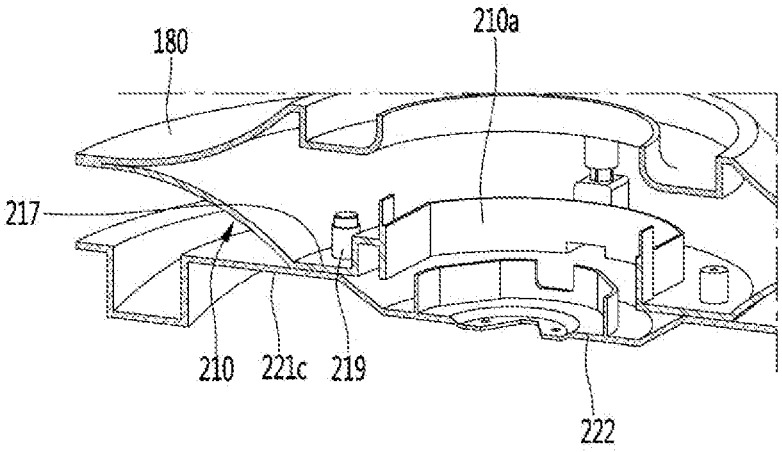
FIG. 26 is a view illustrating a configuration of the air guide device and the lower fan housing according to the first embodiment of the present invention.

FIG. 25 is a cross-sectional view illustrating a configuration of the air guide device and the upper fan housing according to the embodiment of the present invention, and FIG. 26 is a view illustrating a configuration of the air guide device and the lower fan housing according to the embodiment of the present invention.

Referring to FIGS. 25 and 26, the air guide devices 180 and 210 according to an embodiment of the present invention may be coupled to each other. In detail, a first guide coupling part 188 is provided on the upper air guide 180, and a second guide coupling part 218 is provided on the lower air guide 210. The first guide coupling part 188 may be aligned above the second guide coupling part 218 and coupled by a predetermined coupling member. For example, the coupling member may be coupled to the second guide coupling part 218 through the first guide coupling part 188.

[Upper Fan Housing Support Structure of Upper Air Guide]

A first recess part 187 that is recessed downward is provided in the central portion 180*a* of the upper air guide 180. The guide support part 152*a* of the upper fan housing 150 may be inserted into the first recess part 187. The guide support part 152*a* is provided on the edge-side of the hub facing part 152 of the upper fan housing 150 and has a shape that is recessed downward. Due to the configuration of the first recess part 187 and the guide support part 152*a*, the upper fan housing 150 may be stably supported on the upper air guide 180. Also, as described above, the first guide coupling part 151*b* of the upper fan housing 150 may be coupled to the first housing coupling part 183 of the upper air guide 180.

[Lower Fan Housing Support Structure of Lower Air Guide]

A housing support 217 supported by the guide seating part 221*c* of the lower fan housing 220 is provided on a central portion 210*a* of the lower air guide 210. The guide extension part 210*c* may extend from the housing support 217 in the outer radial direction. Due to the configuration of the housing support 217 and the guide seating part 221*c*, the lower air guide 210 may be stably supported on the lower fan housing 220.

The lower air guide 210 includes a second housing coupling part 217*a* coupled to the second guide coupling part 221*d* of the lower fan housing 220. A predetermined coupling member may pass through the second guide coupling part 221*d* and be coupled to the second housing coupling part 217*a*.

[Base]

Figure 27:
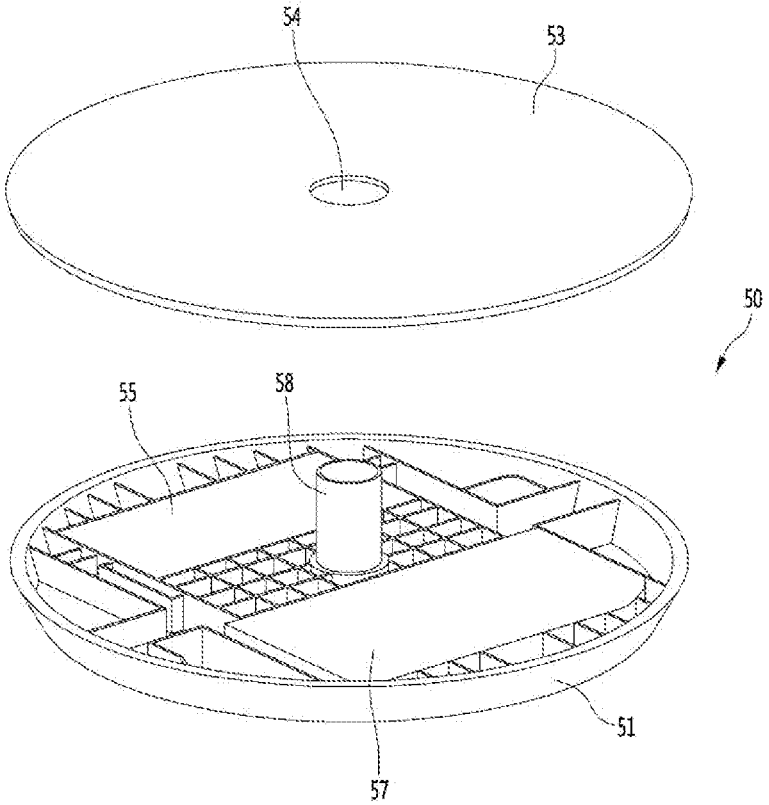
FIG. 27 is an exploded perspective view illustrating a configuration of a base according to the first embodiment of the present invention.

FIG. 27 is an exploded perspective view illustrating a configuration of a base according to the first embodiment of the present invention.

Referring to FIG. 27, the base 50 according to the embodiment of the present invention includes a base body 51 placed on the ground and a base cover 53 coupled to the upper side of the base body 51.

The base cover 53 includes a through-hole 54. The through-hole 54 may be formed at a central portion of the base cover 53. The base 50 may further include a base support 58 extending upward from the base body 51 and passing through the through-hole 54. A leg body 31 may be coupled to the base support 58.

The base body 51 may include a base cover coupling part coupled to the base cover 53. For example, the base cover coupling part may be provided in plurality along the inner circumference of the base body 51.

A power PCB 57 may be installed on the base body 51. The battery 55 and the power PCB 57 may be disposed on both sides of the base support 58. For example, the battery 55 and the power PCB 57 may be installed at symmetrical positions with respect to the base support 58.

The battery 55 installed in the base body 51 has a relatively heavy weight, so that the center of gravity of the flow generating device 10 may be lowered downward. In detail, the upper module 100 and the lower module 200, which include a relatively heavy component, are disposed on the upper portion of the flow generating device 10.

Therefore, since the center of gravity of the flow generating device 10 is formed on the upper portion of the flow generating device 10 but the battery 55 is disposed in the base 50, the effect that the entire center of gravity of the flow generating device 10 is lowered appears. As a result, the risk of collapse of the flow generating device 10 may be reduced, and safety accidents may be prevented.

On the other hand, the base body 51 may further include an insertion hole into which a power cable for supplying external power is inserted. The power cable inserted through the insertion hole may be connected to the battery 55 or the power PCB 57.

The power supplied from the outside or the power stored in the battery 55 may be supplied to the electric component through the power PCB 57. The electrical component may include the upper motor 170, the lower motor 236, the main PCB 215, or the rotary motor 270.

The power PCB 57 may be connected to an electric wire (see reference numeral 60 of FIG. 2). The electric wire 60 extends upward from the base 50 and may be disposed within the legs 30.

In detail, the electric wire 60 may extend from the power PCB 57 to the inside of the leg body 31 and may extend to the main body 20 via the inside of the leg extension parts 33 and 35. That is, the leg 30 may provide a space for installing the electric wire 60 in addition to the function of supporting the main body 20.

[Air Flow in Upper Module]

Figure 28:
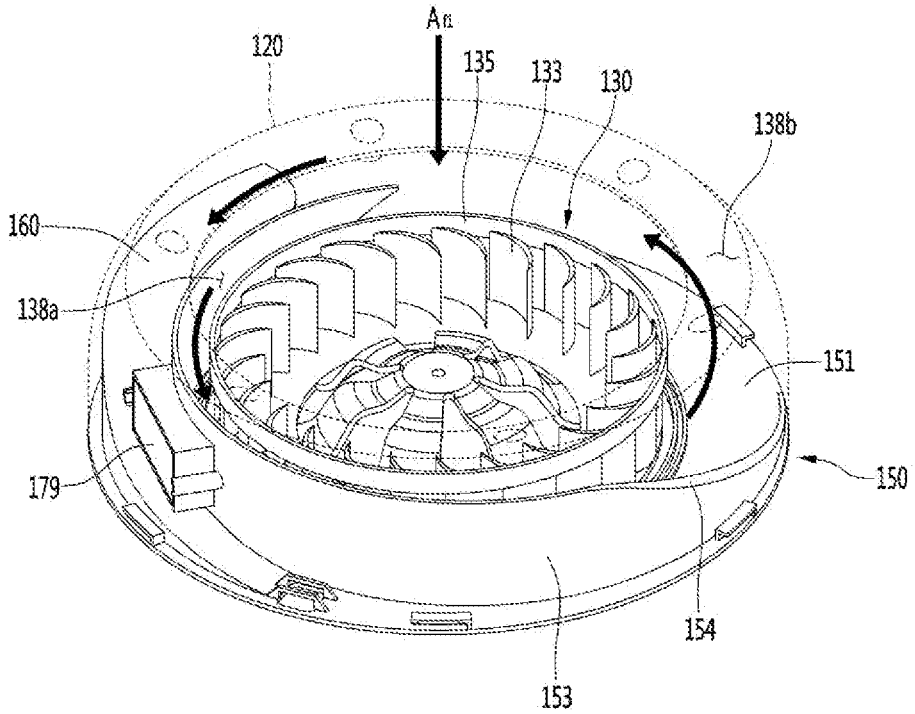
FIGS. 28 and 29 are views illustrating a state in which air passing through a fan is discharged from the upper module according to the first embodiment of the present invention.
Figure 29:
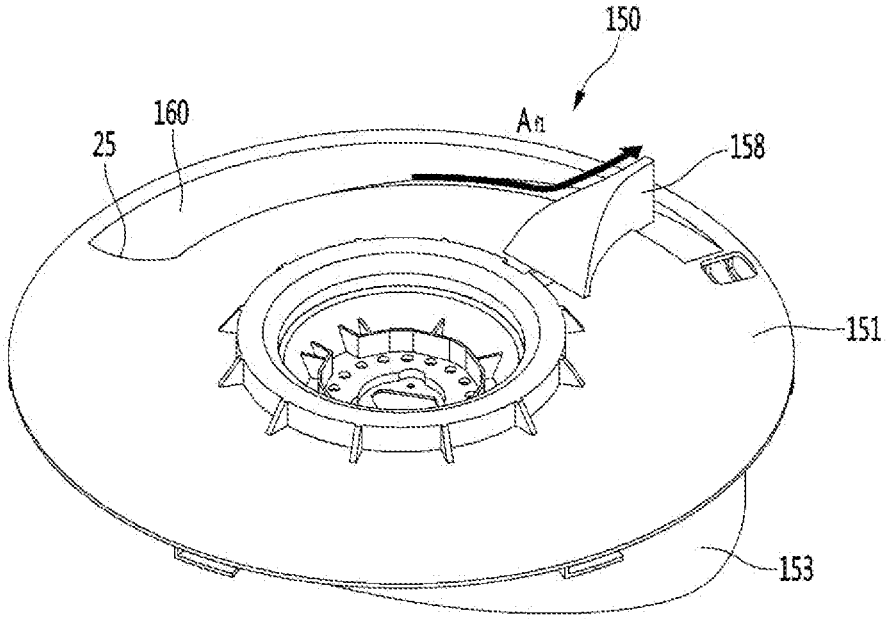

FIGS. 28 and 29 are views illustrating a state in which air passing through a fan is discharged from the upper module according to the first embodiment of the present invention.

Referring to FIGS. 2, 28, and 29, when the upper fan 130 according to the first embodiment of the present invention is driven, air may be suctioned through the first suction part 21 of the upper module 100 to pass through the upper fan 130 to generate a flow of air discharged from the first inner discharge part 25, i.e., a first air flow Af1.

In detail, as the upper fan 130 rotates, the air is suctioned through the first suction part 21 provided in the upper portion of the upper module 100. The air suctioned through the first suction part 21 is suctioned in the axial direction of the upper fan 130 via the first pre-filter 105.

The air introduced in the axial direction of the upper fan 130 may be discharged in the radial direction of the upper fan 130 and guided by the guide wall 153 of the upper fan housing 150 to flow while rotating in the circumferential direction along the first fan passage 138*a*. Also, the air passing through the first fan passage 138*a* may flow in the circumferential direction through the second fan passage 138*b* disposed in a downstream side of the first fan passage 138*a*.

The second fan passage 138*b* may have a flow cross-sectional area greater than that of the first fan passage 138*a* to reduce flow resistance of the air passing through the upper fan 130, thereby reducing noise generated from the upper fan 130.

The air passing through the second fan passage 138*b* may flow to the lower side of the housing plate 151 through the first inner discharge part 25. At this time, the flow direction of the air discharged through the first inner discharge part 25 may be the direction toward the second inner discharge part 27. The air discharged from the first inner discharge part 25 may be guided by the flow guide part 160 and may easily flow in the circumferential direction.

The air flowing along the flow guide part 160 may be changed in flow direction by the first discharge guide part 158 provided below the housing plate 151. In detail, the air flowing in the circumferential direction may meet the first discharge guide part 158 to flow in the outer radial direction. Here, the upper air guide 180 together with the first discharge guide part 158 may guide the air flow in the radial direction.

Due to this configuration, the air passing through the upper fan 130 is guided in the circumferential direction by the upper fan housing 150 and the upper cover 120 and then is discharged through the first inner discharge part 25 at rotation force. Also, the discharged air may be guided by the first discharge guide part 158 and the upper air guide 180 and thus be easily discharged in the radial direction.

The ionizer mounting part 168 in which an ionizer 179 for sterilizing microorganisms contained in the air is installed is provided outside the guide wall 153. The ionizer 179 may emit anions to the first fan passage 138*a* or the second fan passage 138*b*. Thus, the air passing through the upper module 100 may be sterilized through the ionizer 179, and thus, clean air may be supplied to the user.

[Air Flow in Lower Module]

Figure 30:
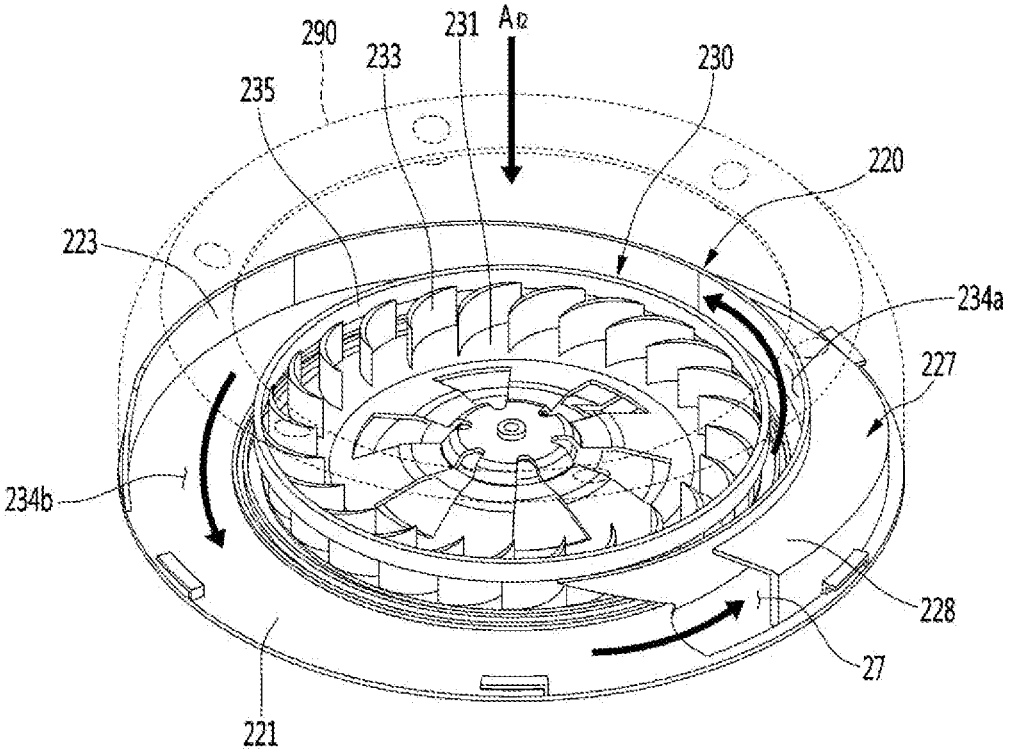
FIGS. 30 and 31 are views illustrating a state in which the air passing through the fan is discharged from the lower module according to the first embodiment of the present invention.
Figure 31:
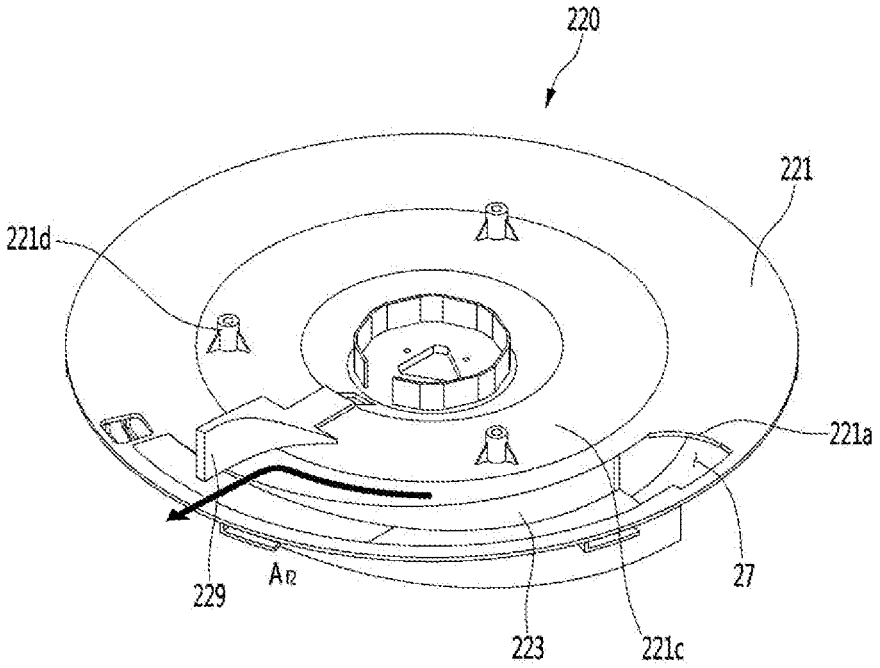
Figure 32:
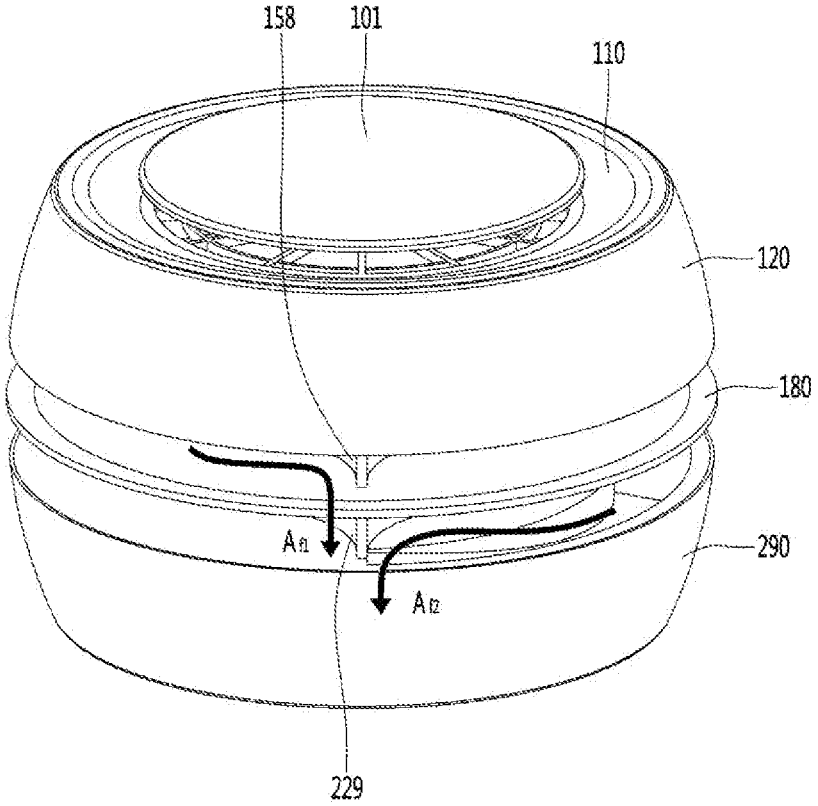
FIG. 32 is a view illustrating a flow of air discharged from the upper module and the lower module according to the first embodiment of the present invention.

FIGS. 30 and 31 are views illustrating a state in which the air passing through the fan is discharged from the lower module according to the first embodiment of the present invention, and FIG. 32 is a view illustrating a flow of air discharged from the upper module and the lower module according to the first embodiment of the present invention.

Referring to FIGS. 2, 30, and 31, when the lower fan 230 according to the first embodiment of the present invention is driven, air may be suctioned through the second suction part 23 of the upper module 200 to pass through the lower fan 230 to generate a flow of air discharged from the second inner discharge part 27, i.e., a second air flow Af2.

In detail, as the lower fan 230 rotates, the air is suctioned through the second suction part 23 provided in the lower portion of the lower module 200. The air suctioned through the second suction part 23 is suctioned in the axial direction of the lower fan 230 via the second pre-filter 295.

The air introduced in the axial direction of the lower fan 230 may be discharged in the radial direction of the lower fan 230 and guided by the guide wall 223 of the upper fan housing 220 to flow while rotating in the circumferential direction along the first fan passage 234*a*. Also, the air passing through the first fan passage 234*a* may flow in the circumferential direction through the second fan passage 234*b* disposed in a downstream side of the first fan passage 234*a*.

The second fan passage 234*b* may have a flow cross-sectional area greater than that of the first fan passage 234*a* to reduce flow resistance of the air passing through the lower fan 230, thereby reducing noise generated from the lower fan 230.

The air flowing through the second fan passage 234*b* may be discharged to the second inner discharge part 27 to flow to the upper side of the housing plate 221. Here, the air discharged through the second inner discharge part 27 may flow in a direction of the first inner discharge part 25. Also, the air discharged from the second inner discharge part 27 may be guided by the flow guide part 227 to easily flow in the circumferential direction.

The air flowing along the flow guide part 227 may be changed in flow direction by the second discharge guide part 229 provided above the housing plate 221. In detail, the air flowing in the circumferential direction may meet the second discharge guide part 229 to flow in the outer radial direction. Here, the lower air guide 210 together with the second discharge guide part 229 may guide the air flow in the radial direction.

Due to this configuration, the air passing through the lower fan 230 is guided in the circumferential direction by the lower fan housing 220 and the lower cover 290 and then is discharged through the second inner discharge part 27 at rotation force. Also, the discharged air may be guided by the second discharge guide part 229 and the upper air guide 210 and thus be easily discharged in the radial direction.

[Intensive Discharge of Air Passing through First and Second Inner Discharge Parts]

Referring to FIG. 32, the second inner discharge part 27 may be disposed to face the first inner discharge part 25 with respect to the air guide devices 180 and 210. Also, the air flowing to the second inner discharge part 27 may be discharged in the direction of the first inner discharge part 25. In other words, first air discharged from the first inner discharge part 25 and second air discharged from the second inner discharge part 27 may flow to be close to each other.

Also, the air discharged from the first inner discharge part 25 may be guided by the first discharge guide part 158 and the upper air guide 180 and then disposed to the first discharge passage 26, and the air discharged from the second inner discharge part 27 may be guided by the second discharge guide part 229 and the lower air guide 229 and then disposed to the second discharge passage 28.

Here, the first discharge guide part 229 may be disposed directly below the first discharge guide part 158 to concentrate the air flowing through the first and second discharge passages 26 and 28, thereby discharging the air to the outside. Due to this configuration, a flow pressure acting on the flow generating device 10 may be uniform to reduce the vibration or noise of the flow generator 10.

The air discharged through the second inner discharge part 27 may be easily discharged to the second discharge passage 28 in the radial direction by the second flow guide part 227 and the second discharge guide part 229.

The lower module 200 further include the heater assembly 260 for heating the air passing through the lower module 200. The heater assembly 260 is disposed at a suction-side of the second blower fan 230, and the air heated by the heater assembly 260 passes through the second blower fan 230. Due to the heater assembly 260, warm air may be supplied to the user. Also, since the heater assembly 260 is provided in the lower module 200, the heat generated from the heater assembly 260 may easily act on the air flowing upward.

[Flow Direction of Air Passing through First and Second Inner Discharge Parts]

The rotation direction of the upper fan 130 and the rotation direction of the lower fan 230 may be opposite to each other.

For example, when the flow generating device 10 is viewed form an upper side, the air discharged from the first inner discharge part 25 rotates in one direction of a clockwise direction and a counterclockwise direction. On the other hand, the air discharged from the second inner discharge part 27 rotates in the other direction of the clockwise direction and the counterclockwise direction.

Thus, the air discharged to the lower side of the upper fan housing 150 by passing through the upper fan 130 may be guided by one side surface of the first discharge guide part 158 and discharged in the radial direction. On the other hand, the air discharged to the upper side of the lower fan housing 220 by passing through the lower fan 230 may be guided by one side surface of the second discharge guide part 229 and discharged in the radial direction.

For example, when the air passing through the upper fan 130 moves to the first discharge guide part 158 while rotating in the clockwise direction, the air is guided by a right surface of the first discharge guide part 158 and discharged in the radial direction. Also, when the air passing through the lower fan 230 moves to the second discharge guide part 229 while rotating in the counterclockwise direction, the air is guided by a left surface of the second discharge guide part 229 and discharged in the radial direction.

On the other hand, when the air passing through the upper fan 130 moves to the first discharge guide part 158 while rotating in the counterclockwise direction, the air is guided by the left surface of the first discharge guide part 158 and discharged in the radial direction. Also, when the air passing through the lower fan 230 moves to the second discharge guide part 229 while rotating in the clockwise direction, the air is guided by a right surface of the second discharge guide part 229 and discharged in the radial direction.

Due to this configuration, the air flow direction generated in the upper module 100 and the air flow direction generated in the lower module 200 may be opposite to each other. Thus, the vibration occurring in the flow generator 10 due to the air flow may be offset. As a result, the vibration and noise of the flow generating device 10 may be reduced.

[Definition of Terms]

The upper module 100 and the lower module 200 may be called a "first module" and a "second module", respectively. The upper fan 130, the upper fan housing 150, the upper air guide 180, and the upper cover 120, which are provided in the upper module 100, may be called a "first fan", a "first fan housing", a "first air guide", and a "first cover", respectively. Also, the lower fan 230, the lower fan housing 220, the lower air guide 210, and the lower cover 290, which are provided in the lower module 200, may be called a "second fan", a "second fan housing", a "second air guide", and a "second cover", respectively.

[Rotation Effect of Flow Generating Device]

Figure 33:
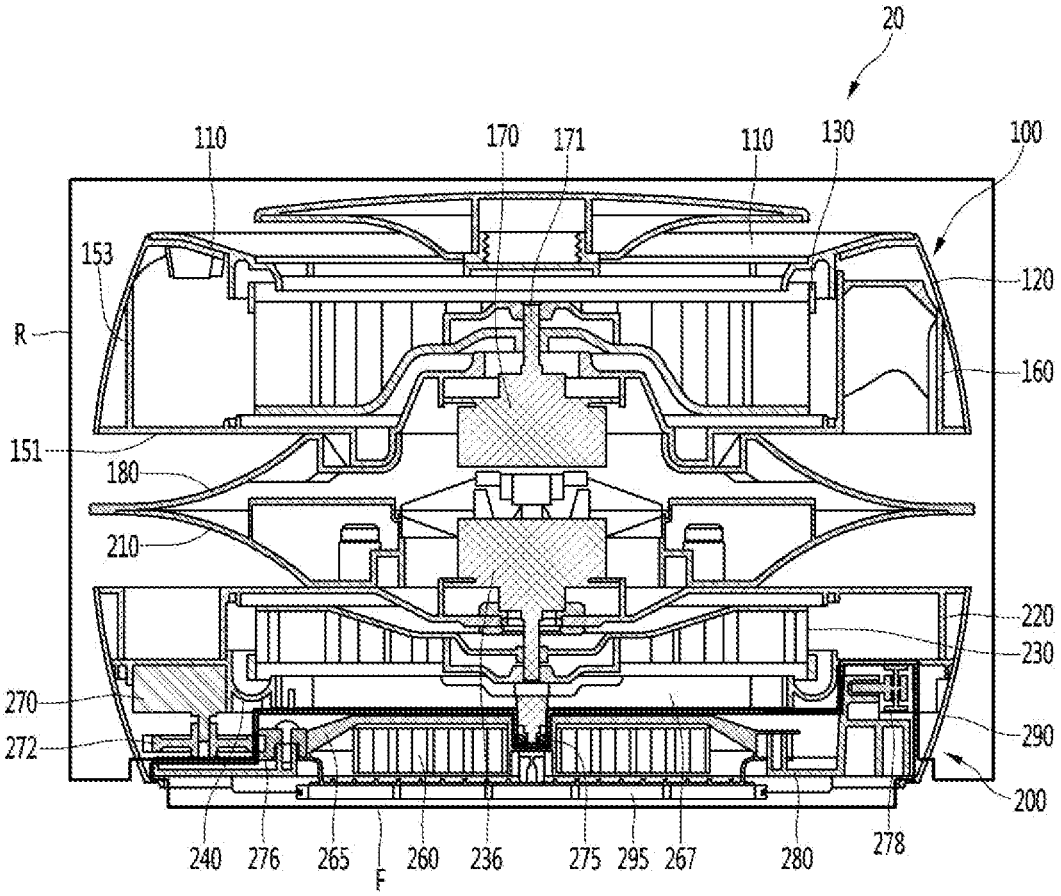
FIG. 33 is a cross-sectional view illustrating a portion F to which a flow generating device is fixed and a rotatable portion R according to the first embodiment of the present invention.
Figure 34:
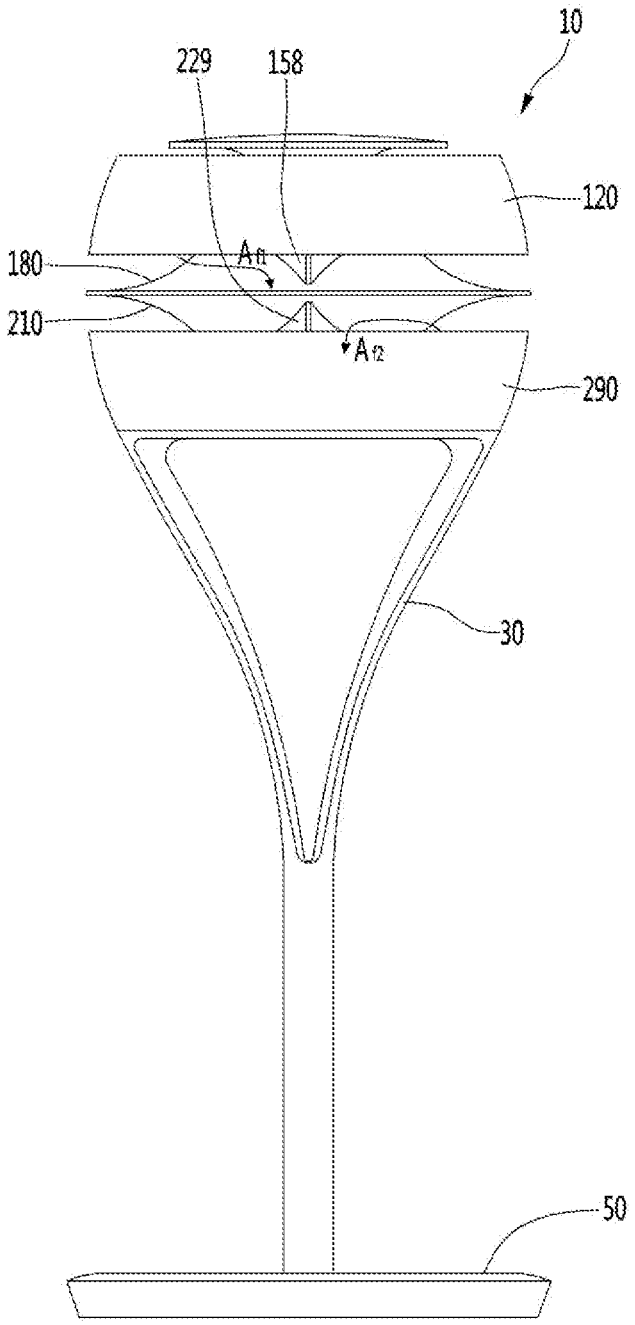
FIG. 34 is a view illustrating a state in which the flow generating device discharges air toward a front side according to the first embodiment of the present invention.
Figure 35:
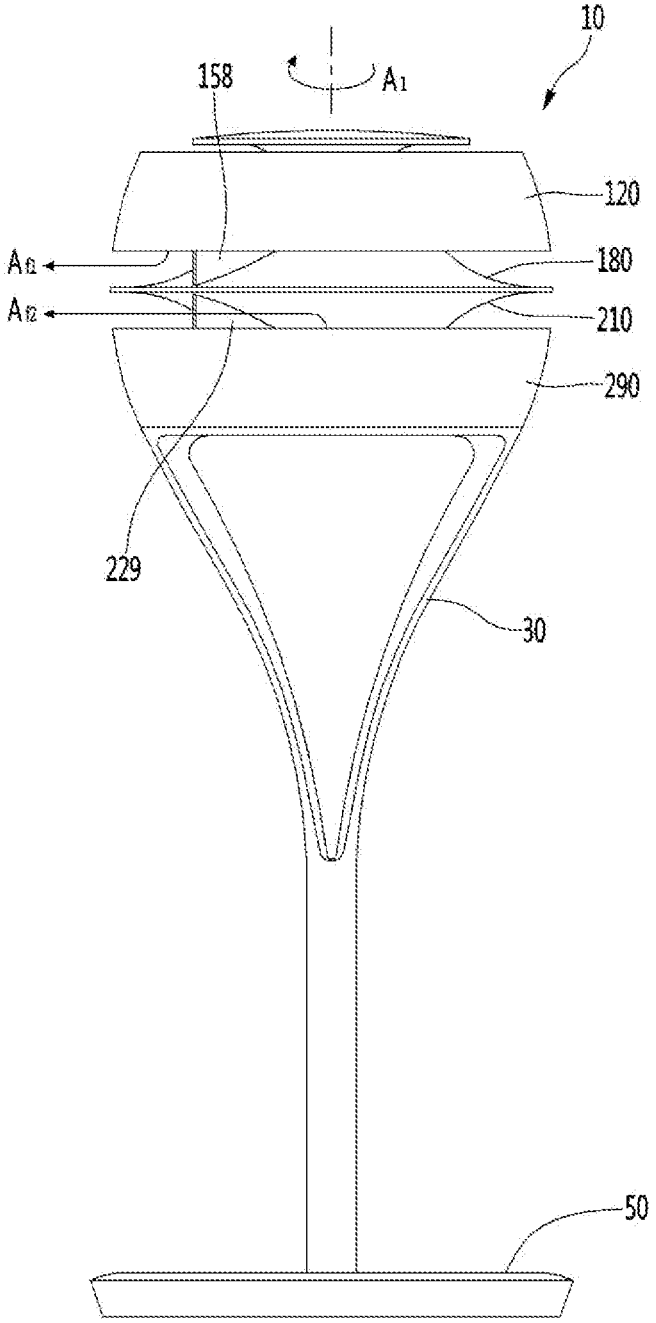
FIG. 35 is a view illustrating a state in which the flow generating device rotates in a left direction to discharge air toward a left side according to the first embodiment of the present invention.
Figure 36:
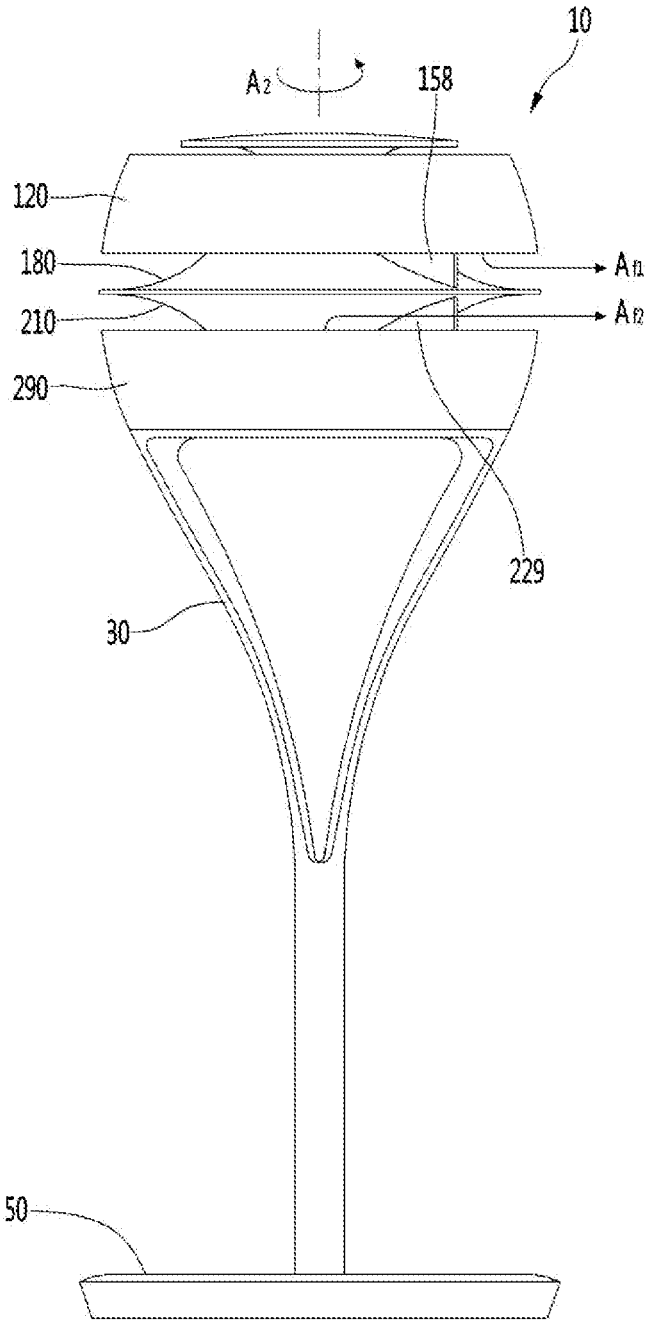
FIG. 36 is a view illustrating a state in which the flow generating device rotates in a right direction to discharge air toward a right side according to the first embodiment of the present invention.

FIG. 33 is a cross-sectional view illustrating a portion F to which the flow generator is fixed and a rotatable portion R according to the first embodiment of the present invention, FIG. 34 is a view illustrating a state in which the flow generator discharges air toward a front side according to the first embodiment of the present invention, FIG. 35 is a view illustrating a state in which the flow generator rotates in a left direction to discharge air toward a left side according to the first embodiment of the present invention, and FIG. 36 is a view illustrating a state in which the flow generator rotates in a right direction to discharge air toward a right side according to the first embodiment of the present invention.

Referring to FIG. 33, the flow generating device 10 according to the first embodiment of the present invention may include a device fixed part F fixed to one position and a device rotatable part R moving while rotating. The device rotatable part R may rotate a clockwise direction or a counterclockwise direction with respect to the axial direction.

The device fixed part F includes the lower orifice 280, the rack gear 276, and the heater assembly 260 of the lower module 100. Also, the device rotatable part R may be understood as the upper module 100 and the remaining components except for the fixed portion R of the lower module 100.

[First Position of Upper Module and Lower Module]

FIG. 34 illustrates the first air flow Af1 discharged from the upper module 100 and the second air flow Af2 discharged from the lower module 200 when the upper module 100 and the lower module 200 are disposed at the first position. For example, the "first position" may be understood as a front discharge position at which the air is intensively discharged forward. Here, the first discharge guide part 158 and the second discharge guide part 229 may be disposed to face the front side.

FIG. 35 illustrates the first air flow Aft discharged from the upper module 100 and the second air flow Af2 discharged from the lower module 200 when the upper module 100 and the lower module 200 are disposed at the second position. For example, the "second position" may be understood as a left discharge position at which the air is intensively discharged to the left side. Here, the first discharge guide part 158 and the second discharge guide part 229 may be disposed to face the left side.

[Second Position of Upper Module and Lower Module]

In detail, in the position of FIG. 34, when the rotary motor 270 provided in the lower module 200 is driven in one direction, the pinion gear 272 and the rack gear 276, which are coupled to the rotary motor 270, are interlocked with each other. Since the rack gear 276 is fixed to the lower orifice 280, the pinion gear 272 rotates along the rack gear 276. In this process, the rotary motor 270 and the pinion gear 272 rotate in the clockwise direction A1 with respect to the center of the axial direction of the lower module 200.

The rotary motor 270 is supported by the upper orifice 240, and the upper orifice 240 and the second support 267 are coupled to each other. Thus, the upper orifice 240 and the second support 267 rotate (revolve). Here, the rotation central portion 267*b* of the second support 267 provides a rotational center of the upper orifice 240 and the second support 267.

In summary, the rotary motor 270 and the pinion gear 272 may revolve with respect to the rotation central portion 267*b* of the second support 267, and the upper orifice 240 and the second support 267 may rotate with respect to the rotation central portion 267*b*. Here, the bearing 275 coupled to the lower orifice 280 may come into roll contact with the bottom surface of the upper orifice 240.

Also, the upper orifice 240 is coupled to the lower cover 290, and the lower cover 290 and the lower fan housing 220 are coupled to each other by the hook structure. Thus, the lower cover 290 and the lower fan housing 220 may also rotate. Also, the lower fan 230 supported by the lower fan housing 220 and the lower air guide 210 coupled to the lower fan housing 220 may also rotate.

As a result, when the rotary motor 270 is driven, the remaining components except for the rack gear 276 and the heater assembly 260, which are coupled to the fixed lower orifice 280, of the lower module 200 may integrally rotate with respect to the rotation central portion 267*b* of the second support 267.

Since the lower air guide 210 and the upper air guide 180 are coupled to each other, the rotation force of the lower module 200 may be transmitted to the upper module 100 through the air guides 180 and 210.

Since the upper fan housing 150 and the upper air guide 180 are coupled to each other, and the upper cover 120 and the upper fan 130 are coupled to the upper fan housing 150, the upper air guide 180, the upper fan housing 150, the upper fan 130, and the upper cover 120 integrally rotate. Also, the inlet cover 110, the top cover support 103, and the top cover 101, which are supported by the upper portion of the upper cover 120 may also rotate together.

When the upper fan 130 and the lower fan 230 are driven, if the rotary motor 270 is driven, the first inner discharge part 25 provided in the upper module 100 and the second inner discharge part 27 provided in the lower module 200 may also rotate. Thus, a flow direction of the discharged air may be changed.

As a result, as illustrated in FIG. 35, the first and second inner discharge parts 25 and 27 may rotate in the clockwise direction A1. When viewed from the front side, the first and second inner discharge parts 25 and 27 may rotate in the left direction.

[Third Position of Upper Module and Lower Module]

FIG. 36 illustrates the first air flow Af1 discharged from the upper module 100 and the second air flow Af2 discharged from the lower module 200 when the upper module 100 and the lower module 200 are disposed at a third position. For example, the "third position" may be understood as a right discharge position at which the air is intensively discharged to the right side. Here, the first discharge guide part 158 and the second discharge guide part 229 may be disposed to face the right side.

The third position of the upper module 100 and the lower module 200 may be realized by driving the rotary motor 270 in the other direction at the first position and interlocking the pinion gear 272 and the rack gear 276. Description with respect to a rotation principle of the device rotatable part R as the pinion gear 272 and the rack gear 276 are interlocked with each other will be derived from that with respect to the second position.

However, the rotation principle at the third position is different from that at the second position in that the rotatable portion R rotates in the counterclockwise direction A2 with respect to the axial direction to discharge the air in the right direction. As a result, as illustrated in FIG. 36, the first and second inner discharge parts 25 and 27 may rotate in the counterclockwise direction A2. When viewed from the front side, the first and second inner discharge parts 25 and 27 may rotate in the right direction.

Due to the movement of the device rotatable part R, the air discharged from the flow generating device 10 may flow in various directions to improve usage convenience.

Figure 37:
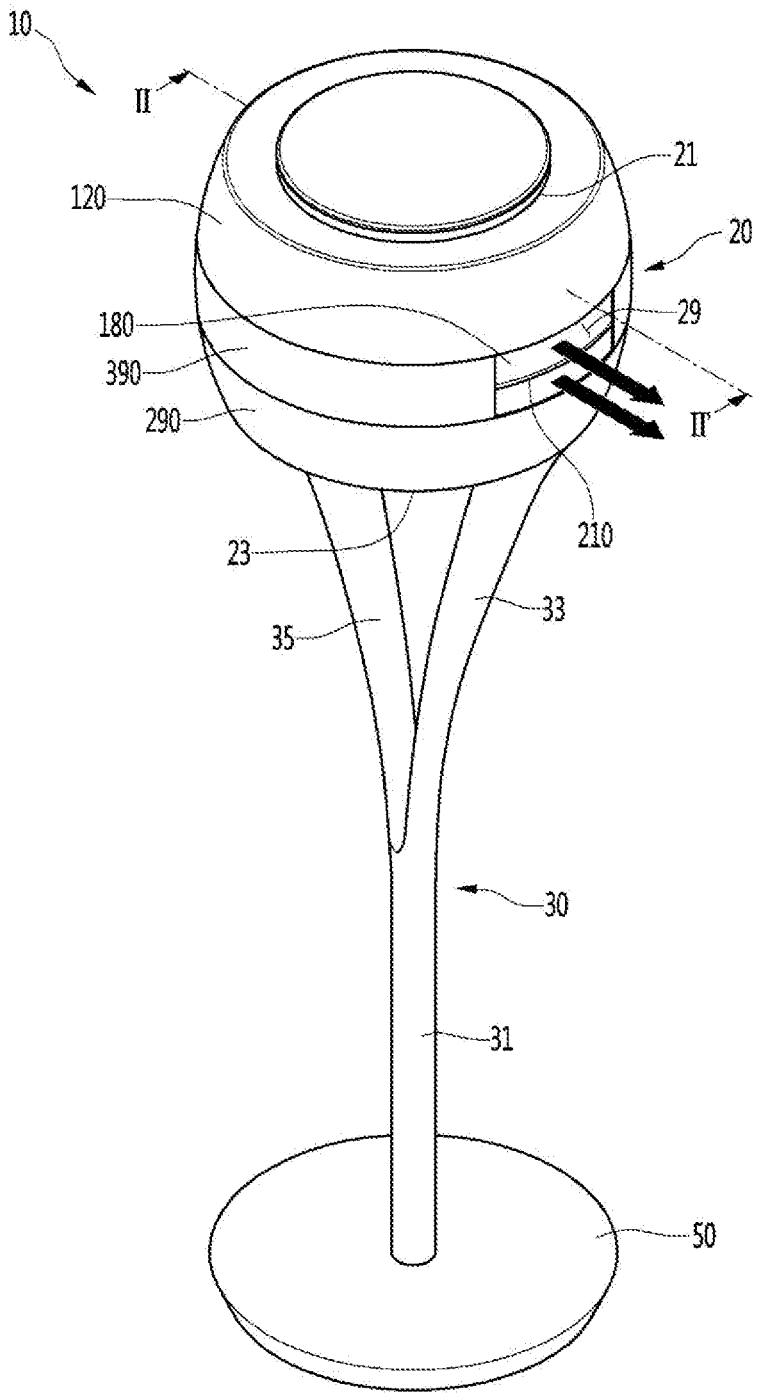
FIG. 37 is a perspective view illustrating a configuration of a flow generating device according to a first embodiment of the present invention.
Figure 38:
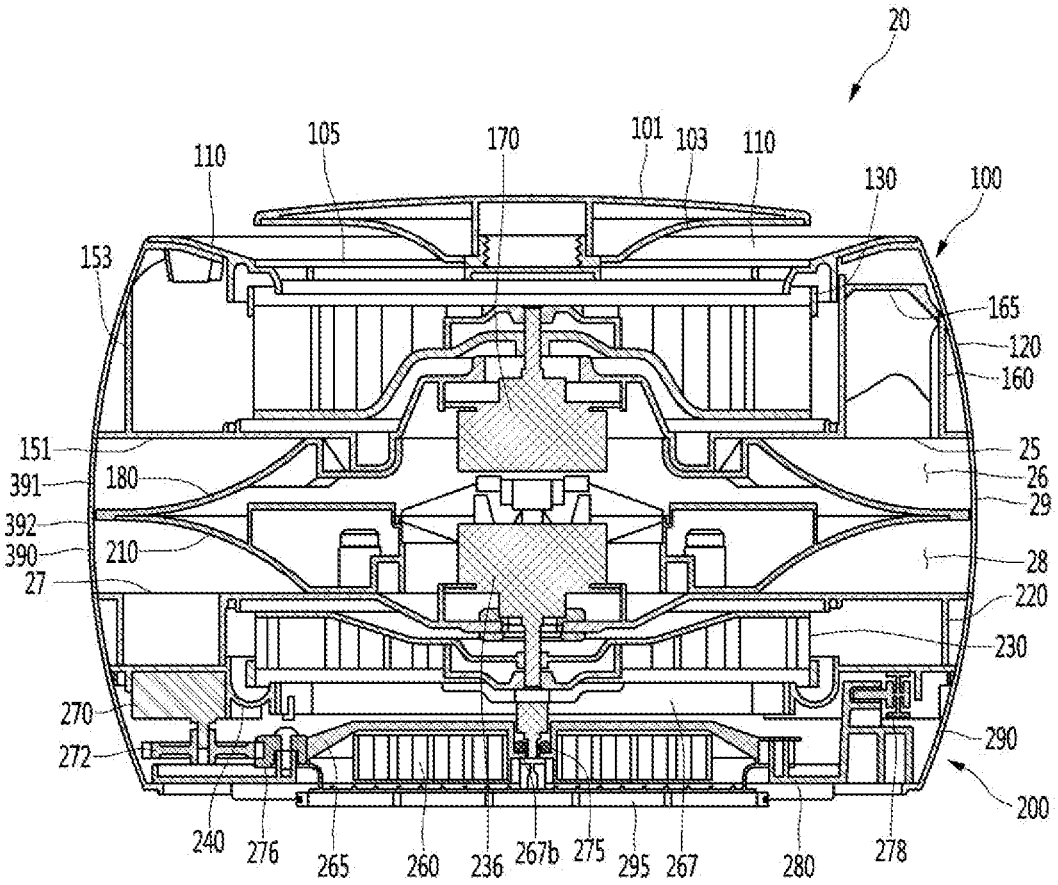
FIG. 38 is a cross-sectional view illustrating the inside of a main body illustrated in FIG. 37.

FIG. 37 is a perspective view illustrating a configuration of a flow generating device according to a first embodiment of the present invention, and FIG. 37 is a cross-sectional view illustrating the inside of a main body of FIG. 37.

[Main Body]

At least one outer discharge part 29 may be formed in the main body 20, and air passing through a first inner discharge part 25 and air passing through a second inner discharge part 27 may be discharged to the outside of the main body 20 through at least one outer discharge part 29.

[Outer Discharge Part]

An outer discharge part 29 is an opening formed in a central portion of the main body 20. The air inside the main body 20 may be discharged to the outside of the main body 20 through the outer discharge part 29.

[Opening Direction of Outer Discharge Part]

The outer discharge part 29 may be opened in the main body 20 in a radial direction. The opened direction of the outer discharge part 29 may intersect with the opened direction of the first suction part 21 and the opened direction of the second suction part 23.

When the first suction part 21 is vertically opened in an upper portion of the main body 20 and the second suction part 23 is vertically opened in a lower portion of the main body 20, the outer discharge part 29 may be opened in the main body 20 in a horizontal direction.

Here, the vertical opening of the first suction part 21 and the vertical opening of the second suction part 23 may mean that the first suction part 21 and the second suction part 23 are opened in the vertical direction to the main body 20, and that the first suction part 21 and the second suction part 23 are opened in an oblique direction between the vertical direction and the horizontal direction.

For example, the first suction part 21 may be opened obliquely at an upper portion of the main body 20 in an oblique direction between the vertical direction and the horizontal direction, and the second suction part 23 may be opened in a vertical direction at a lower portion of the main body 20. Also, the outer discharge part 29 may be opened to the main body 20 in the horizontal direction which does not coincide with the inclined direction and the vertical direction.

[Height of Outer Discharge Part]

The height of the outer discharge part 29 may be lower than the height of the first suction part 21 and higher than the height of the second suction part 23.

The air suctioned into the main body 20 through the first suction part 21 and discharged to the outer discharge part 29 may be discharged to the outside of the main body 20 at a lower height than the first suction part 21.

The air suctioned into the main body 20 through the second suction part 23 and discharged to the outer discharge part 29 may be discharged to the outside of the main body 20 at a higher height than the second suction part 23.

That is, a first stereoscopic air flow suctioned through the first suction part 21 and then discharged in the horizontal direction of the main body 20 and a second stereoscopic air flow suctioned through the second suction part 23 and then discharged in the horizontal direction of the main body 20 may be formed around the main body 20.

The first stereoscopic air flow may be an upper stereoscopic air flow that is discharged in the horizontal direction of the main body after passing through an upper portion of the main body from above the main body 20, and the second stereoscopic air flow may be a lower stereoscopic air stream which is discharged in a horizontal direction of the main body after passing through the lower portion of the main body below the main body 20.

[Size of Outer Discharge Part]

The outer discharge part 29 may have a size less than the sum of a size of the first suction part 21 and a size of the second suction part 23. When the size of the outer discharge part 29 is small, concentrated air may be discharged to the outside of the main body 20.

[Air Guide and Outer Discharge Part]

The air guides 180 and 210 may be connectors connecting the upper fan housing 150 to the lower fan housing 220. That is, the air guides 180 and 210 may connect the upper fan housing 150 to the lower fan housing 220 so that discharge passages 26 and 28 are provided between the upper fan housing 150 and the lower fan housing 220.

The air guides 180 and 210 may be respectively connected to the upper fan housing 150 and the lower fan housing 220 so that the upper fan housing 150 and the lower fan housing 220 are disposed in parallel to each other.

The air guides 180 and 210 may include a first air guide 180 providing a first discharge passage 26 through which air passing through the first inner discharge part 25 is guided and a second air guide 210 providing a second discharge passage 28 through which air passing through the second inner discharge part 27 is guided.

The outer discharge part 29 and the discharge passages 26 and 28 communicate with each other. The outer discharge part 29 may communicate with each of the first discharge passage 26 and the second discharge passage 28.

When the upper fan 130 is driven, the air may successively pass through the first suction part 21 and the first inner discharge part 25 and then be discharged to the first discharge passage 26, and the air within the first discharge passage 26 may be discharged to the outside of the main body 20 through the outer discharge part 29.

When the lower fan 230 is driven, the air may successively pass through the second suction part 23 and the second inner discharge part 27 and then be discharged to the second discharge passage 28, and the air within the second discharge passage 28 may be discharged to the outside of the main body 20 through the outer discharge part 29.

[Outer Discharge Body]

The outer discharge body 390 may constitute a portion of the outer appearance of the flow generating device, and an outer surface of the outer discharge body 390 may be exposed to the outside.

The outer discharge body 390 may be disposed to surround at least a portion of an outer circumference of each of the air guides 180 and 210. The outer discharge body 390 may be disposed between the upper cover 120 and the lower cover 290.

An outer discharge part 29 may be provided in the outer discharge body 390. The air discharged to the discharge passages 26 and 28 may be guided to the outer discharge body 390 to flow to the outer discharge part 29 and then pass through the outer discharge part 29 and be discharged to the outside of the main body 20.

The outer discharge body 390 has an arc-shaped cross-section. The outer discharge body 390 may have one end and the other end, which are spaced apart from each other in a circumferential direction. The outer discharge body 390 has a circular arc-shaped cross-section.

The outer discharge part 29 may be provided between one end of the outer discharge body 390 and the other end of the outer discharge body 390.

An inner curve 391 for guiding the air passing through the first inner discharge part 25 and the air passing through the second inner discharge part 27 to the outer discharge part 29 may be provided on the outer discharge body 390. The outer discharge body 390 may have an outer curve 392 that is an opposite to the inner curve.

[Inner Curve of Outer Discharge Body]

The inner curve 391 may contact an outer circumferential surface of each of the air guides 180 and 210.

An upper portion of the inner curve 391 may face the first air guide 180 in the horizontal direction, and the first discharge passage 26 for guiding the air discharged from the first inner discharge part 25 to the outer discharge part 29 may be provided between the upper portion of the inner curve 391 and the first air guide 180.

A lower portion of the inner curve 391 may face the second air guide 210 in the horizontal direction, and the second discharge passage 28 for guiding the air discharged from the second inner discharge part 27 to the outer discharge part 29 may be provided between the lower portion of the inner curve 391 and the second air guide 210.

[Outer Curve of Outer Discharge Body]

The outer curve 392 may have a convex shape having a curvature in the vertical direction. The outer curve 392 may have an upper end contacting a lower end of an outer surface of the upper cover 120 and a lower end contacting an upper end of an outer surface of the lower cover 290.

Hereinafter, a third embodiment of the present disclosure will be described. Since the embodiments are the same as the first embodiment except for only portions of the constitutions, different points therebetween will be described principally, and descriptions of the same parts will be denoted by the same reference numerals and descriptions of the first embodiment.

Second Embodiment

Figure 39:
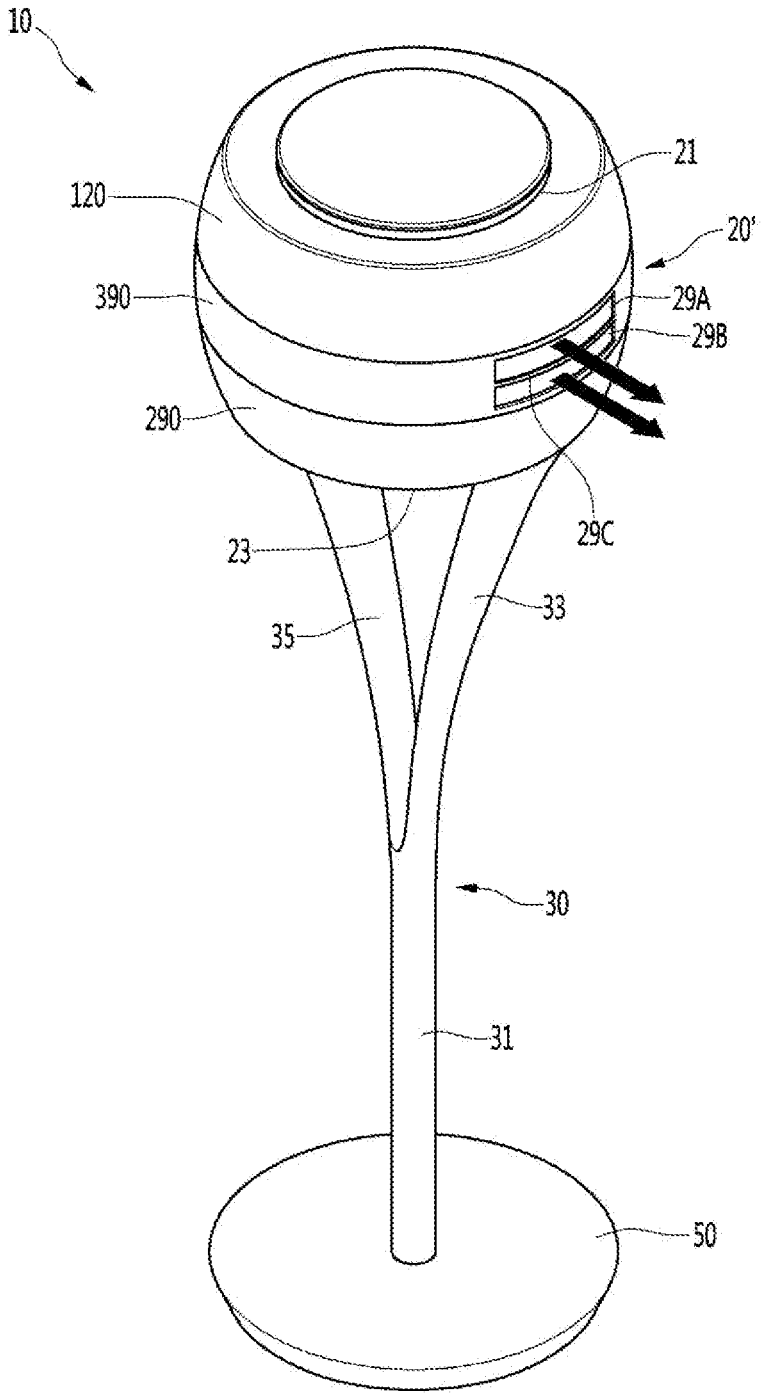
FIG. 39 is a perspective view illustrating a configuration of a flow generating device according to a second embodiment of the present invention.
Figure 40:
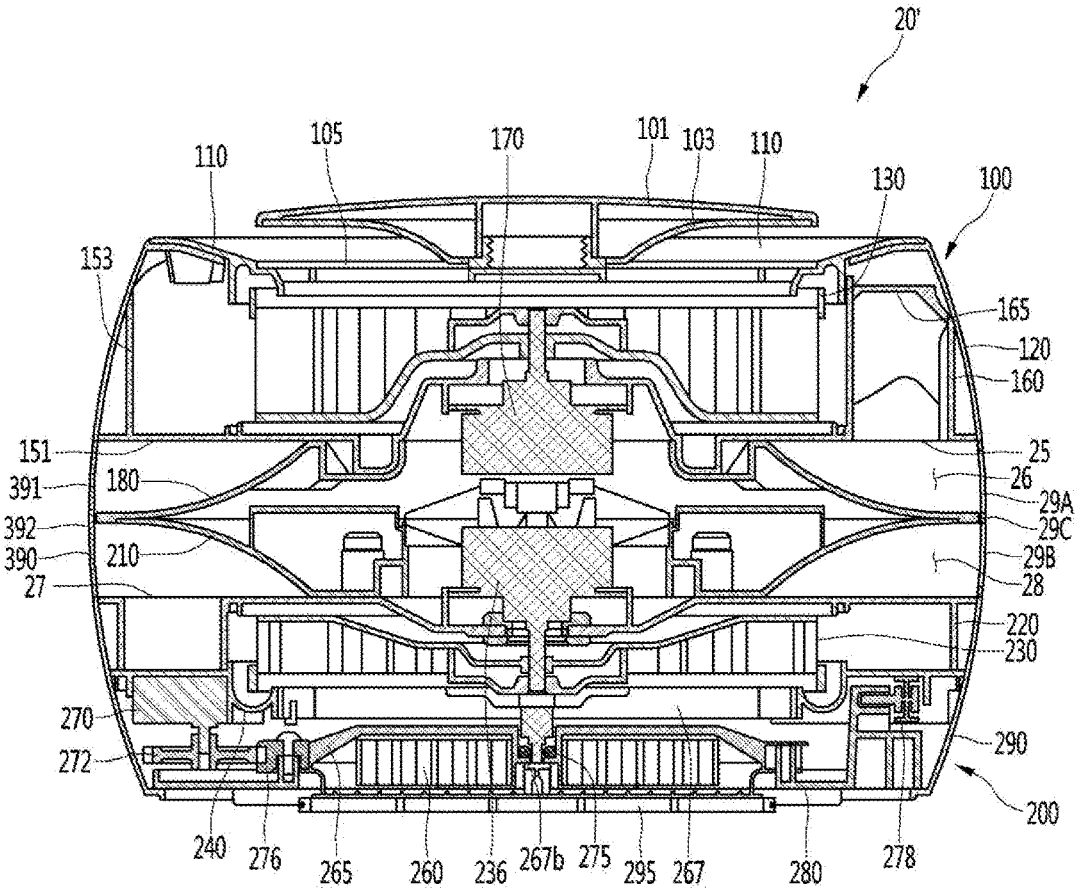
FIG. 40 is a cross-sectional view illustrating the inside of a main body illustrated in FIG. 39.

FIG. 39 is a perspective view illustrating a configuration of a flow generating device according to a second embodiment of the present invention, and FIG. 40 is a cross-sectional view illustrating the inside of a main body of FIG. 39.

[Main Body]

The main body 20' according to the embodiment includes a first outer discharge part 29A communicating with a first discharge passage 26 and a second outer discharge part 29B communicating with a second discharge passage 28. Here, other components and effect are the same or equal to those according to the first embodiment except for the first outer discharge part 29A and the second outer discharge part 29B, and thus, their detailed description will be omitted.

[Outer Discharge Body]

The outer discharge body 390 may be formed so that the first outer discharge part 29A and the second outer discharge part 29B are spaced apart from each other.

The direction in which the first outer discharge part 29A and the second outer discharge part 29B are separated from each other may be parallel to the separation direction between the first suction part 21 and the second suction part 23.

The outer discharge body 390 may include a shield part 29C disposed between the first outer discharge part 29A and the second outer discharge part 29B.

[Height of Shield Part]

The shield part 29C may be disposed at a height at which an outer circumference of a lower end of the first air guide 180 and an outer circumference of an upper end of the second air guide 210 face each other.

[Inner Surface of Shield Part]

The shield part 29C may include an inner surface facing the air guides 180 and 210. The inner surface may contact each of the outer circumference of the lower end of the first air guide 180 and the outer circumference of the upper end of the second air guide 210.

Each of the outer circumference of the lower end of the first air guide 180 and the outer circumference of the upper end of the second air guide 210 may be surrounded by the inner curve 391 of the outer discharge body 390 and the inner surface of the shield part 29C.

[Effect of Outer Discharge Body]

In the air guides 180 and 210, a gap between the first air guide 180 and the second air guide 210 may be entirely covered by the outer discharge body 390. Thus, the outer appearance may be more elegant and maintained in more clean state.

In this embodiment, the air guided to the first discharge passage 26 and the air guided to the second discharge passage 28 may be dispersed to be discharged to the first outer discharge part 29A and the second outer discharge part 29B.

Third Embodiment

Figure 41:
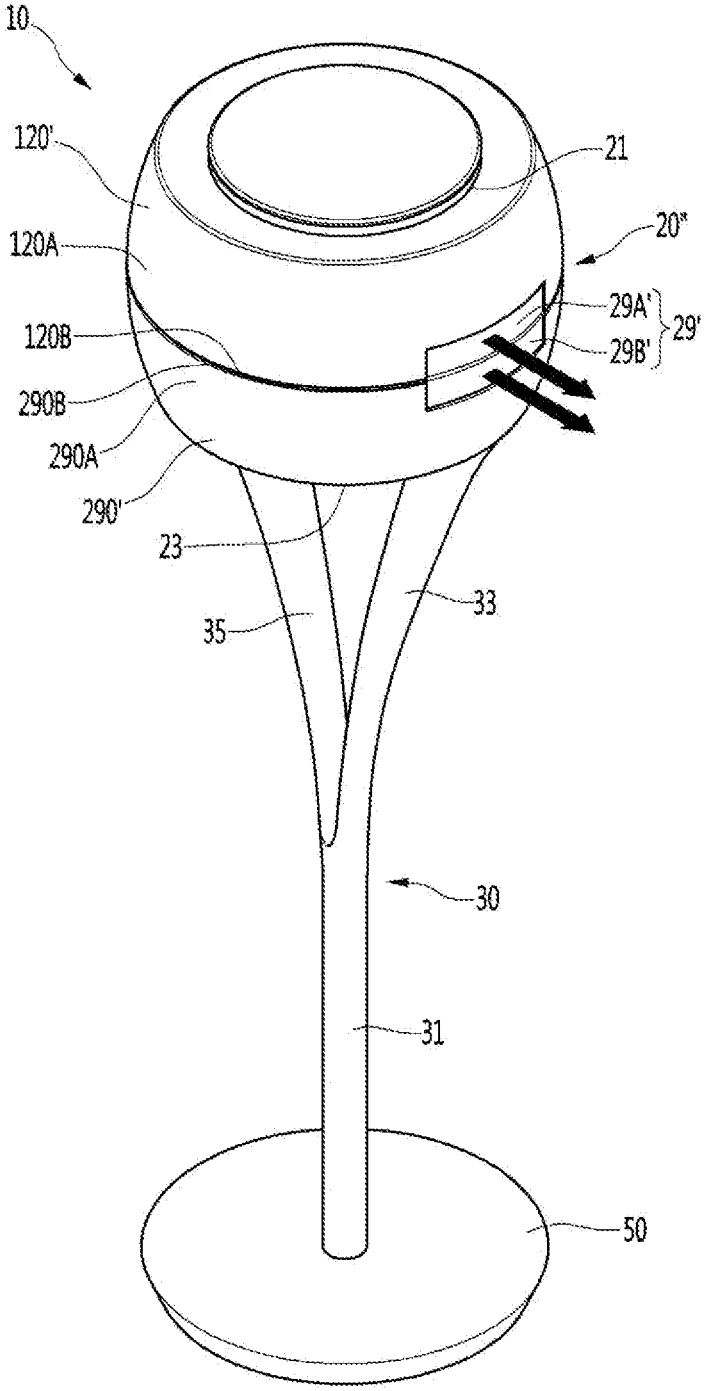
FIG. 41 is a perspective view illustrating a configuration of a flow generating device according to a third embodiment of the present invention.
Figure 42:
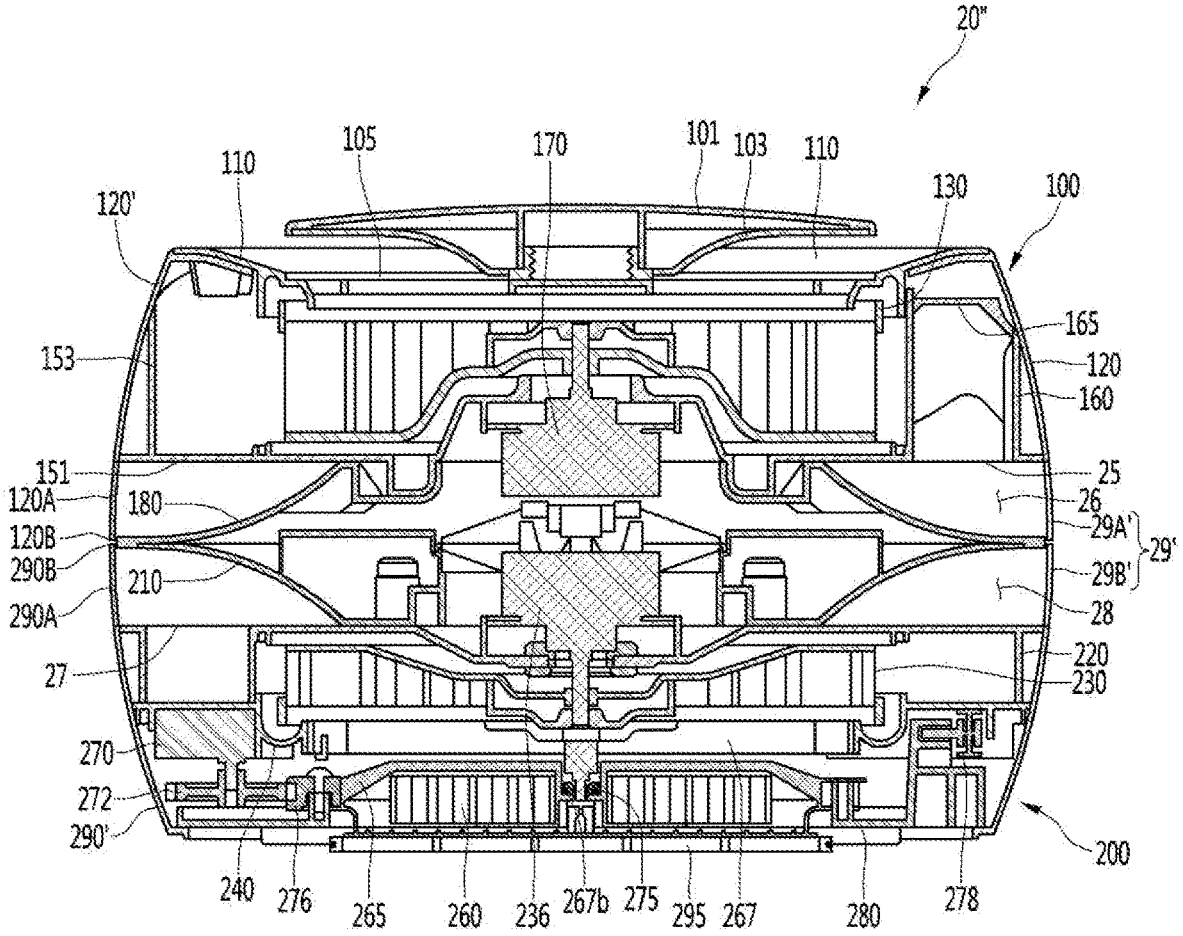
FIG. 42 is a cross-sectional view illustrating the inside of a main body illustrated in FIG. 41.

FIG. 41 is a perspective view illustrating a configuration of a flow generating device according to a third embodiment of the present invention, and FIG. 42 is a cross-sectional view illustrating the inside of a main body of FIG. 41.

[Main Body]

A main body 20" according to this embodiment may include an upper cover 120' having a lower passage body part 120A forming a first discharge passage 26, and a lower cover 290' having an upper passage body part 290A forming a second discharge passage 28.

Since the main body 20" of this embodiment is the same as or similar to the first embodiment except for the upper cover 120' and the lower cover 290', the same parts will be denoted by the same reference numerals, and detailed description thereof will be omitted.

[Lower Passage Body Part of Upper Cover]

The lower passage body part 120A may be disposed to surround an outer circumferential surface of a first air guide 180. The first discharge passage 26 may be provided between the outer circumferential surface of the first air guide 180 and an inner circumferential surface of the lower passage body part 120A.

[Upper Passage Body Part of Lower Cover]

The upper passage body part 290A may be disposed to surround an outer circumferential surface of a second air guide 210. The second discharge passage 28 may be provided between the outer circumferential surface of the second air guide 210 and an inner circumferential surface of the upper passage body part 290A.

[Contact Between Upper Cover and Lower Cover]

A lower end 120B of an upper cover 120' may contact an upper end 290B of a lower cover 290'.

[Outer Discharge Part]

According to this embodiment, the outer discharge part 29' may be provided in each of the upper cover 120' and the lower cover 290'.

A first outer discharge part 29A' communicating with a first discharge passage 26 may be provided in the upper cover 120'. Also, a second outer discharge part 29B' communicating with a second discharge passage 28 may be provided in the lower cover 290'.

The first outer discharge part 29A' and the second outer discharge part 29B' may form one opening when the upper cover 120' and the lower cover 290' contact each other. The opening may communicate with each of the first discharge passage 26 and the second discharge passage 28.

The invention claimed is:

1. A flow generating device comprising:

a main body comprising a first suction part and a second suction part disposed at sides opposite to each other, a first inner discharge part through which air suctioned into the first suction part passes, a second inner discharge part through which air suctioned into the second suction part passes, and at least one outer discharge part through which air passing through the first inner discharge part and air passing through the second inner discharge part are discharged to the outside;

a first fan disposed between the first suction part and the first inner discharge part; and a second fan disposed between the second suction part and the second inner discharge part, wherein the main body comprises:

a first fan housing in which the first inner discharge part is formed;

a second fan housing in which the second inner discharge part is formed; and a connector coupling the first fan housing and the second fan housing such that a discharge passage is formed between the first fan housing and the second fan housing, wherein the main body further comprises an outer discharge body which surrounds at least a portion of an outer circumference of the connector and in which the outer discharge part is formed, and wherein the outer discharge body defines an inner curved surface guiding the air passing through the first inner discharge part and the air passing through the second inner discharge part toward the outer discharge part.

2. The flow generating device according to claim 1, wherein the outer discharge part is opened in the main body in a radial direction.

3. The flow generating device according to claim 1, wherein an opening direction of the outer discharge part intersects with each of an opening direction of the first suction part and an opening direction of the second suction part.

4. The flow generating device according to claim 1, wherein the outer discharge part is opened in the main body in a horizontal direction.

5. The flow generating device according to claim 1, wherein a size of the outer discharge part is smaller than the sum of a size of the first suction part and a size of the second suction part.

6. The flow generating device according to claim 1, wherein the outer discharge part communicates with the discharge passage.

7. The flow generating device according to claim 1, the connector is coupled to the first fan housing and the second fan housing such that the first fan housing and the second fan housing are disposed in parallel.

8. The flow generating device according to claim 1, wherein the main body comprises:

a first cover in which the first suction part is formed; and a second cover in which the second suction part is formed, wherein the outer discharge body is disposed between the first cover and the second cover.

9. The flow generating device according to claim 1, wherein the inner curved surface contacts the outer circumference of the connector.

10. The flow generating device according to claim 1, wherein the connector comprises:

a first air guide defining a first discharge passage through which the air passing through the first inner discharge part passes; and a second air guide defining a second discharge passage through which the air passing through the second inner discharge part passes, wherein the outer discharge part communicates with each of the first discharge passage and the second discharge passage.

11. The flow generating device according to claim 1, wherein the connector comprises:

a first air guide defining a first discharge passage through which the air passing through the first inner discharge part passes; and a second air guide defining a second discharge passage through which the air passing through the second inner discharge part passes, wherein the outer discharge part comprises:

a first outer discharge part communicating with the first discharge passage; and a second outer discharge part communicating with the second discharge passage.

12. The flow generating device according to claim 1, wherein the flow generating device comprises:

a first air treating unit disposed between the first suction part and the second inner discharge part; and a second air treating unit disposed between the second suction part and the second inner discharge part, one of the first air treating unit and the second air treating unit is one of a temperature regulator, a cleanliness regulator, and a humidity regulator, and the other of the first air treating unit and the second air treating unit is the other of the temperature regulator, the cleanliness regulator, and the humidity regulator.

13. The flow generating device according to claim 1, wherein the main body further comprises:

an upper cover surrounding an outer circumference of the first fan;

an inlet cover disposed above the upper cover and defining an upper suction hole; and a top cover disposed above the inlet cover and shielding the upper suction hole.

14. The flow generating device according to claim 1, further comprising:

a base; and a leg provided below the main body and extending downward from the main body to be coupled to the base, wherein the second suction part faces the base in a vertical direction.

15. The flow generating device according to claim 14, wherein the leg comprises:

a leg main body coupled to the base and extending upward; and at least one leg extension part extending upward from the leg main body, wherein at least a portion of the at least one leg extension part is disposed below the second suction part.

16. The flow generating device comprising:

a main body comprising a first suction part and a second suction part disposed at sides opposite to each other, a first inner discharge part through which air suctioned into the first suction part passes, a second inner discharge part through which air suctioned into the second suction part passes, and at least one outer discharge part through which air passing through the first inner discharge part and air passing through the second inner discharge part are discharged to the outside;

a first fan disposed between the first suction part and the first inner discharge part; and a second fan disposed between the second suction part and the second inner discharge part, wherein a horizontal width of the main body is reduced from a central portion toward upper and lower portions.

17. The flow generating device comprising:

a main body comprising a first suction part and a second suction part disposed at sides opposite to each other, a first inner discharge part through which air suctioned into the first suction part passes, a second inner discharge part through which air suctioned into the second suction part passes, and at least one outer discharge part through which air passing through the first inner discharge part and air passing through the second inner discharge part are discharged to the outside;

a first fan disposed between the first suction part and the first inner discharge part; and a second fan disposed between the second suction part and the second inner discharge part, the flow generating device further comprising:

a base; and a leg provided below the main body and extending downward from the main body to be coupled to the base, wherein the second suction part faces the base in a vertical direction, wherein the leg comprises:

a leg main body coupled to the base and extending upward; and at least one leg extension part extending upward from the leg main body, wherein at least a portion of the at least one leg extension part is disposed below the second suction part, and wherein the at least one leg extension part comprises:

a first leg extension part extending from the leg main body in one direction; and a second leg extension part extending from the leg main body in another direction different from the direction of the first leg extension part, wherein a gap is formed between the first leg extension part and the second leg extension part.

* * * * *